US011739954B2

(12) United States Patent
Lei et al.

(10) Patent No.: US 11,739,954 B2
(45) Date of Patent: Aug. 29, 2023

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Zhisheng Lei, Foshan (CN); Zhigang Xing, Foshan (CN); Yu Liu, Foshan (CN); Kangwen Zhang, Foshan (CN); Hui Yu, Foshan (CN); Yuhang Tang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 748 days.

(21) Appl. No.: 16/497,962

(22) PCT Filed: Mar. 28, 2019

(86) PCT No.: PCT/CN2019/080148
§ 371 (c)(1),
(2) Date: Sep. 26, 2019

(87) PCT Pub. No.: WO2020/155355
PCT Pub. Date: Aug. 6, 2020

(65) Prior Publication Data

US 2021/0356145 A1 Nov. 18, 2021

(30) Foreign Application Priority Data

Feb. 3, 2019 (CN) ..... 201910108802.7
Feb. 3, 2019 (CN) ..... 201910108804.6
(Continued)

(51) Int. Cl.
*F24F 1/031* (2019.01)
*F24F 1/0323* (2019.01)
(Continued)

(52) U.S. Cl.
CPC ..... *F24F 1/031* (2019.02); *F24F 1/0323* (2019.02); *F24F 13/20* (2013.01); *F24F 13/24* (2013.01)

(58) Field of Classification Search
CPC ..... F24F 1/031; F24F 1/0323; F24F 13/20; F24F 13/24; F24F 1/027; F24F 13/32;
(Continued)

(56) References Cited

U.S. PATENT DOCUMENTS 2,719,342 A * 10/1955 Hunt ..... E06B 7/18 49/318
5,253,485 A * 10/1993 Kennedy ..... F24F 1/027 62/262
(Continued)

FOREIGN PATENT DOCUMENTS

CN 2560895 Y 7/2003
CN 101957025 A 1/2011
(Continued)

OTHER PUBLICATIONS

World Intellectual Property Organization (WIPO) Written Opinion for PCT/CN2019/080148 dated Nov. 1, 2019 9 Pages(Translation Included).
(Continued)

*Primary Examiner* — Cassey D Bauer
*Assistant Examiner* — Martha Tadesse
(74) *Attorney, Agent, or Firm* — Anova Law Group PLLC

(57) ABSTRACT

A window air conditioner includes a casing including a receiving groove formed at an outer peripheral wall of the
(Continued)

casing. The receiving groove has an open top, an open left side, and an open right side. The casing is divided into an indoor part and an outdoor part by the receiving groove. The window air conditioner further includes an indoor heat exchanger and an indoor fan arranged in the indoor part, and an outdoor heat exchanger and an outdoor fan arranged in the outdoor part.

20 Claims, 42 Drawing Sheets

(30) Foreign Application Priority Data

| | | |
|---|---|---|
| Feb. 3, 2019 | (CN) | 201910108813.5 |
| Feb. 3, 2019 | (CN) | 201920188025.7 |
| Feb. 3, 2019 | (CN) | 201920188029.5 |
| Feb. 3, 2019 | (CN) | 201920188059.6 |

(51) Int. Cl.
*F24F 13/20* (2006.01)
*F24F 13/24* (2006.01)

(58) Field of Classification Search
CPC ..... F24F 2221/20; F24F 1/62; F24F 1/0003; E06B 2007/023
See application file for complete search history.

(56) References Cited

U.S. PATENT DOCUMENTS

| | | | | |
|---|---|---|---|---|
| 5,467,610 | A * | 11/1995 | Bolton | F24F 1/027 62/262 |
| 2003/0110789 | A1 | 6/2003 | Cur et al. | |
| 2007/0137237 | A1 | 6/2007 | Rais | |
| 2017/0191763 | A1 * | 7/2017 | Xu | F24F 1/027 |

FOREIGN PATENT DOCUMENTS

| | | | |
|---|---|---|---|
| CN | 102425823 | A | 4/2012 |
| CN | 203586400 | U | 5/2014 |
| CN | 106765654 | A | 5/2017 |
| CN | 106765655 | A | 5/2017 |
| CN | 108870565 | A | 11/2018 |
| CN | 109184456 | A | 1/2019 |
| WO | 0225177 | A1 | 3/2002 |
| WO | 2020155355 | A1 | 8/2020 |

OTHER PUBLICATIONS

Canadian Intellectual Property Office the Office Action for CA Application No. 3057107 dated Feb. 9, 2021 5 Pages.
World Intellectual Property Organization (WIPO) International Search Report for PCT/CN2019/080148 dated Nov. 1, 2019 20 Pages(Translation Included).
Canadian Intellectual Property Office the Office Action for CA Application No. 3129267 dated Nov. 28, 2022 5 Pages.

* cited by examiner

WINDOW AIR CONDITIONER

CROSS-REFERENCE TO RELATED APPLICATIONS

This application is a National Stage Entry under 35 U.S.C. § 371 of International Application No. PCT/CN2019/080148, filed on Mar. 28, 2019, which is based on and claims priority to Chinese Patent Application Serial No. 201920188059.6, No. 201910108804.6, No. 201910108813.5, No. 201920188025.7, No. 201910108802.7, and No. 201920188029.5, filed on Feb. 3, 2019, the entire contents of all of which are incorporated herein by reference.

FIELD

The present disclosure relates to a field of air conditioning technology, and particularly, to a window air conditioner.

BACKGROUND

A window air conditioner of the related art has a casing which is generally a rectangular parallelepiped, and a window has a lower end abutting a top surface of the window air conditioner. The noise on the outdoor side of the window air conditioner is easily transmitted to the indoor side. The operating noise of the window air conditioner is relatively large. If the window air conditioner is sealed, the required sealing device is bulky and inconvenient to seal.

SUMMARY

The present disclosure aims to solve one of the technical problems existing in the related art to at least some extent. To this end, the present disclosure provides a window air conditioner that is easy to install and has a great sealing effect.

In order to achieve the above objective, embodiments of the present disclosure provide a window air conditioner. The window air conditioner is supported in a window opening of a wall, and a movable window is provided in the window opening. The window air conditioner includes a casing, the casing includes a receiving groove formed at an outer peripheral wall, the receiving groove has an open top, an open left side, and an open right side, the casing is divided into an indoor part and an outdoor part by the receiving groove, at least a part of the window is capable of extending into the receiving groove, and an indoor heat exchanger and an indoor fan are arranged in the indoor part, and an outdoor heat exchanger and an outdoor fan are arranged in the outdoor part.

The window air conditioner according to embodiments of the present disclosure has advantages of ease of installation and good sealing effect.

In addition, the window air conditioner according to embodiments of the present disclosure can have the following technical features.

According to some embodiments of the present disclosure, the window air conditioner further includes a sealing assembly configured to seal a space between the window and the window opening, and the sealing assembly is arranged at the casing.

According to some embodiments of the present disclosure, the casing includes: a chassis; a rear case fixed at the chassis; a front case fixed at the chassis, and spaced apart from the rear case in a front-rear direction to include the receiving groove. The chassis, the rear case, and the front case are independently machined parts.

According to some embodiments of the present disclosure, the casing further includes an intermediate partition board fixed at the chassis and located in the receiving groove, and the intermediate partition board has a front end and a rear end cooperating with the rear case and the front case, respectively.

According to some embodiments of the present disclosure, the rear case includes a rear case seat and a rear case cover, the rear case seat has an open top and is fixed at the chassis, and the rear case cover covers the top of the rear case seat.

According to some embodiments of the present disclosure, a part of a top wall of the rear case seat is provided with a supporting plate, another part of the top wall of the rear case seat is configured as a supporting step surface, the rear case cover covers an outer side of the supporting plate, and a lower end of the rear case cover is supported on the supporting step surface.

According to some embodiments of the present disclosure, the supporting plate is provided with a plurality of spaced supporting bosses, and each of the supporting bosses abuts against an inner peripheral wall of the rear case cover.

According to some embodiments of the present disclosure, the supporting step surface includes a fastening hole, the lower end of the rear case cover is provided with a fastener insert, and the fastener insert extends into the fastening hole.

According to some embodiments of the present disclosure, the chassis is an integrally formed member, a position of the rear case on the chassis is fixed, and a position of the front case on the chassis is fixed.

According to some embodiments of the present disclosure, the sealing assembly includes: a first connecting component having a variable length, and including a fixing component and a sliding block, at least a part of the fixing component being arranged in the receiving groove, and the sliding block being slidably fitted with the fixing component; and a plurality of second connecting components, any one of the second connecting components being detachably connected to the sliding block, and any two of the second connecting components being detachably connected to adjust a length of the sealing assembly.

According to some embodiments of the present disclosure, the sealing assembly further includes a rotating shaft bracket fixed at the casing, and the fixing component is rotatably arranged at the rotating bracket to enable the sealing assembly to be rotated to be stowed in the receiving groove.

According to some embodiments of the present disclosure, the window air conditioner further includes an angle-positioning assembly, the angle-positioning assembly cooperates with the rotating bracket and the fixing component to fix a position of the fixing component at a current angle, when the fixing component is rotated to a set angle.

According to some embodiments of the present disclosure, the angle-positioning assembly comprises a positioning protrusion and a plurality of positioning recesses, the positioning protrusion is arranged at the fixing component, and the plurality of positioning recesses are arranged in the rotating bracket and arranged in a ring; when the fixing component is rotated, the positioning protrusion can be switchably fitted with the plurality of positioning recesses, and when the positioning protrusion is fitted with one of the positioning recesses, the position of the fixing component is fixed.

According to some embodiments of the present disclosure, the window air conditioner further includes a slide-positioning assembly arranged at the fixing component and cooperating with the sliding block to fix the sliding block at a current position.

According to some embodiments of the present disclosure, the fixing component includes a sliding cavity therein, and at least a part of the sliding block extends into the sliding cavity.

According to some embodiments of the present disclosure, the slide-positioning assembly is configured as a rotating member, the rotating member is rotatably provided through the fixing component and is in threaded fit with the fixing component, the rotating member rotates to adjust a length of a portion, of the rotating member, extending into the sliding cavity, and the rotating member is capable of abutting against the sliding block to fix a position of the sliding block.

According to some embodiments of the present disclosure, the fixing component includes an avoidance hole in communication with the sliding cavity; the slide-positioning assembly comprises a resilient snap and a plurality of snapping positions, the plurality of snapping positions are arranged at an outer peripheral wall of the sliding block and spaced apart from one another along a moving direction of the sliding block, and the resilient snap is deformably arranged at an inner peripheral wall including the avoidance hole to be fitted with at least one of the snapping positions at a slope or separated from the at least one of the snapping positions; the slide-positioning assembly is configured in such a way that the sliding member is capable of moving in a direction away from the fixing component when the resilient snap is fitted with the snapping position at the slope, and the sliding member is capable of moving in a direction towards the fixing component when the resilient snap is separated from the snapping position.

According to some embodiments of the present disclosure, the sliding cavity has an inner wall provided with a sliding rib, and has an outer wall including a sliding groove that is fitted with the sliding rib.

According to some embodiments of the present disclosure, each of the second connecting components includes an insertion portion, each of the second connecting components and the sliding block both include an insertion chamber, and each insertion portion is fitted with the insertion chamber in a pluggable manner.

According to some embodiments of the present disclosure, one of the insertion portion and an inner wall of the insertion chamber is provided with a first resilient protrusion, the other one of the insertion portion and the inner wall of the insertion chamber includes a first recess, and the first resilient protrusion is capable of extending into the first recess.

According to some embodiments of the present disclosure, the first resilient protrusion is arranged in the insertion chamber, the first resilient protrusion has two opposite guiding slopes in an insertion-pull direction of the second connecting component, respective first ends of the two guiding slopes are fixed to the inner wall of the insertion chamber, and respective second ends of the two guiding slopes extend obliquely towards each other.

According to some embodiments of the present disclosure, the window air conditioner further includes a sealing end cover configured to seal an open end of the insertion chamber farthest from the fixing component.

According to some embodiments of the present disclosure, the window air conditioner further includes: an outdoor assembly comprising an outdoor housing, the outdoor heat exchanger, the outdoor fan, and an electric control box, wherein the outdoor heat exchanger, the outdoor fan, and the electric control box are arranged in the outdoor housing, and the outdoor housing has an outdoor air inlet and an outdoor air outlet; an indoor assembly comprising an indoor housing, the indoor heat exchanger, and the indoor fan, in which the indoor heat exchanger and the indoor fan are arranged in the indoor housing, and the indoor housing has an indoor air inlet and an indoor air outlet; and a partition assembly provided between the indoor assembly and the outdoor assembly, a receiving space being included above the partition assembly and between the outdoor assembly and the indoor assembly, wherein the window air conditioner is suitable to be supported on a window sill, the outdoor assembly is located on an outdoor side of the window sill, the indoor assembly is located on an indoor side of the window sill, and the window above the window sill is capable of moving downwards into the receiving space.

According to some embodiments of the present disclosure, the electric control box is located on a side of the outdoor fan adjacent to the indoor assembly.

According to some embodiments of the present disclosure, the window air conditioner further includes a chassis, the outdoor assembly, the indoor assembly, and the partition assembly are all arranged on the chassis, and the electric control box is mounted on the chassis.

According to some embodiments of the present disclosure, the electric control box includes a box body and a top cover, the box body includes a mounting chamber with an open top, and the top cover is arranged on the top of the box body to open or close the mounting chamber.

According to some embodiments of the present disclosure, at least a part of the outdoor air inlet is formed in a top wall of the outdoor housing.

According to some embodiments of the present disclosure, the outdoor heat exchanger is located on a side of the outdoor fan away from the indoor assembly; the outdoor fan comprises an axial flow fan blade and a water splash ring, the water splash ring is connected to an outer edge of the axial flow fan blade; the outdoor assembly further comprises an air guide ring surrounding the axial flow fan blade and located on a side of the water splash ring away from the outdoor heat exchanger, wherein in an axial direction of the axial flow fan blade, a distance between the water splash ring and the air guide ring is represented by L1, and a distance between the water splash ring and the outdoor heat exchanger is represented by L2, L1 is greater than or equal to 5 mm, and L2 is greater than or equal to 12 mm.

According to some embodiments of the present disclosure, the water splash ring and the outer edge of the axial flow fan blade are connected by a connecting portion. The connecting portion includes a first segment and a second segment, the first segment extends from the outer edge of the axial flow fan blade towards the outdoor heat exchanger, and the second segment extends from an extension tail end of the first segment towards a direction away from a central axis of the axial flow fan blade. The water splash ring is connected with an extension tail end of the second segment, the water splash ring has a diameter gradually increased in a direction from the air guide ring to the outdoor heat exchanger, the water splash ring has an inner peripheral surface provided with at least one water splash rib, and an end of the water splash ring adjacent to the air guide ring has an anti-backflow ring extending towards a central axis of the water splash ring.

According to some embodiments of the present disclosure, the indoor air outlet is located above the indoor air inlet, and the indoor air outlet extends obliquely upwards along a direction from the outdoor assembly to the indoor assembly.

According to some embodiments of the present disclosure, the indoor fan comprises a cross flow fan blade with an axis extending in a horizontal direction.

According to some embodiments of the present disclosure, the window air conditioner further includes a sealing assembly pivotally connected with the partition assembly to be rotatable between a stowed position and a sealing position. When the sealing assembly is pivoted to the stowed position, the sealing assembly is stowed in the receiving space; when the sealing assembly is pivoted to the sealing position, the sealing assembly realizes sealing between the window sill and the window.

According to some embodiments of the present disclosure, the window air conditioner further includes a chassis. The chassis includes a bottom plate and two side plates; the two side plates are arranged on two sides of the bottom plate, respectively, and include a mounting chamber along with the bottom plate; the mounting chamber comprises a first sub-chamber, a second sub-chamber, and a third sub-chamber sequentially arranged in a length direction of the side plates; the first sub-chamber is used to bear an indoor assembly of the window air conditioner, the third sub-chamber is used to bear an outdoor assembly of the window air conditioner, and the second sub-chamber is used to bear a partition assembly partitioning the indoor assembly from the outdoor assembly; any one of the side plates has a concave portion recessed towards the other of the side plates, and the concave portion constitutes a side wall including the second sub-chamber.

According to some embodiments of the present disclosure, the bottom plate has an upper surface including a drainage groove recessed downwards, the drainage groove is located in the third sub-chamber and comprises a water collecting portion and a water guiding portion, the water collecting portion extends from one of the side plates to the other of the side plates, and the water guiding portion starts from an intersection of the water collecting portion and the side plates and extends along the length direction of the side plates towards the first sub-chamber.

According to some embodiments of the present disclosure, two water guiding portions are provided and arranged on two longitudinal sides of the water collecting portion.

According to some embodiments of the present disclosure, the bottom plate has an upper surface provided with a rib, the rib is located between the first sub-chamber and the third sub-chamber, and the rib extends along a direction from one of the side plates to the other of the side plates.

According to some embodiments of the present disclosure, the rib is spaced apart from the two side plates.

According to some embodiments of the present disclosure, the bottom plate has a lower surface includes an avoidance groove recessed upwards, and the avoidance groove is at least located below the second sub-chamber.

According to some embodiments of the present disclosure, the avoidance groove extends along a length direction of the side plates and extends to a drainage groove; the drainage groove is included in an upper surface of the bottom plate, recesses downwards, and located in the third sub-chamber; two sides of the avoidance groove in a width direction are each provided with a rib, the rib is arranged on the upper surface of the bottom plate and located on a side of the first sub-chamber adjacent to the second sub-chamber, and the rib extends in a direction from one of the side plates to the other of the side plates.

According to some embodiments of the present disclosure, the bottom plate has an upper surface provided with at least one bracket, and the bracket is located in the second sub-chamber to support the partition assembly.

According to some embodiments of the present disclosure, the partition assembly and the chassis include a drainage via hole therebetween, the indoor assembly further comprises a drain pan provided below the indoor heat exchanger, the drain pan has an extension segment, and the extension segment passes through the drainage via hole and extends to the water guiding portion to output water from the drain pan to the water guiding portion.

A window air conditioner assembly according to embodiments of a second aspect of the present disclosure includes the window air conditioner according to embodiments of a second aspect of the present disclosure, in which the bottom plate has a lower surface including an avoidance groove recessed upwards, and the avoidance groove is at least located below the second sub-chamber; and a mounting frame assembly provided on a window sill, received in the avoidance groove, and configured to allow the window air conditioner to be supported on the window sill through the mounting frame assembly.

With the window air conditioner assembly according to the embodiments of the present disclosure, installation convenience, stability and reliability of the window air conditioner can be improved.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of embodiments of the present disclosure will become apparent and more readily appreciated from the following descriptions made with reference the accompanying drawings, in which.

Figure 1:
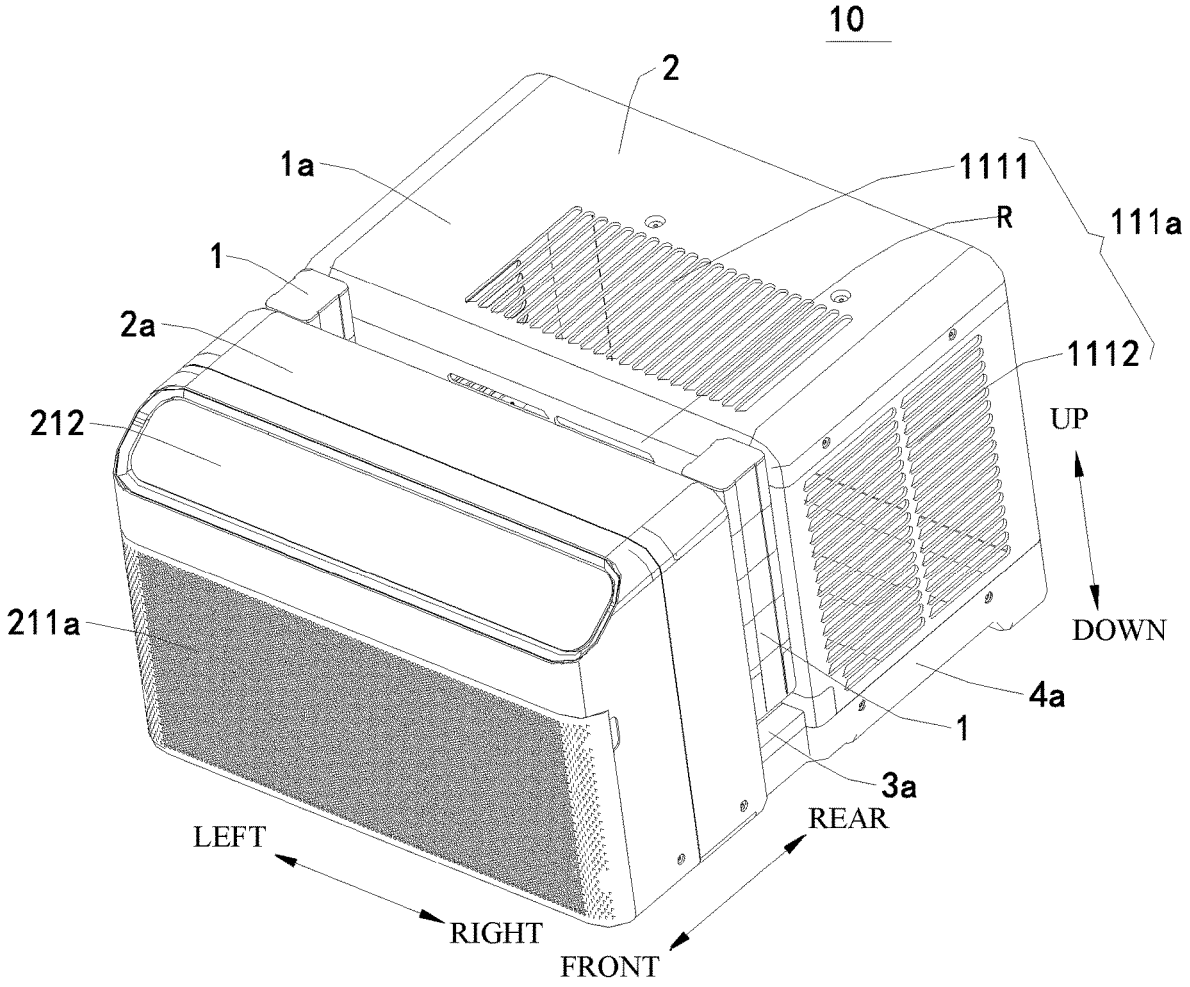
FIG. 1 is a schematic view of a window air conditioner according to an embodiment of the present disclosure.

REFERENCE NUMERALS window air conditioner 10, sealing assembly 1, first connecting component 100, fixing component 110, mating protrusion 111, sliding cavity 112, sliding rib 113, pivot shaft 114, guide groove 115, avoidance hole 116, receiving space 117, sliding block 120, sliding groove 121, guiding boss 122, second connecting component 200, insertion portion 210, first recess 211, insertion chamber 220, first resilient protrusion 221, guiding slope 222, second recess 230, rotating bracket 300, pivot hole 310, mating plate 320, protruding portion 330, fixing hole 340, angle-positioning assembly 400, positioning protrusion 410, positioning recess 420, slide-positioning assembly 500, resilient snap 510, snapping position 520, sealing end cover 600, sealing-matching component 700, casing 2, receiving groove 21, chassis 22, rear case 23, rear case seat 24, supporting plate 241, supporting step surface 242, supporting boss 243, fastening hole 244, rear case cover 25, fastener insert 251, front case 26, intermediate partition board 27, placement space 270, wall 3, window opening 31, window 4, window air conditioner assembly 200*a*, window sill 101, outdoor side 101*a*, indoor side 101*b*, mounting opening

102*a*, mounting frame assembly 103, outdoor assembly 1*a*, outdoor housing 11, outdoor heat exchanger 12, outdoor fan 13, electric control box 14, air guide ring 15, compressor 16, back panel 17, outdoor air inlet 111*a*, outdoor air outlet 112*a*, axial flow fan blade 131, water splash ring 132, connecting portion 133, water splash rib 134, anti-backflow ring 135, outdoor motor 136, motor frame 137, box body 141, mounting chamber 141*a*, top cover 142, flange 142*a*, connecting member 143, first outdoor air inlet 1111, second outdoor air inlet 1112, central axis 1310 of axial flow fan blade, central axis 1320 of water splash ring, first segment 1331, second segment 1332, extension tail end 1331*a* of first segment, extension tail end 1332*a* of second segment, indoor assembly 2*a*, indoor housing 21*a*, indoor heat exchanger 22*a*, indoor fan 23*a*, indoor air inlet 211*a*, indoor air outlet 212, air channel 230*a*, cross flow fan blade 231, partition assembly 3*a*, chassis 4*a*, water collecting groove 41, sealing assembly 1, first end 51, second end 52, first sub-chamber 101*c*, second sub-chamber 102, third sub-chamber 103*a*, bottom plate 11*a*, drainage groove 111*b*, water collecting portion 1111*a*, water guiding portion 1112*a*, rib 112*b*, avoidance groove 113*a*, bracket 114*a*, side plate 12*d*, concave portion 121*a*, first side portion 12*a*, second side portion 12*b*, third side portion 12*c*, indoor assembly 2*a*, indoor housing 21*a*, drain pan 24*a*, extension segment 241*a*, outdoor assembly 1*a*, outdoor housing 11, partition member 41*a*, foam member 42, drainage via hole 401, wiring via hole 402, sealing assembly 1, body 51*a*, end portion 510*a*, pivoting portion 52*a*.

DETAILED DESCRIPTION

Embodiments of the present disclosure will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present disclosure, but shall not be construed to limit the present disclosure.

A window air conditioner 10 according to embodiments of the present disclosure will be described with reference to the drawings.

FIGS. 1-28 illustrate the window air conditioner 10 according to embodiments of the present disclosure.

The window air conditioner 10 is supported in a window opening 31 of a wall 3, and a movable window 4 is provided in the window opening 31. The window air conditioner 10 includes a casing 2, the casing 2 includes a receiving groove 21 at an outer peripheral wall, and the receiving groove 21 has an open top, an open left side, and an open right side (an up-down direction as indicated by arrow A in FIGS. 1-2, and a left-right direction as indicated by arrow C in FIGS. 1-2). The casing 2 is divided into an indoor part and an outdoor part through the receiving groove 21. At least a part of the window 4 is capable of extending into the receiving groove 21. The indoor part is provided with an indoor heat exchanger and an indoor fan therein, while the outdoor part is provided with an outdoor heat exchanger and an outdoor fan therein.

In the window air conditioner 10 according to embodiments of the present disclosure, the casing 2 is partitioned into the indoor part and the outdoor part by the receiving groove 21 in the outer peripheral wall of the casing 2, and at least a part of the window 4 can extends into the receiving groove 21. This facilitates installation of the window air conditioner 10 into the window opening 31, facilitates the fitting between the window air conditioner 10 between the window opening 31 and the window 4, thereby improving structural reliability and stability of the window air conditioner 10 after the installation, and facilitating operational reliability of the window air conditioner 10.

Moreover, the casing 2 is partitioned into the indoor part and the outdoor part by the receiving groove 21, such that a space between the window 4 and the window opening 31 is sealed, thereby improving a sealing effect at the window opening 31 after the window air conditioner 10 is installed. Therefore, it is convenient to improve a thermal insulation effect and a sound insulation effect between the indoors and the outdoors, avoid influence of an outdoor temperature on an indoor temperature, and prevent outdoor noise from generating any influence on the indoors, thereby upgrading user experience, and improving functionality and adaptability of the window air conditioner 10.

In addition, the casing 2 is partitioned into the indoor part and the outdoor part by the receiving groove 21, such that the window air conditioner 10 cooperates with the window 4 and the window opening 31, in which way the appearance of the window air conditioner 10 is more tidy and beautiful after installation, thereby upgrading the user experience.

Further, compared with the related art where a receiving groove is recessed upwards from a bottom wall of a casing, since the top, the left side, and the right side of the receiving groove 21 are open, the window air conditioner 10 can be stressed more uniformly and be prevented from being damaged by a large force exerted on a top wall of the window air conditioner 10, thereby enhancing the arrangement reliability and operational performance of the window air conditioner 10, and moreover, an air outlet of the window air conditioner 10 can be set at a higher position, which makes it convenient for an air-out flow to flow in the indoor space, increases temperature regulation efficiency of the window air conditioner 10, and improves an adjustment effect of the window air conditioner 10 on the indoor temperature.

Therefore, the window air conditioner 10 according to the embodiments of the present disclosure has advantages, such as easy installation, good sealing performance, and the like.

The window air conditioner 10 according to specific embodiments of the present disclosure will be described below with reference to the drawings.

In some specific embodiments of the present disclosure, FIGS. 1-28 illustrate the window air conditioner 10 according to embodiments of the present disclosure.

Specifically, as shown in FIGS. 20-23, the window air conditioner 10 further includes a sealing assembly 1 used to seal a space between the window 4 and the window opening 31, and the sealing assembly 1 is arranged at the casing 2. Thus, by means of the sealing assembly 1, the sealing performance between the window 4 and the window opening 31 can be enhanced, and the thermal insulation effect and the sound insulation effect between the indoors and the outdoors can be improved.

Optionally, as shown in FIGS. 20-23, the casing 2 includes a chassis 22, a rear case 23, and a front case 26 (a front-rear direction indicated by arrow B in FIGS. 1-2), and the rear case 23 is fixed at the chassis 22. The front case 26 is fixed at the chassis 22, and the front case 26 and the rear case 23 are spaced apart in the front-rear direction to form the receiving groove 21. The chassis 22, the rear case 23, and the front case 26 are independently machined parts, which not only facilitates the formation of the receiving groove 21 and hence the fitting between the window air conditioner 10 and the window 4, but also facilitates the processing of the chassis 22, the rear case 23, and the front case 26 individually to allow the chassis 22, the rear case 23, and the front case 26 to be processed by using different materials. For example, the rear case 23 is a sheet metal piece, and the front case 26 is a plastic piece, which improves the structural performance and the appearance of the casing 2.

Specifically, as shown in FIG. 20 to FIG. 23, the casing 2 further includes an intermediate partition board 27 fixed at the chassis 22 and located in the receiving groove 21, and front and rear ends of the intermediate partition board 27 cooperate with the rear case 23 and the front case 26, respectively. In such a way, a lower surface of the window 4 can abut against the intermediate partition board 27, which facilitates the wiring and drainage of the window air conditioner 10 and enhances the operational reliability of the window air conditioner 10.

More specifically, the intermediate partition board 27 is connected to a rotating bracket 300 by a screw.

Optionally, as shown in FIGS. 20-23, the rear case 23 includes a rear case seat 24 and a rear case cover 25. The rear case seat 24 has an open top and is fixed at the chassis 22, and the rear case cover 25 covers the top of the rear case seat 24. Thus, the structural flexibility of the rear case 23 is improved, and the disassembly and installation of parts in the rear case 23 is facilitated.

Further, the front case 24 is a sheet metal piece or a plastic piece, the rear case 23 is a sheet metal piece, and the intermediate partition board 27 is a plastic piece.

Figure 22:
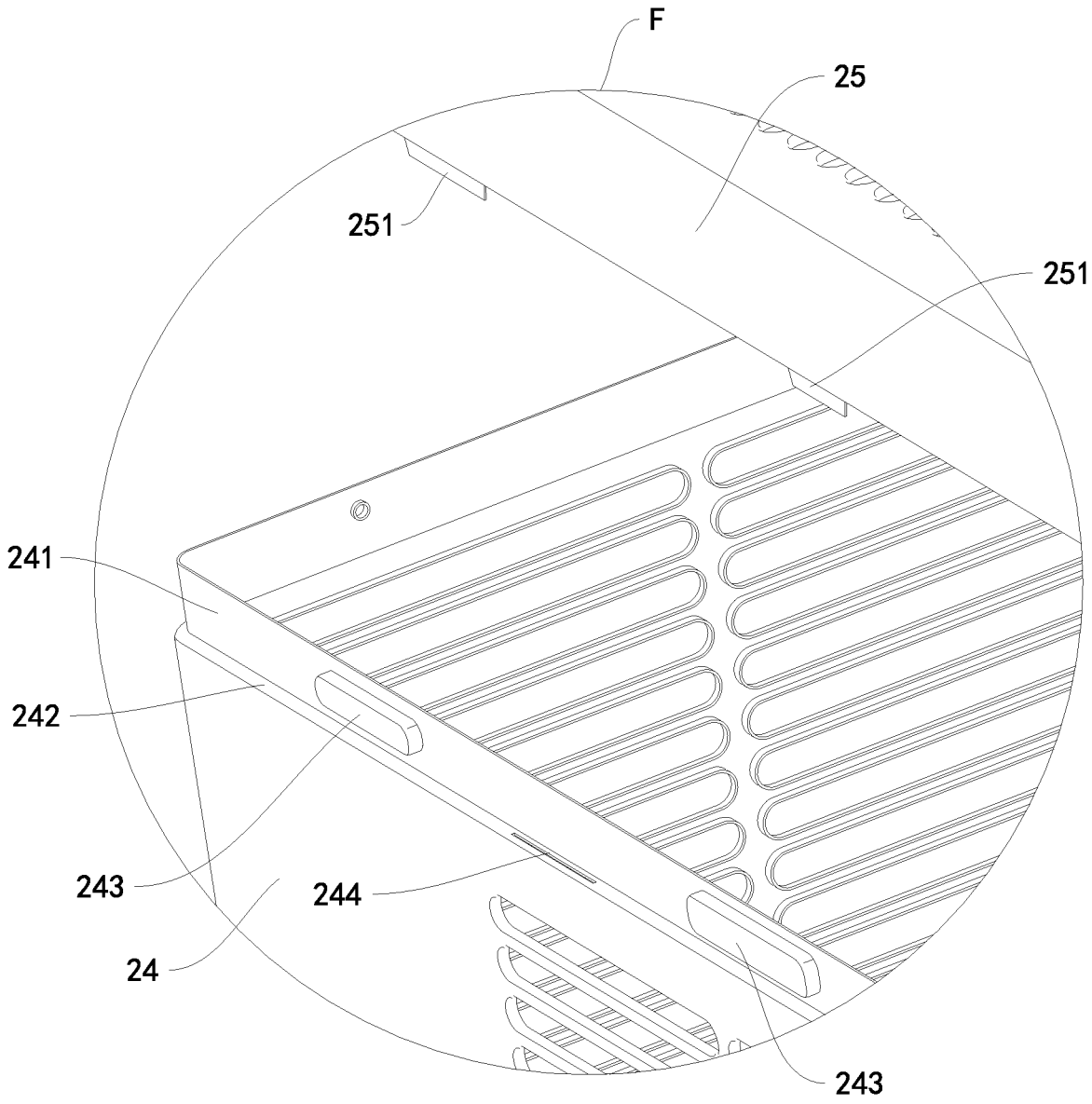
FIG. 22 is an enlarged view of part F in FIG. 21.
Figure 23:
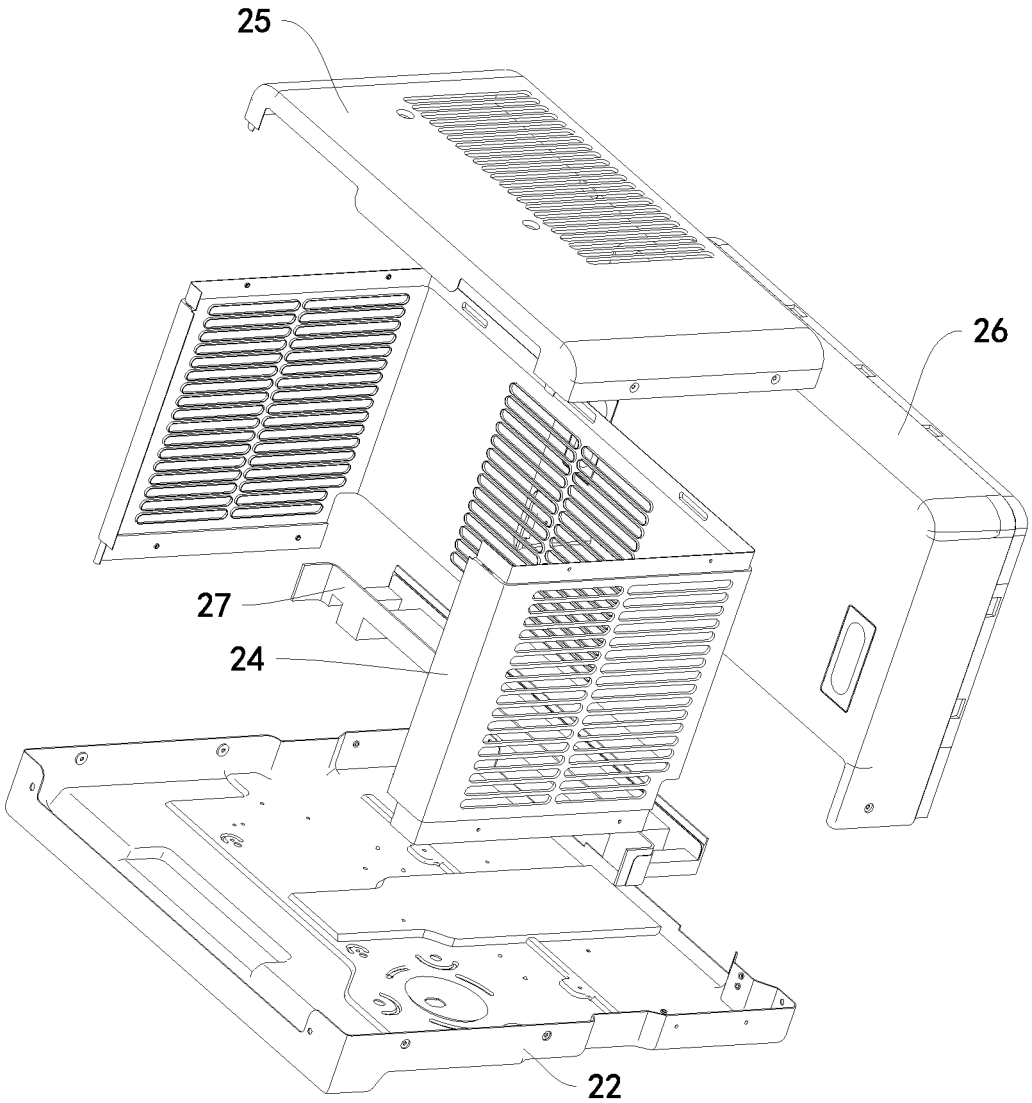
FIG. 23 is an exploded view of a casing of a sealing assembly of a window air conditioner according to an embodiment of the present disclosure.

Specifically, as shown in FIG. 22, a part of a top wall of the rear case seat 24 is provided with a supporting plate 241, and another part of the top wall of the rear case seat 24 is configured as a supporting step surface 242. The rear case cover 25 covers an outer side of the supporting plate 241, and a lower end of the rear case cover 25 is supported on the supporting step surface 242. Thus, the mounting and connection of the rear case seat 24 and the rear case cover 25 is facilitated, the reliability of connection between the rear case seat 24 and the rear case cover 25 is enhanced, and the structural stability of the casing 2 is further improved.

More specifically, as shown in FIG. 22, the supporting plate 241 is provided with a plurality of spaced supporting bosses 243, each of which abuts against an inner peripheral wall of the rear case cover 24. Thus, the inner peripheral wall of the rear case cover 24 can be supported by the supporting bosses 243, and the strength of connection between the case seat 24 and the rear case cover 25 can be improved.

Optionally, as shown in FIG. 22, the supporting step surface 242 includes a fastening hole 244, the lower end of the rear case cover 25 is provided with a fastener insert 251, and the fastener insert 251 extends into the fastening hole 244. Thus, the rear case cover 25 can be positioned, disassembled and installed conveniently, and the connection reliability of the rear case seat 24 and the rear case cover 25 is further improved.

Specifically, the chassis 22 is an integrally formed member, the position of the rear case 23 on the chassis 22 is fixed, and the position of the front case 26 on the chassis 22 is fixed. Compared with the related art where a chassis is made of pieces and is movable relative to the rear case or the front case, not only the structure of the chassis 22 can be simplified and the structure of the window air conditioner 10 will not be too complicated, thereby facilitating the processing of the chassis 22, but also the structural strength of the chassis 22 can be reinforced, thereby improving the structural reliability and stability of the window air conditioner 10.

Figure 4:
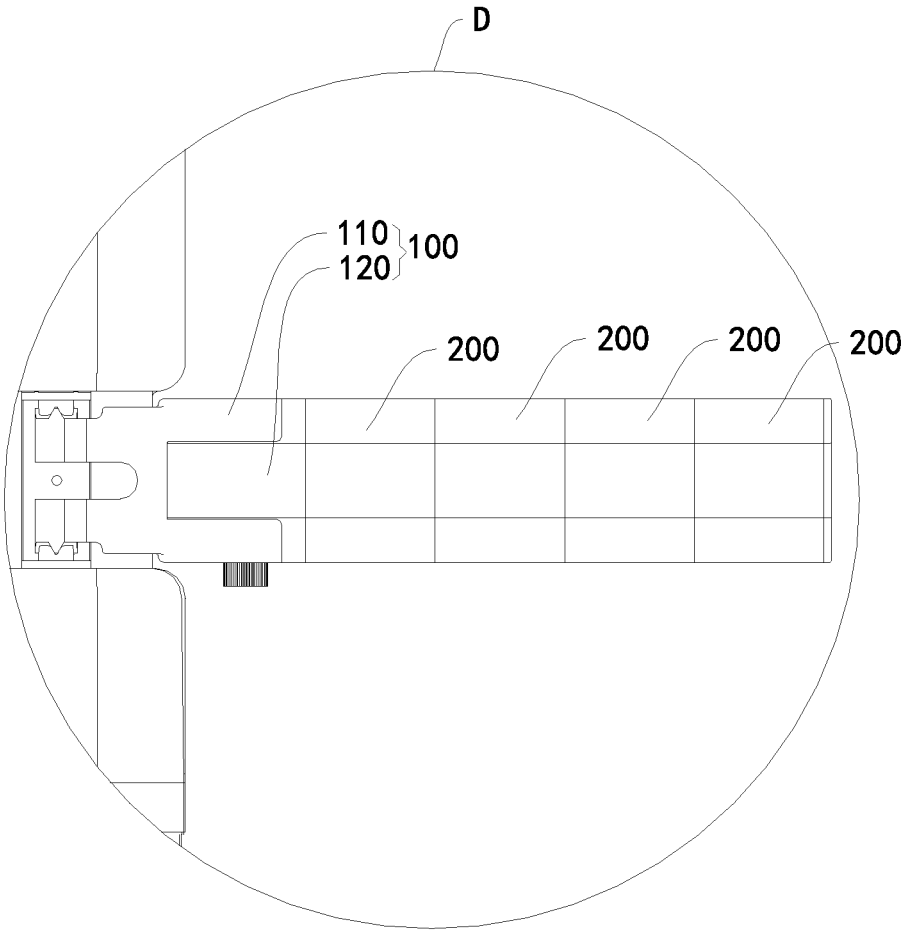
FIG. 4 is an enlarged view of part D in FIG. 3.
Figure 5:
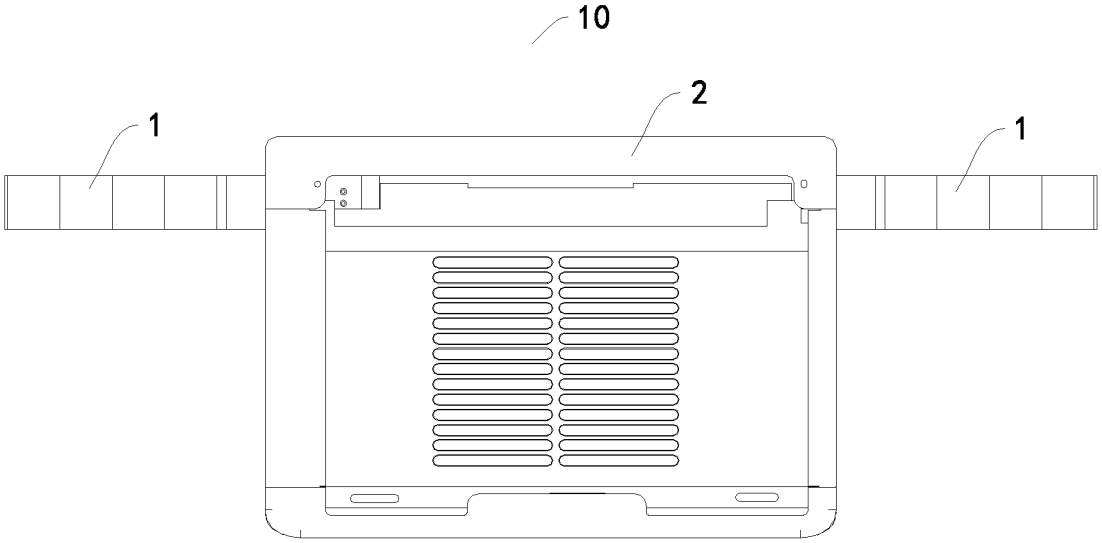
FIG. 5 is a schematic view of a window air conditioner according to an embodiment of the present disclosure.
Figure 6:
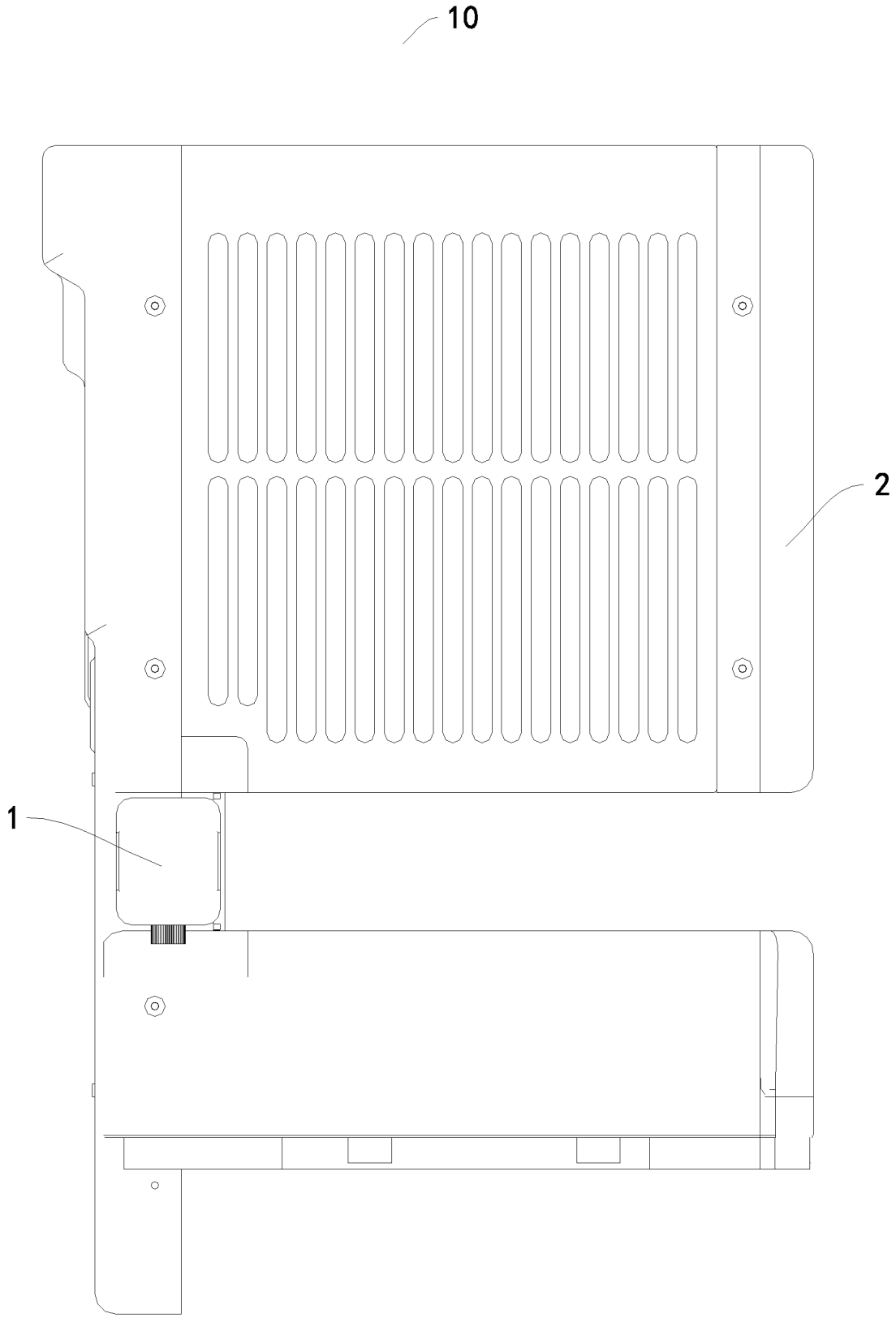
FIG. 6 is a schematic view of a window air conditioner according to an embodiment of the present disclosure.

In some embodiments of the present disclosure, as shown in FIG. 4, the sealing assembly 1 includes a first connecting component 100 having a variable length and a plurality of second connecting components 200. The first connecting component 100 includes a fixing component 110 and a sliding block 120. At least a part of the fixing component 110 is arranged in the receiving groove 21, and the sliding block 120 is slidably fitted with the fixing component 110. Any one of the second connecting components 200 can be detachably connected to the sliding block 120, and any two of the second connecting components 200 can be detachably connected with each other, so as to adjust the length of the sealing assembly 1. Thus, the sealing assembly 1 can be mounted to the window air conditioner 10 by means of the fixing component 110, thereby facilitating the arrangement of the sealing assembly 1 and avoiding the loss of the sealing assembly 1, and the sliding fit between the sliding block 120 and the fixing component 110 can adjust the length of the first connecting component 100 so as to adjust the sealing length of the sealing assembly 1. Therefore, the sealing assembly 1 can seal windows 4 of different sizes, thereby facilitating the sealing effect of the sealing assembly 1 and broadening the application range of the sealing assembly 1, so as to increase the application range of the window air conditioner 10 and improve the functionality and applicability of the window air conditioner 10.

Further, with the plurality of second connecting components 200, any one of the second connecting components 200 can be detachably connected to the sliding block 120, and any two of the second connecting components 200 can be detachably connected with each other, which improves the structural flexibility of the sealing assembly 1, that is, the length of the sealing assembly 1 can be adjusted by connecting different numbers of the second connecting components 200, so as to broaden a variation range of the sealing length of the sealing assembly 1, and adapt the sealing assembly 1 to windows 4 of different sizes, thereby further enhancing the sealing reliability and stability of the sealing assembly 1, and further improving the application range of the sealing assembly 1.

Figure 7:
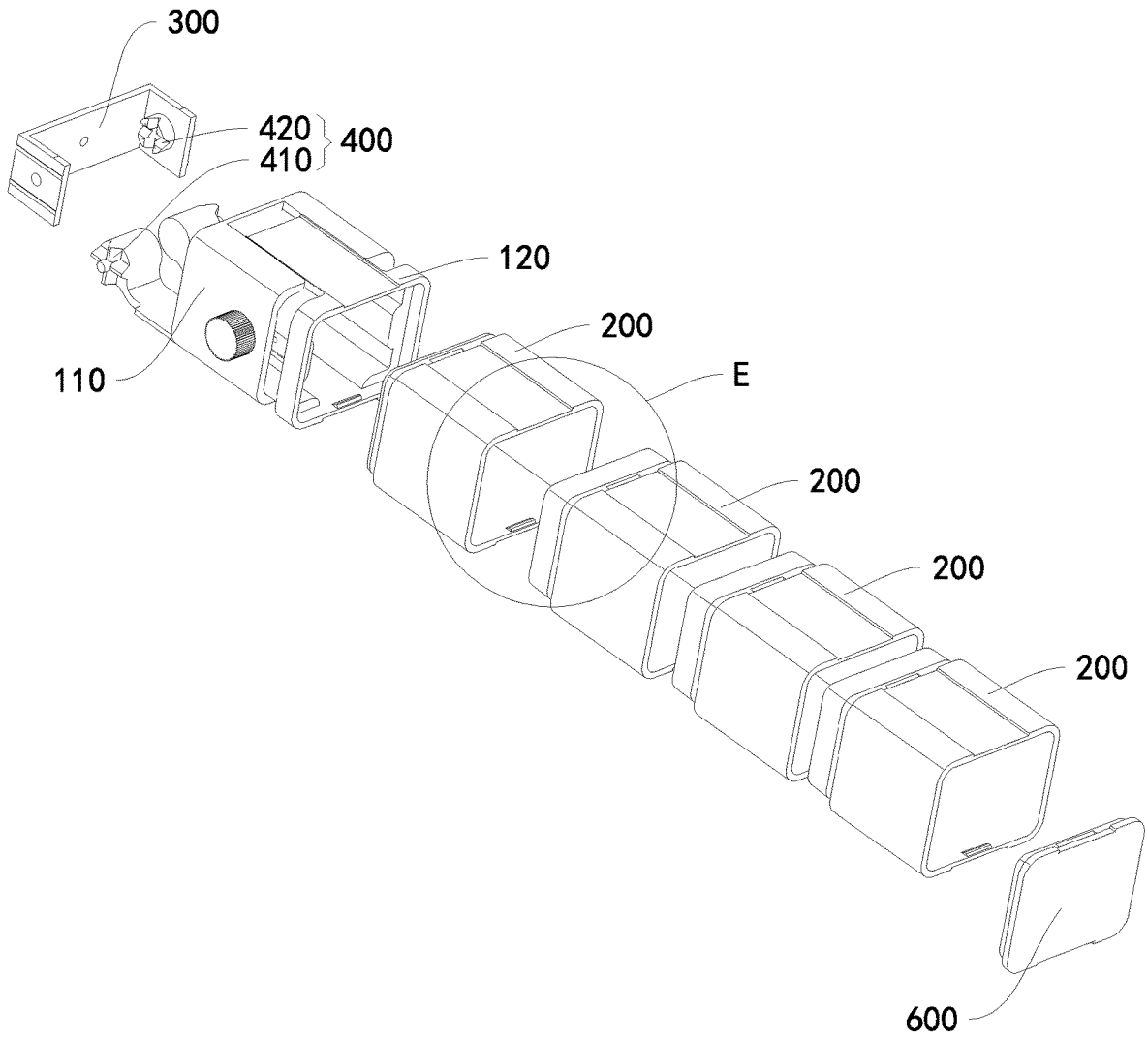
FIG. 7 is an exploded view of a sealing assembly of a window air conditioner according to an embodiment of the present disclosure.

Optionally, as shown in FIG. 7, the sealing assembly 1 further includes the rotating bracket 300 which is fixed at the casing 2, and the fixing component 110 is rotatably arranged at the rotating bracket 300, such that the sealing assembly 1 can be rotated to be stowed in the receiving groove 21. Thus, it is possible to facilitate the installation and arrangement of the fixing component 110, and realize the rotation of the fixing component 110 relative to the rotating bracket 300, facilitating the storage of the sealing assembly 1, and reducing the space occupied by the sealing assembly 1.

Figure 12:
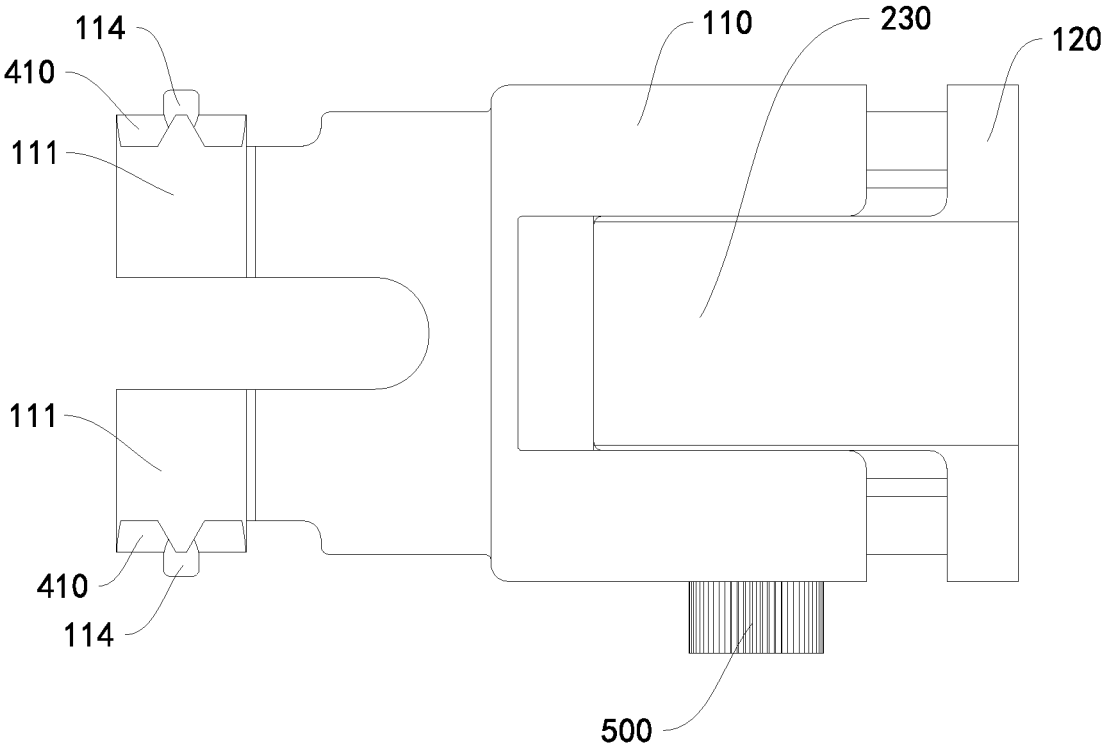
FIG. 12 is a schematic view of a partial structure of a sealing assembly of a window air conditioner according to some embodiments of the present disclosure.

Further, as shown in FIG. 12, the fixing component 110 is provided with a pivot shaft 114, the rotating bracket 300 is provided with a pivot hole 310, and the pivot shaft 114 is rotatably fitted with the pivot hole 310. Thus, the fitting between the pivot shaft 114 and the pivot hole 310 can facilitate smooth rotation of the fixing component 110, and improve the reliability of the rotation of the fixing component 110.

Specifically, as shown in FIG. 7, the sealing assembly 1 further includes an angle-positioning assembly 400 that cooperates with the rotating bracket 300 and the fixing component 110, such that when the fixing component 110 is rotated to a set angle, the fixing component 110 is fixed at the current angle. In this way, the fixing component 110 can be positioned at a specific angle. For example, the fixing component 110 is positioned at an angle of 90°, 45° or 30° relative to a horizontal direction. Thus, a user can fix the rotation angle of the fixing component 110 according to requirements, thereby improving the performance of the sealing assembly 1.

More specifically, the angle-positioning assembly 400 includes a positioning protrusion 410 and a plurality of positioning recesses 420. One of the rotating bracket 300 and the fixing component 110 is provided with the positioning protrusion 410, and the other one of the rotating bracket 300 and the fixing component 110 is provided with the plurality of positioning recesses 420.

Further, the positioning protrusion 410 is arranged at the fixing component 110, and the plurality of positioning recesses 420 are arranged on the rotating bracket 300. Specifically, the plurality of positioning recesses 420 are arranged in a ring, and when the fixing component 110 is rotated, the positioning protrusion 410 can be switchably fitted with the plurality of positioning recesses 420, that is, the positioning protrusion 410 is fitted with one of the positioning recesses 420 to fix a position of the fixing component 110. Thus, the positioning protrusion 410 and the positioning recesses 420 can be used to fix the rotation angle of the fixing component 110, thereby facilitating the positioning reliability and stability of the fixing component 110.

Furthermore, a plurality of positioning protrusions 410 are provided and arranged in a ring, and the plurality of positioning protrusions 410 are fitted with the plurality of positioning recesses 420 in one-to-one correspondence. In this way, the angle-positioning assembly 400 can be stressed more uniformly, the structural strength of the angle-positioning assembly 400 can be reinforced, and the positioning reliability and accuracy of the angle-positioning assembly 400 can be improved.

Figure 9:
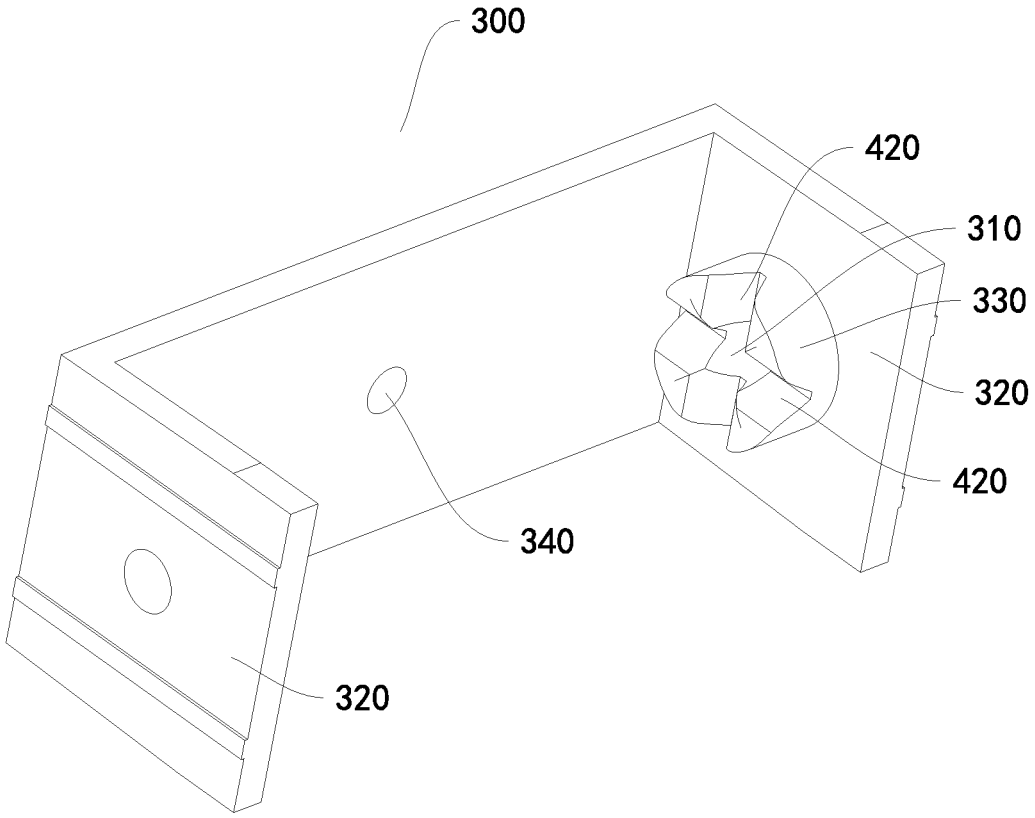
FIG. 9 is a schematic view of a rotating bracket of a sealing assembly of a window air conditioner according to an embodiment of the present disclosure.
Figure 10:
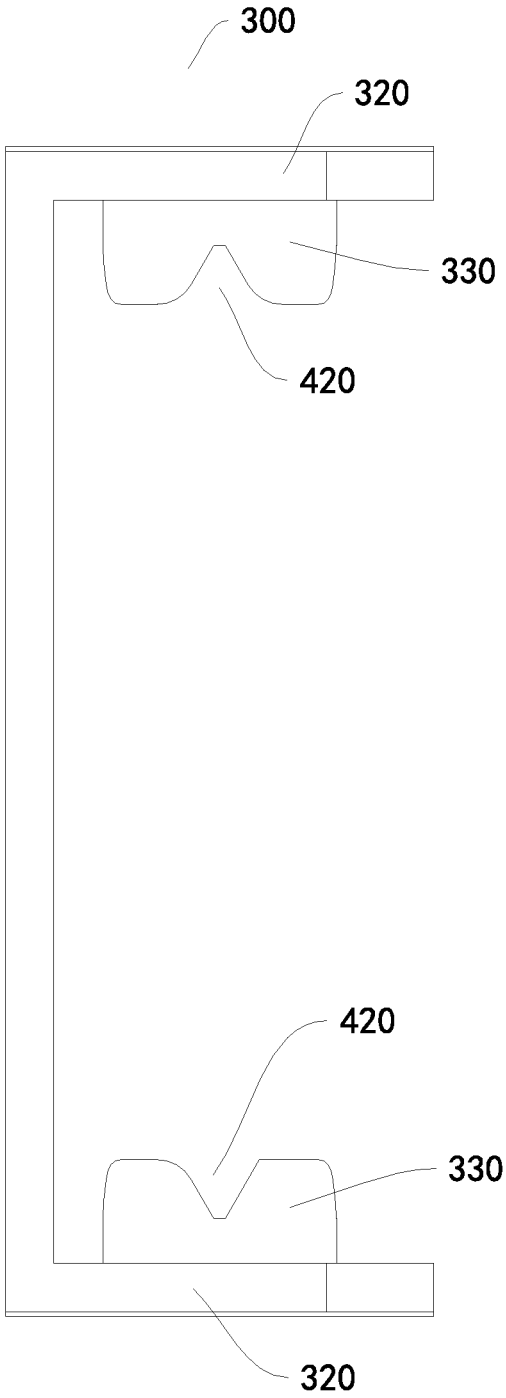
FIG. 10 is a schematic view of a rotating bracket of a sealing assembly of a window air conditioner according to an embodiment of the present disclosure.

Specifically, as shown in FIG. 9, the rotating bracket 300 includes mating plates 320 arranged opposite each other. An end surface of each of the mating plates 320 facing the other mating plate is provided with a protruding portion 330, and the protruding portion 330 includes a pivot hole 310 and a plurality of positioning recesses 420. Thus, the processing and arrangement of the pivot hole 310 and the positioning recesses 420 is facilitated, and the rotational fit between the rotating bracket 300 and the fixing component 110 is realized.

Figure 11:
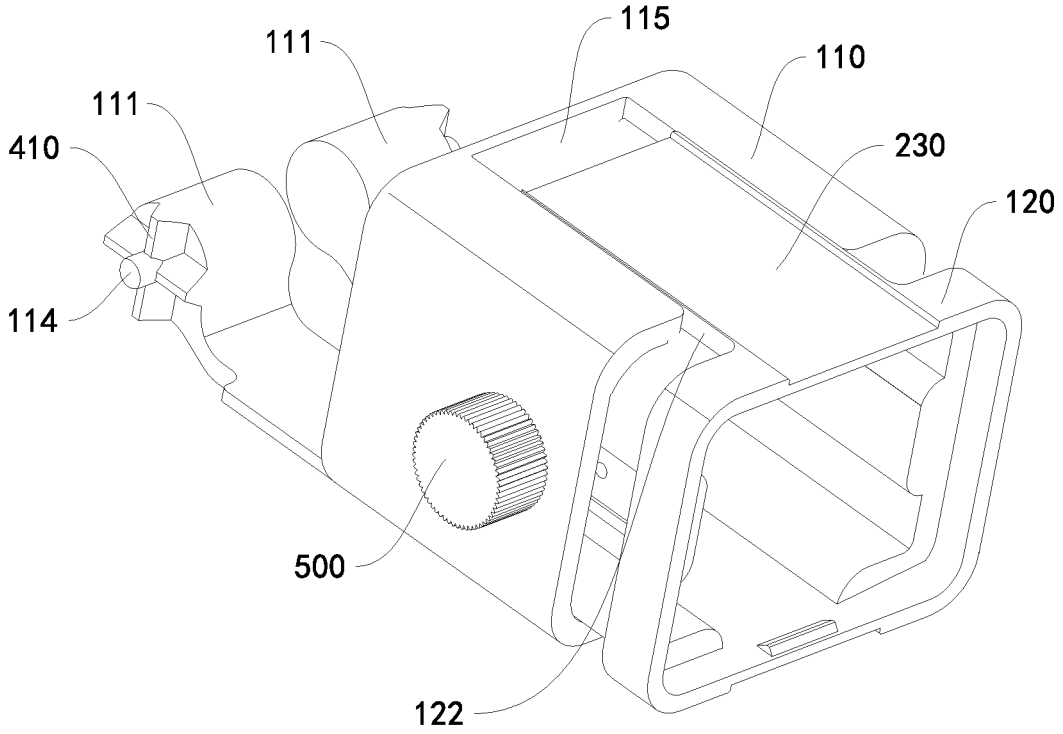
FIG. 11 is a schematic view of a partial structure of a sealing assembly of a window air conditioner according to some embodiments of the present disclosure.

Optionally, as shown in FIG. 11 to FIG. 12, the fixing component 110 includes two mating protrusions 111 spaced apart from each other, and each of the mating protrusions 111 is rotatably fitted with the rotating bracket 300. Thus, the arrangement of the pivot shaft 114 and the positioning protrusions 410 is facilitated, thereby facilitating the cooperation between the fixing component 110 and the rotating bracket 300 and facilitating the rotation of the fixing component 110 relative to the rotating bracket 300.

Figure 21:
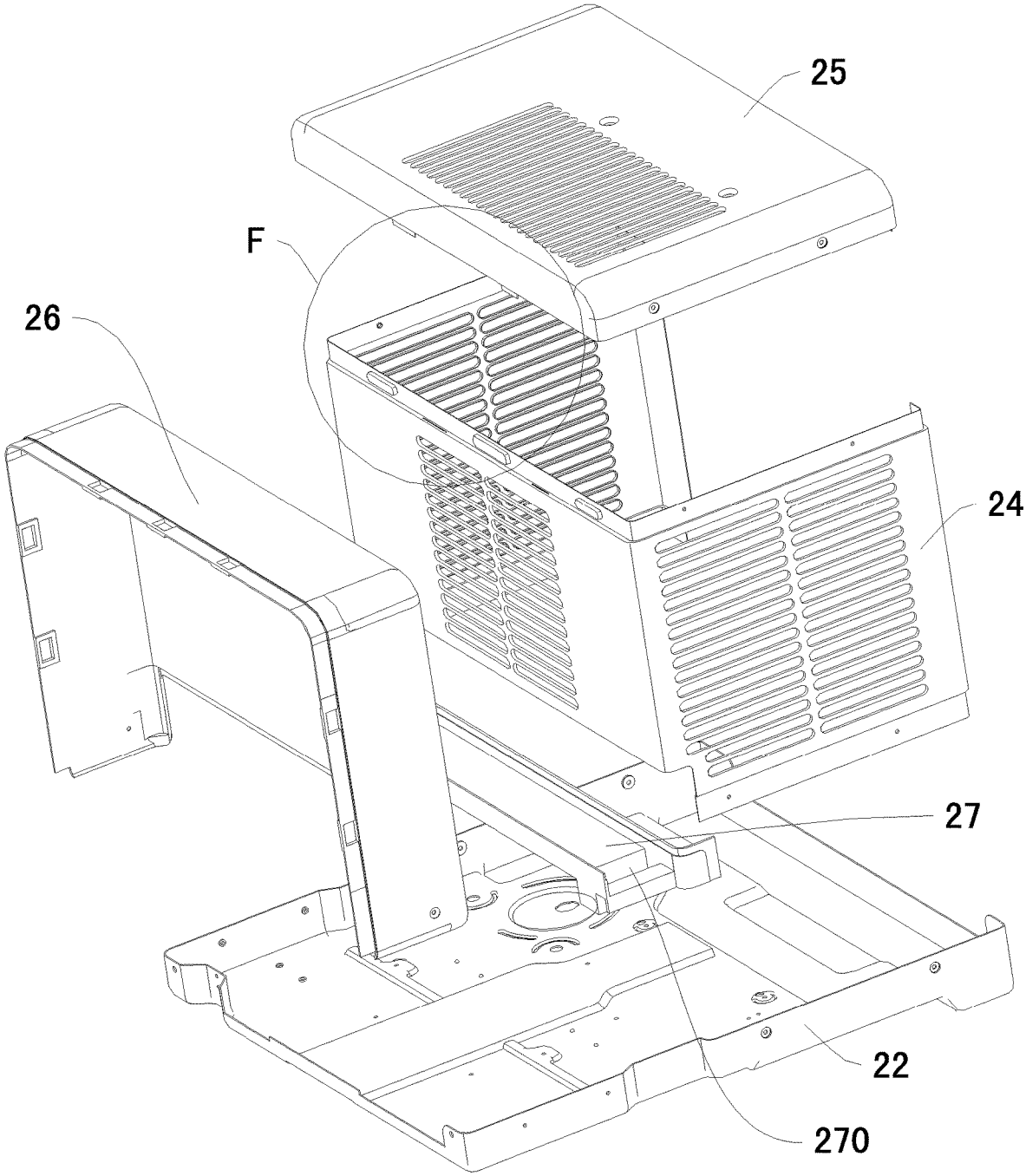
FIG. 21 is an exploded view of a casing of a sealing assembly of a window air conditioner according to an embodiment of the present disclosure.

In some embodiments of the present disclosure, as shown in FIG. 21, the intermediate partition board 27 is provided with a placement space 270 having an open top, and the rotating bracket 300 is stowed in the placement space 270. The fixing component 110 includes a receiving space 117, and when the sealing assembly 1 is rotated to extend out of the receiving groove 21, an outer edge including the placement space 270 extends into the receiving space 117 such that the sealing assembly 1 is substantially flush with the intermediate partition board 27. Thus, the sealing assembly 1 in a state of sealing the window opening can be parallel or substantially parallel with the chassis 22, and the sealing assembly 1 in the state of sealing the window opening 31 has a lowered height relative to the window opening 31, thereby further ensuring the sealing effect.

In a specific example of the present disclosure, the two mating protrusions 111 are located at an upper portion of the fixing component 110, the two mating protrusions 111 partially extend into the placement space 270, and a space below the two mating protrusions 111 is formed as the receiving space 117. When the sealing assembly 1 is rotated to the outside of the receiving groove 21, a portion of the fixing component 110 below the two mating protrusions 111 is located outside the chassis 22, and an inner peripheral wall of the portion of the fixing component 110 located below the two mating protrusions 111 can abut against an outer peripheral wall of the chassis 22. Thus, the sealing assembly 1 in the state of sealing the window opening 31 can be parallel or substantially parallel with the chassis 22 to ensure the sealing effect.

Further, as shown in FIG. 9, the rotating bracket 300 includes a fixing hole 340, the fixing hole 340 is located between the two mating protrusions 111, and the rotating bracket 300 is fixed to the casing 2 by means of a fixing member passing through the fixing hole 340. Specifically, the fixing hole 340 has a width of greater than 10 mm in the front-rear direction. Thus, the rotating bracket 300 can be fixed and mounted conveniently, thereby facilitating the installation operation of the rotating bracket 300, and improving the installation efficiency of the sealing assembly 1.

Specifically, as shown in FIGS. 11 and 12, the sealing assembly 1 further includes a slide-positioning assembly 500 arranged at the fixing component 110 and cooperating with the sliding block 120 to fix the sliding block 120 at a current position. In this way, the sliding block 120 can be positioned by the slide-positioning assembly 500, such that the sealing assembly 1 can be maintained at a specific sealing length, thereby improving the structural stability of the sealing assembly 1 and realizing the reliable sealing of the sealing assembly 1.

Figure 14:
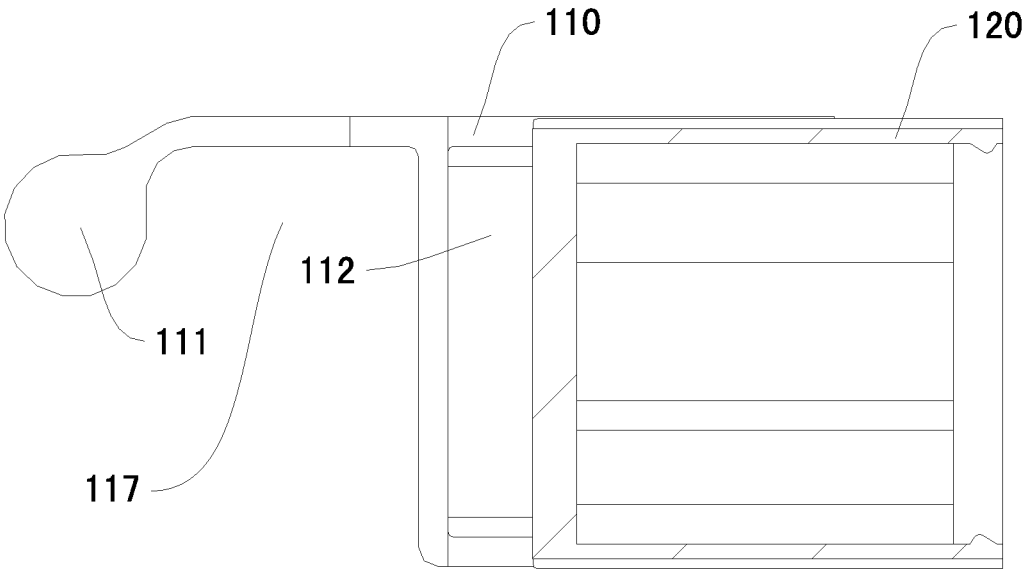
FIG. 14 is a partial sectional view of a sealing assembly of a window air conditioner according to an embodiment of the present disclosure.

More specifically, as shown in FIG. 14, the fixing component 110 includes a sliding cavity 112 therein, and at least a part of the sliding block 120 extends into the sliding cavity 112. Thus, cooperation between the fixing component 110 and the sliding block 120 can be conveniently, thereby facilitating the sliding of the sliding block 120 relative to the fixing component 110.

Figure 13:
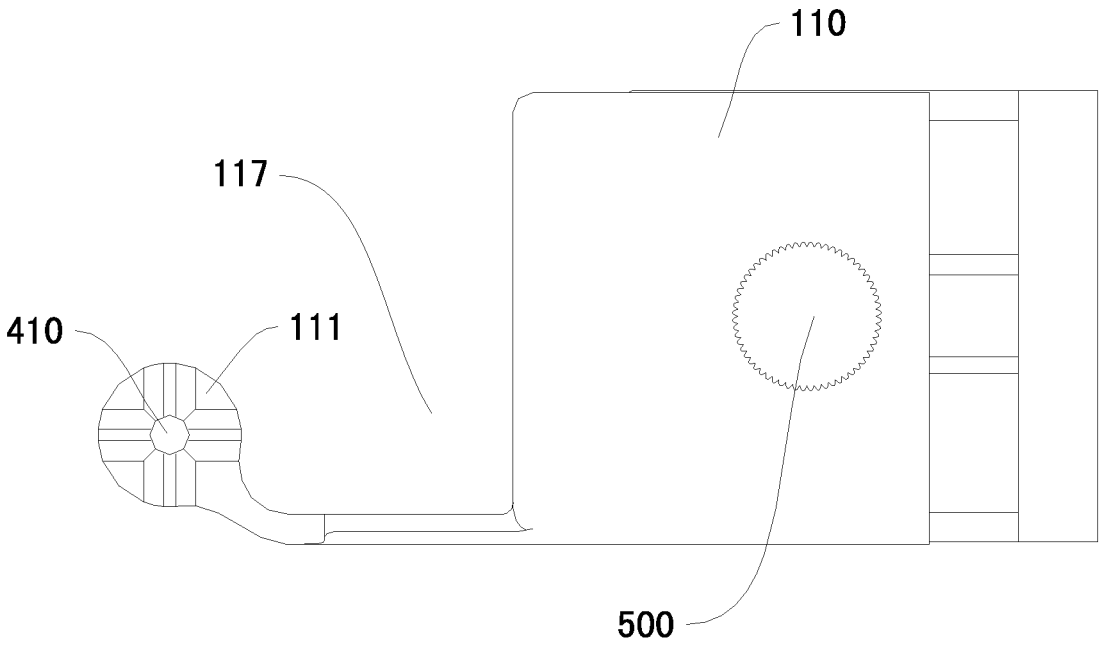
FIG. 13 is a schematic view of a partial structure of a sealing assembly of a window air conditioner according to some embodiments of the present disclosure.

In some embodiments of the present disclosure, as shown in FIGS. 11-13, the slide-positioning assembly 500 is configured as a rotating member, the rotating member is rotatably provided through the fixing component 110 and is in threaded fit with the fixing component 110. The rotating member rotates to adjust a length of a portion of the rotating member that extends into the sliding cavity 112, and the rotating member can abut against the sliding block 120 to fix the position of the sliding block 120. Thus, the user can control whether the sliding block 120 can slide or not by rotating the rotating member, thereby allowing the user to adjust the length of the sliding block 120 conveniently according to requirements.

Figure 26:
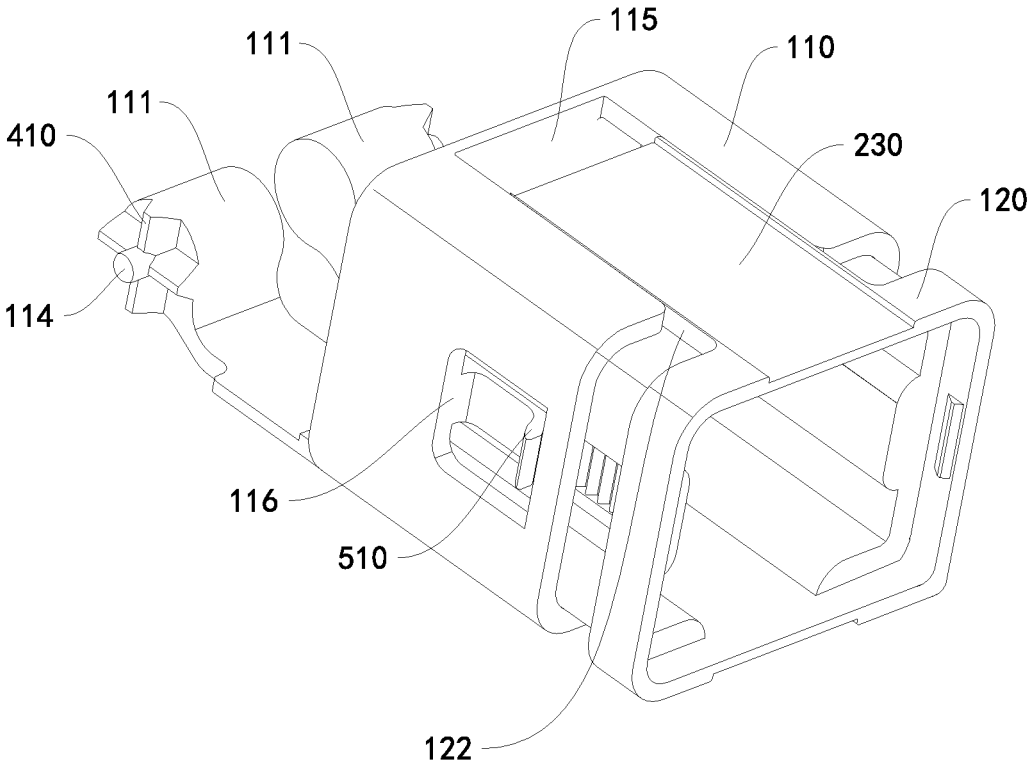
FIG. 26 is a schematic view of a partial structure of a sealing assembly of a window air conditioner according to some other embodiments of the present disclosure.
Figure 27:
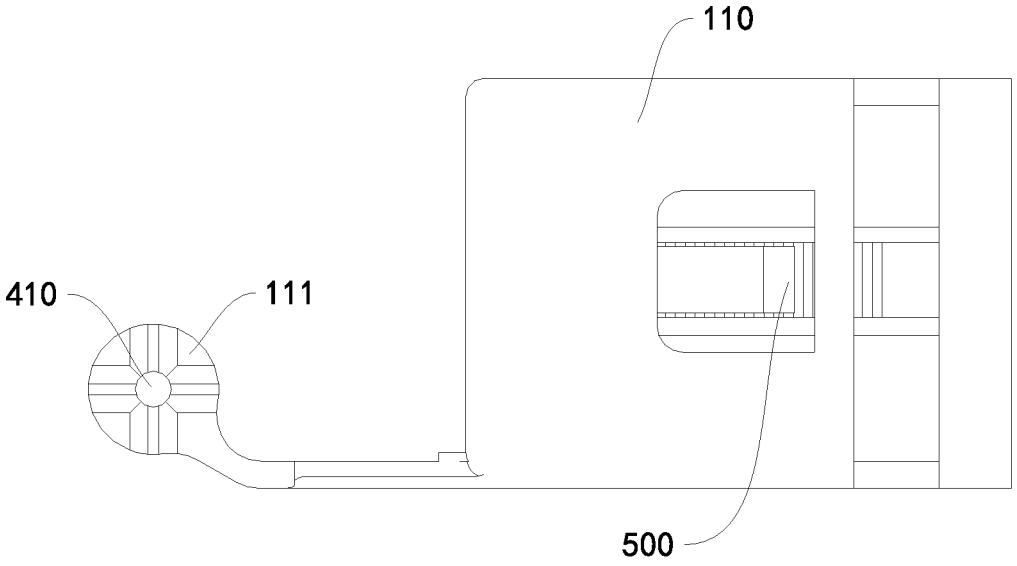
FIG. 27 is a schematic view of a partial structure of a sealing assembly of a window air conditioner according to still other embodiments of the present disclosure.
Figure 28:
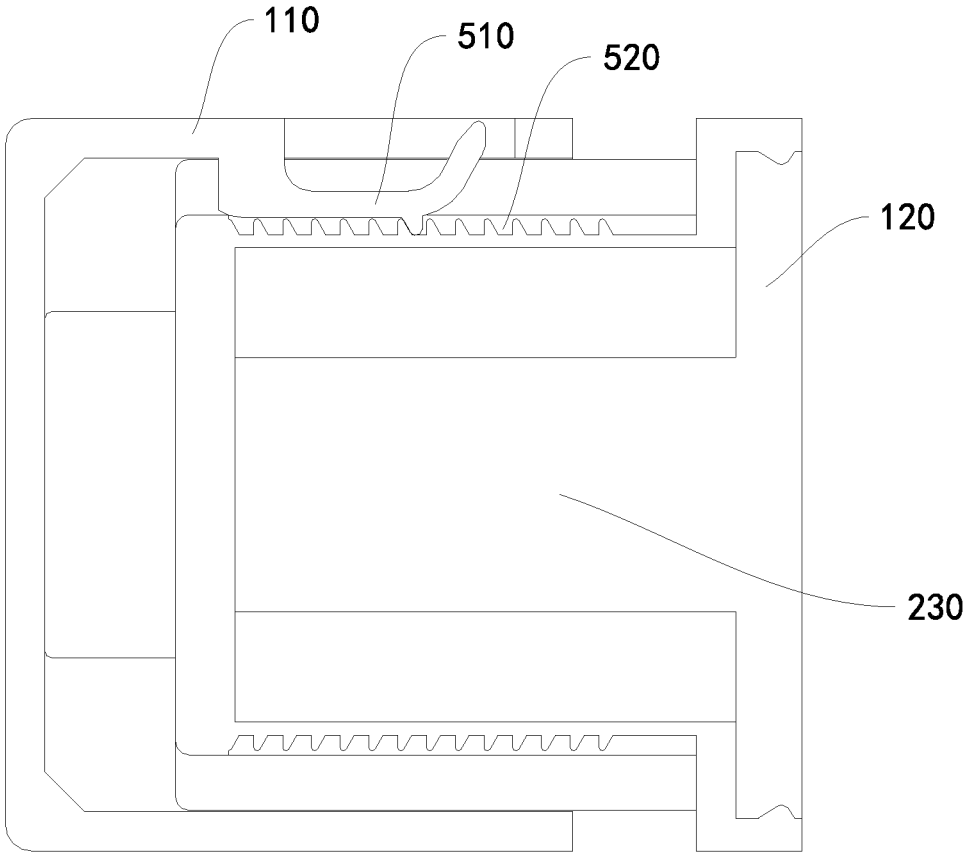
FIG. 28 is a schematic view of a partial structure of a sealing assembly of a window air conditioner according to yet other embodiments of the present disclosure.

In other embodiments of the present disclosure, as shown in FIGS. 26-28, the fixing component 110 includes an avoidance hole 116 in communication with the sliding cavity 112. The slide-positioning assembly 500 includes a resilient snap 510 and a plurality of snapping positions 520. The plurality of snapping positions 520 are arranged at an outer peripheral wall of the sliding block 120 and spaced apart from one another along a moving direction of the sliding block 120. The resilient snap 510 is deformably arranged at an inner peripheral wall of the avoidance hole 116 to be fitted with at least one of the snapping positions 520 at a slope or separated from the at least one of the snapping positions 520. The slide-positioning assembly 500 is configured in such a way that the sliding member 120 can move in a direction away from the fixing component 110 when the resilient snap 510 is fitted with the snapping position 520 at the slope, and the sliding member 120 can move in a direction towards the fixing component 110 when the resilient snap 510 is separated from the snapping position 520. In this way, the user can control a sliding direction of the sliding block 120 by means of the resilient snap 510, and can avoid accidentally triggering the sliding block 120 to move towards the fixing component 110, thereby improving the positioning reliability and accuracy of the slide-positioning assembly 500 and further allowing the user to adjust the length of the sliding block 120 according to requirements.

Figure 15:
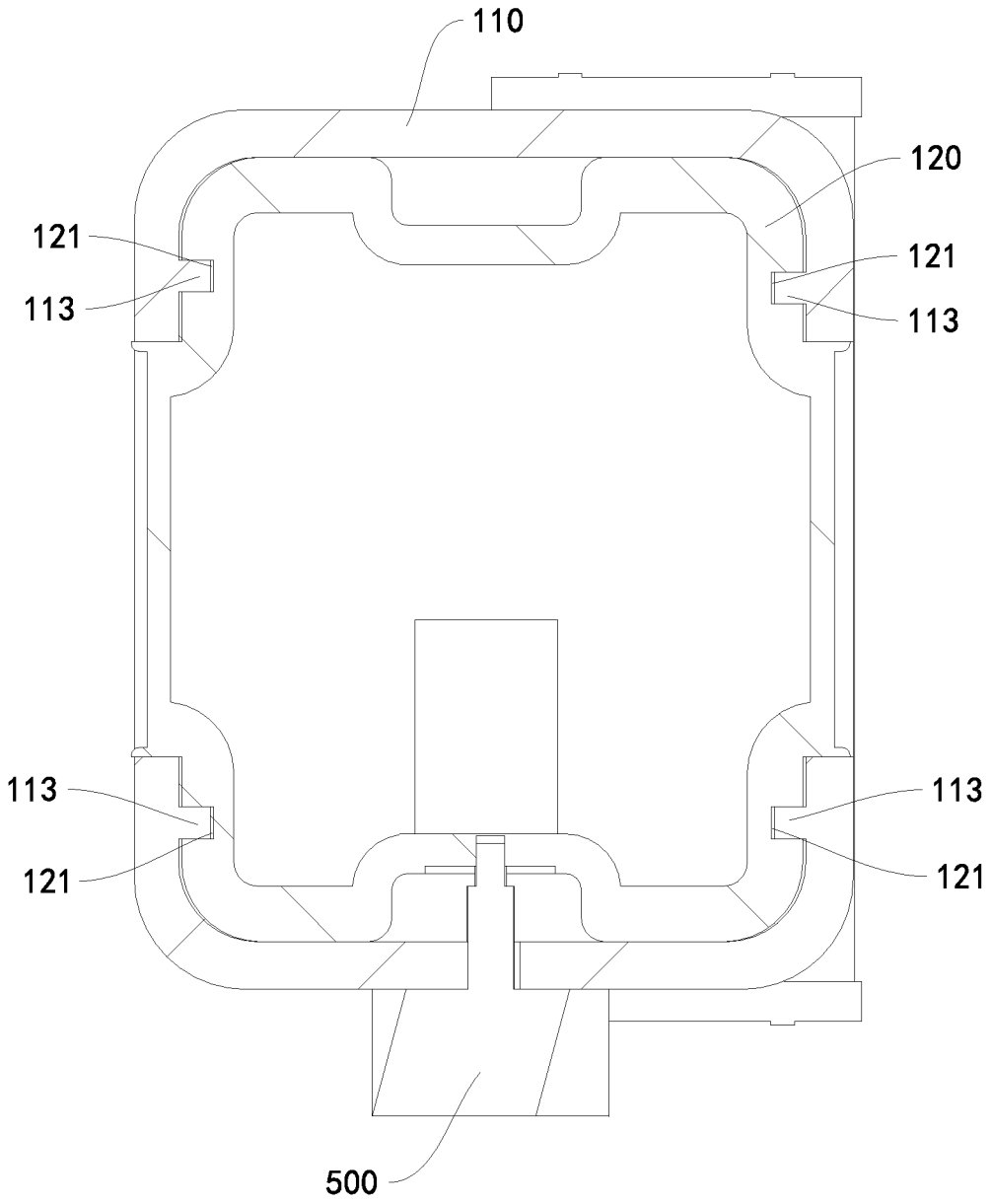
FIG. 15 is a partial sectional view of a sealing assembly of a window air conditioner according to an embodiment of the present disclosure.
Figure 16:
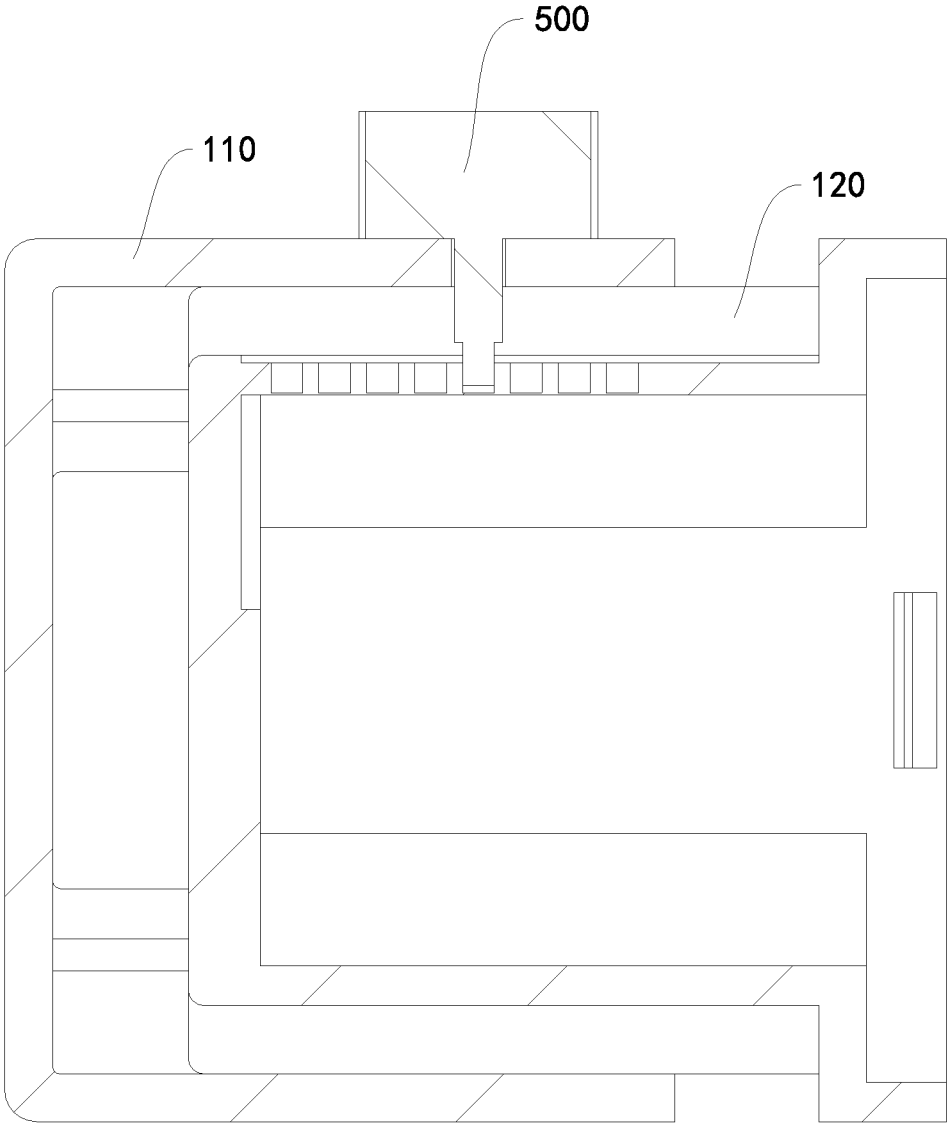
FIG. 16 is a partial sectional view of a sealing assembly of a window air conditioner according to an embodiment of the present disclosure.

Optionally, as shown in FIG. 15, the sliding cavity 112 has an inner wall provided with a sliding rib 113, and the sliding block 120 has an outer wall including a sliding groove 121 that is fitted with the sliding rib 113. In this way, the sliding rib 113 and the sliding groove 121 can be used to position and guide the sliding of the sliding block 120, such that the sliding block 120 slides more smoothly, and the structural strength of the sealing assembly 1 is enhanced, further improving the structural reliability and stability of the sealing assembly 1.

Figure 8:
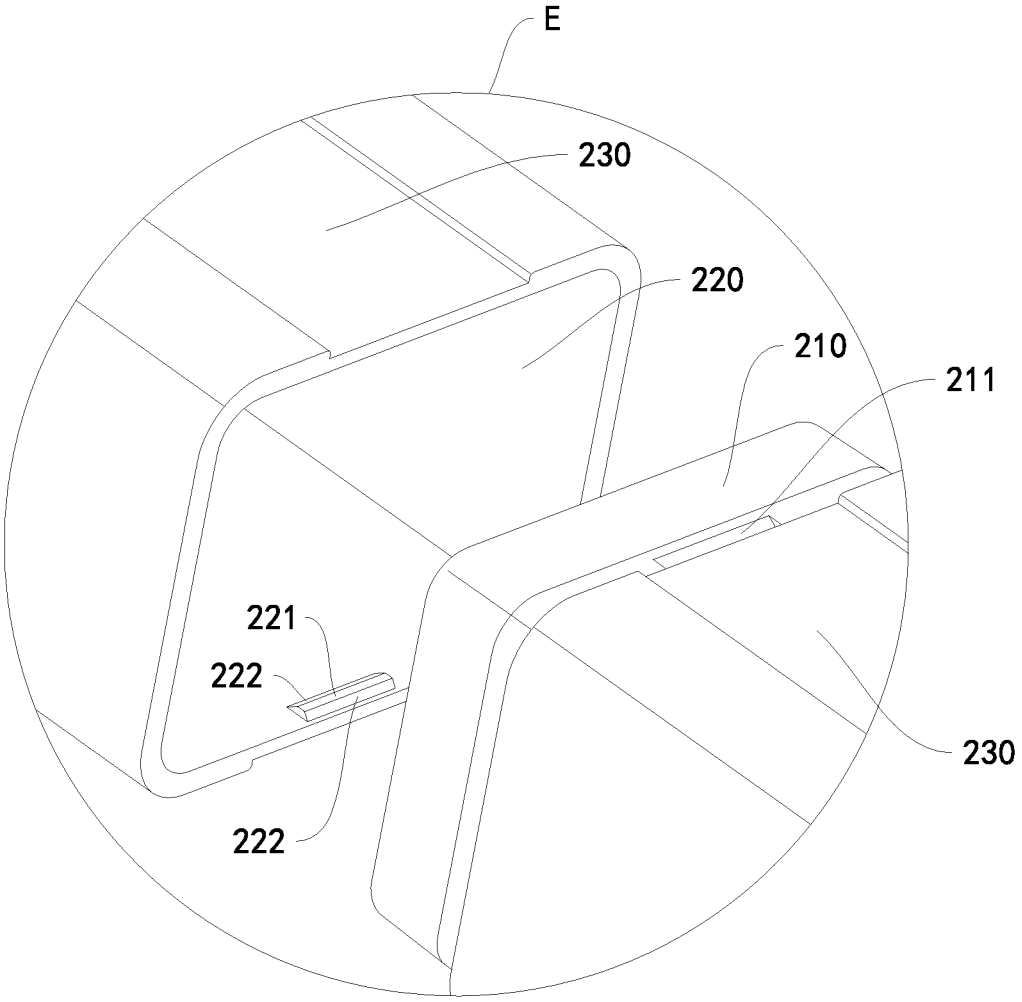
FIG. 8 is an enlarged view of part E in FIG. 7.

Specifically, as shown in FIG. 8, each second connecting component 200 includes an insertion portion 210, and each of the second connecting component 200 and the sliding block 120 includes an insertion chamber 220. Each insertion portion 210 is fitted with the insertion chamber 220 in a pluggable manner. Thus, adjacent second connecting components 200 can be connected conveniently, realizing the assembly of the plurality of second connecting components 200 and further facilitating the adjustment of the sealing length of the sealing assembly 1.

Optionally, in an insertion-pull direction of the second connecting component 200, an outer peripheral surface of the insertion portion 210 is obliquely arranged from the rear to the front.

More specifically, as shown in FIG. 8, one of the insertion portion 210 and an inner wall of the insertion chamber 220 is provided with a first resilient protrusion 221, and the other one of the insertion portion 210 and the inner wall of the insertion chamber 220 includes a first recess 211. The first resilient protrusion 221 can extend into the first recess 211. In this way, the first resilient protrusion 221 and the first recess 211 can be used to realize the reliable connection of the adjacent second connecting components 200, thereby enhancing the connection strength of the plurality of second connecting components 200, and further improving the structural stability of the sealing assembly 1.

Figure 17:
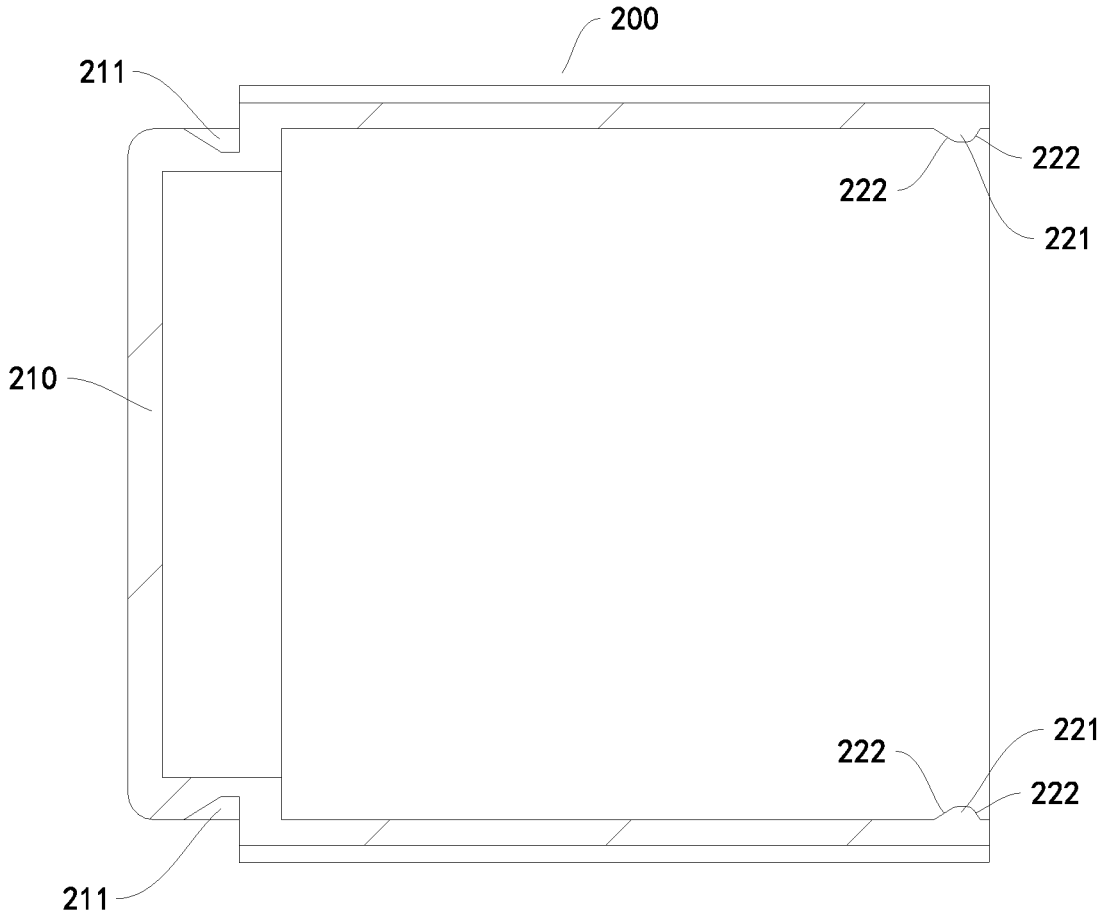
FIG. 17 is a sectional view of a second connecting component of a sealing assembly of a window air conditioner according to an embodiment of the present disclosure.
Figure 18:
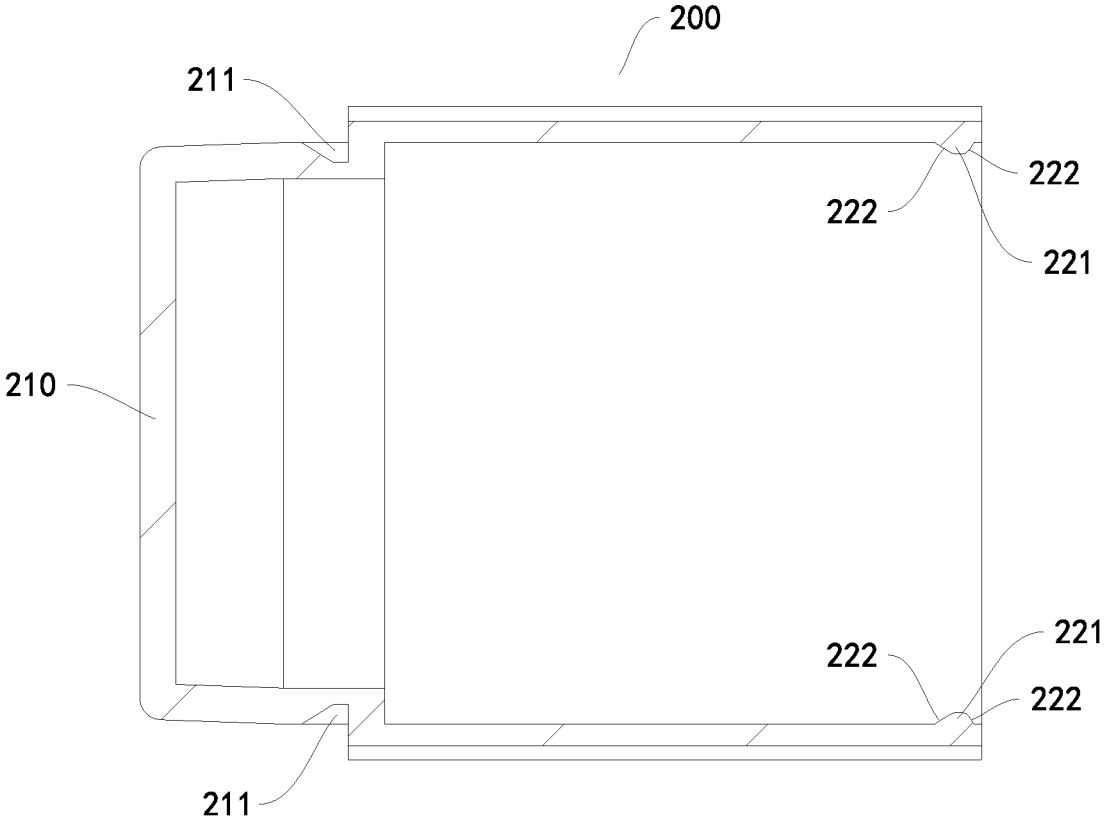
FIG. 18 is a sectional view of a second connecting component of a sealing assembly of a window air conditioner according to another embodiment of the present disclosure.
Figure 19:
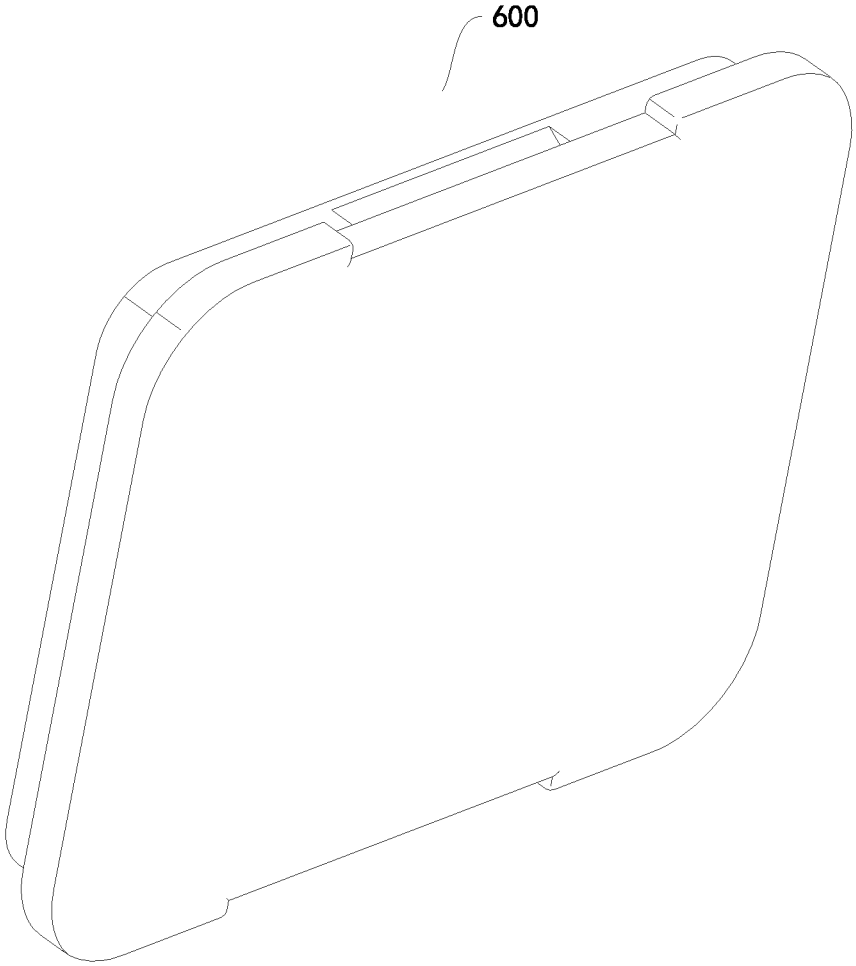
FIG. 19 is a schematic view of a sealing end cover of a sealing assembly of a window air conditioner according to an embodiment of the present disclosure.
Figure 20:
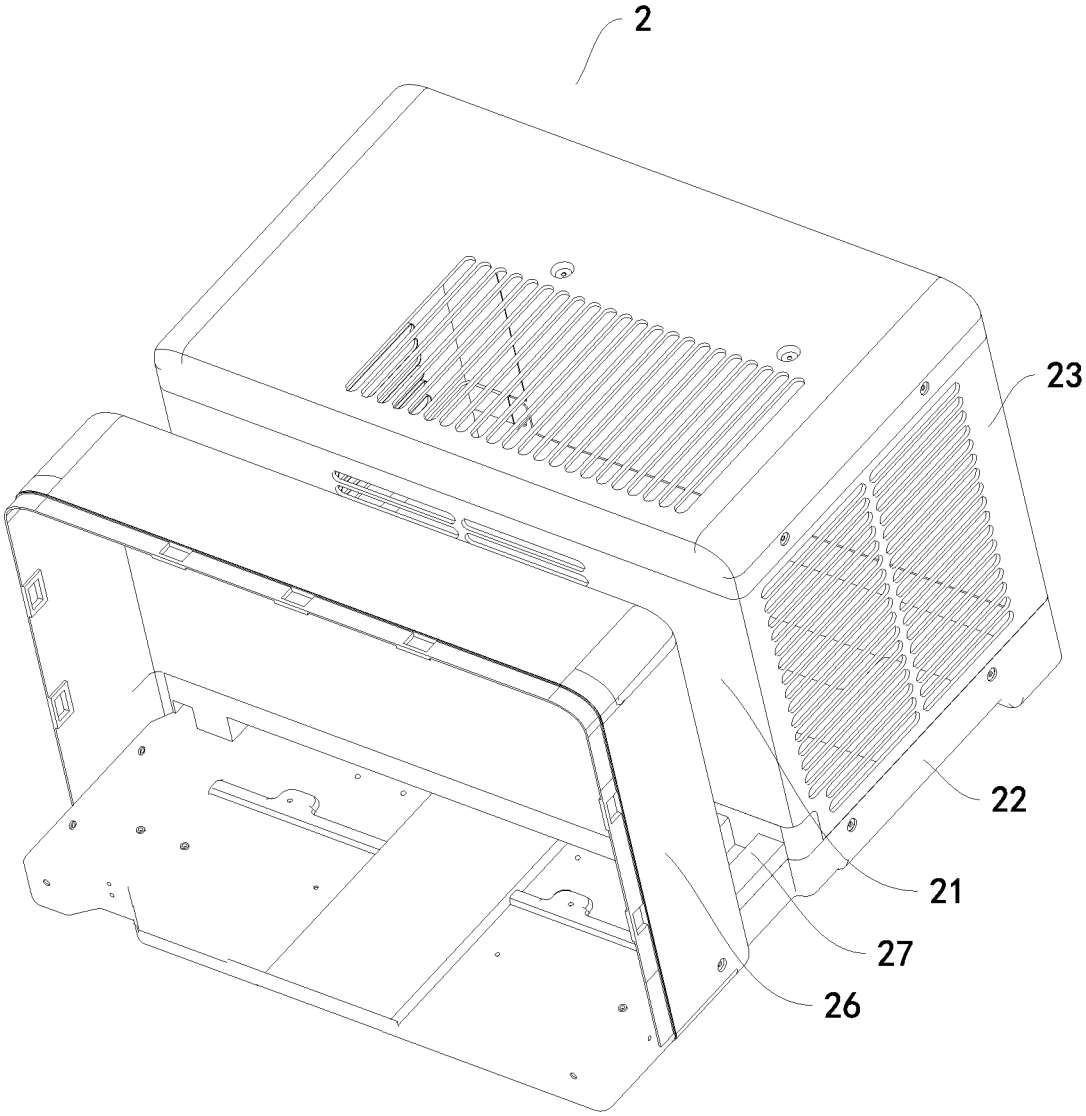
FIG. 20 is a schematic view of a casing of a sealing assembly of a window air conditioner according to an embodiment of the present disclosure.

Further, as shown in FIGS. 17 and 18, the first resilient protrusion 221 is arranged in the insertion chamber 220, and the first resilient protrusion 221 has two opposite guiding slopes 222 in the insertion-pull direction of the second connecting component 200. Respective first ends of the two guiding slopes 222 are fixed to the inner wall of the insertion chamber 220, and respective second ends of the two guiding slopes 222 extend obliquely towards each other. In this way, the insertion and pull-out of the insertion portion 210 can be guided by the two guiding slopes 222, thereby facilitating the mounting/dismounting the insertion portion 210 to/from the insertion chamber 220, and enhancing the connection reliability of the insertion portion 210 and the insertion chamber 220. Meanwhile, the appearance uniformity and aesthetics of the second connecting component 200 can be improved.

Specifically, a front wall surface of the first recess 211 has a guide surface that extends obliquely upwards and frontwards.

Optionally, as shown in FIG. 7, the sealing assembly 1 further includes a sealing end cover 600 configured to seal an open end of the insertion chamber 220 farthest from the fixing component 110. Thus, the insertion chamber 220 farthest from the fixing component 110 can be sealed conveniently, improving the sealing performance of the second connecting components 200, and the plurality of second connecting components 200 can have the same structure, facilitating the processing and manufacturing of the second connecting components 200 and improving the interchangeability of the second connecting components 200.

Certainly, the plurality of second connecting components 200 can be marked, such that the plurality of second connecting components 200 are arranged in a certain order.

Specifically, the sealing assembly 1 has a top wall provided with a sealing sponge on which the window 4 rests. Thus, it is possible to avoid direct contact between the window 4 and the sealing assembly 1 to reduce contact wear of the sealing assembly 1 with the window 4, and improve the sealing effect between the window 4 and the sealing assembly 1.

More specifically, as shown in FIG. 11, the first connecting component 100 and each second connecting component 200 include a second recess 230 for receiving the sealing sponge, which facilitates the arrangement of the sealing sponge and further improves the sealing performance of the sealing sponge.

Optionally, as shown in FIG. 11, the fixing component 110 has a top end provided with a guide groove 115, and the sliding block 120 has a top end provided with a guiding boss 122 fitted with the guide groove 115. In this way, the sliding of the sliding block 120 can be positioned and guided by the guide groove 115 and the guiding boss 122, which further facilitates the smooth sliding of the sliding block 120, and further improves the sliding accuracy and reliability of the sliding block 120.

Specifically, the sealing assembly 1 may be made of a material such as plastic, sheet metal, rubber, or silica gel.

Optionally, the sliding block 120 and the second connecting component 200 constitute a sealing-matching component 700, and the sealing-matching component 700 is connected to the fixing component 110. The sealing-matching component 700 can be rotated to extend out of the receiving groove 21 to abut against an inner wall of the window opening 31. Thus, the sealing length of the sealing assembly 1 can be adjusted by adjusting the length of the sealing-matching component 700.

The window air conditioner 10 according to some specific embodiments of the present disclosure will be described below with reference to the drawings.

Figure 24:
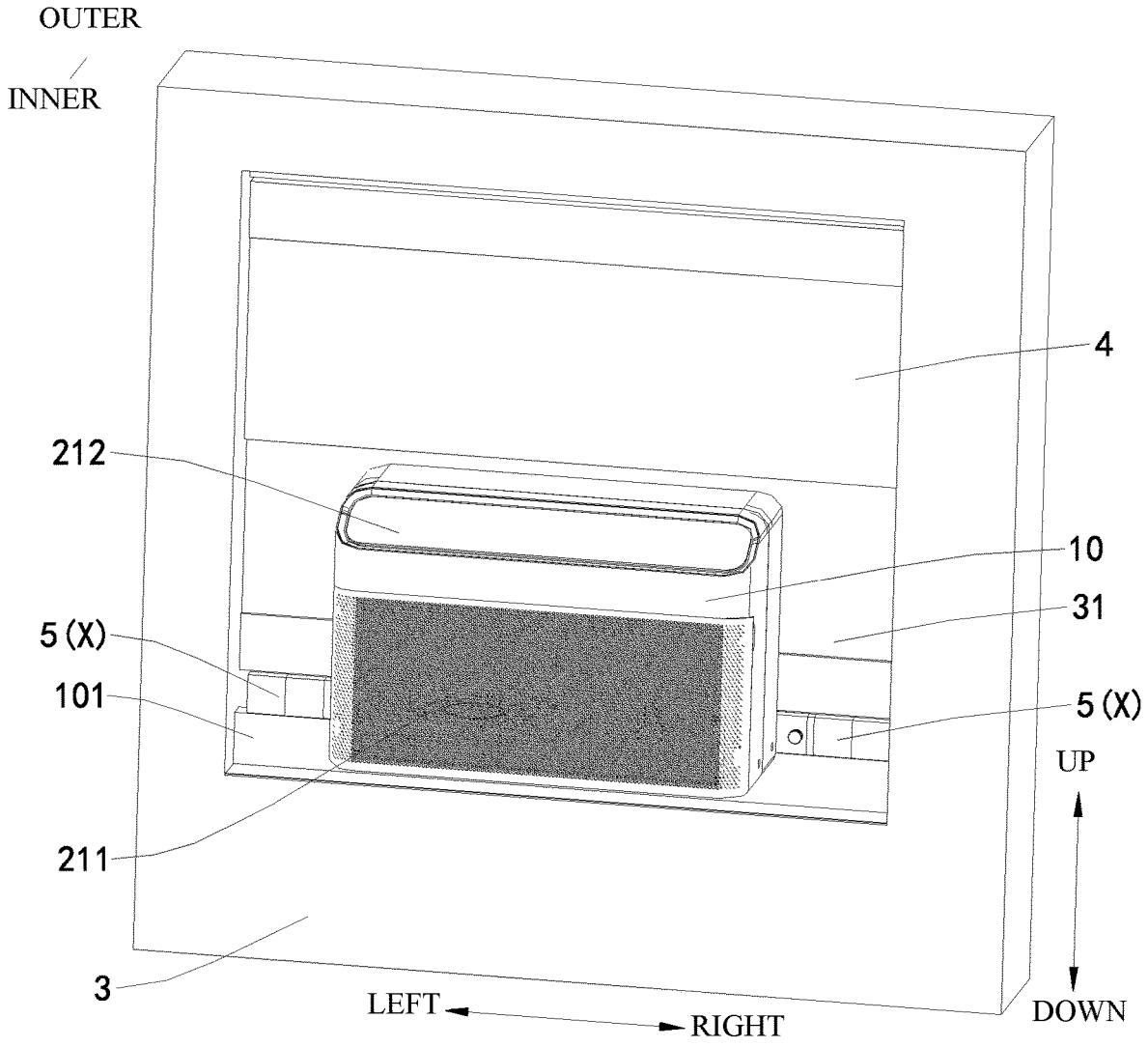
FIG. 24 is a schematic view of a window air conditioner according to an embodiment of the present disclosure.
Figure 25:
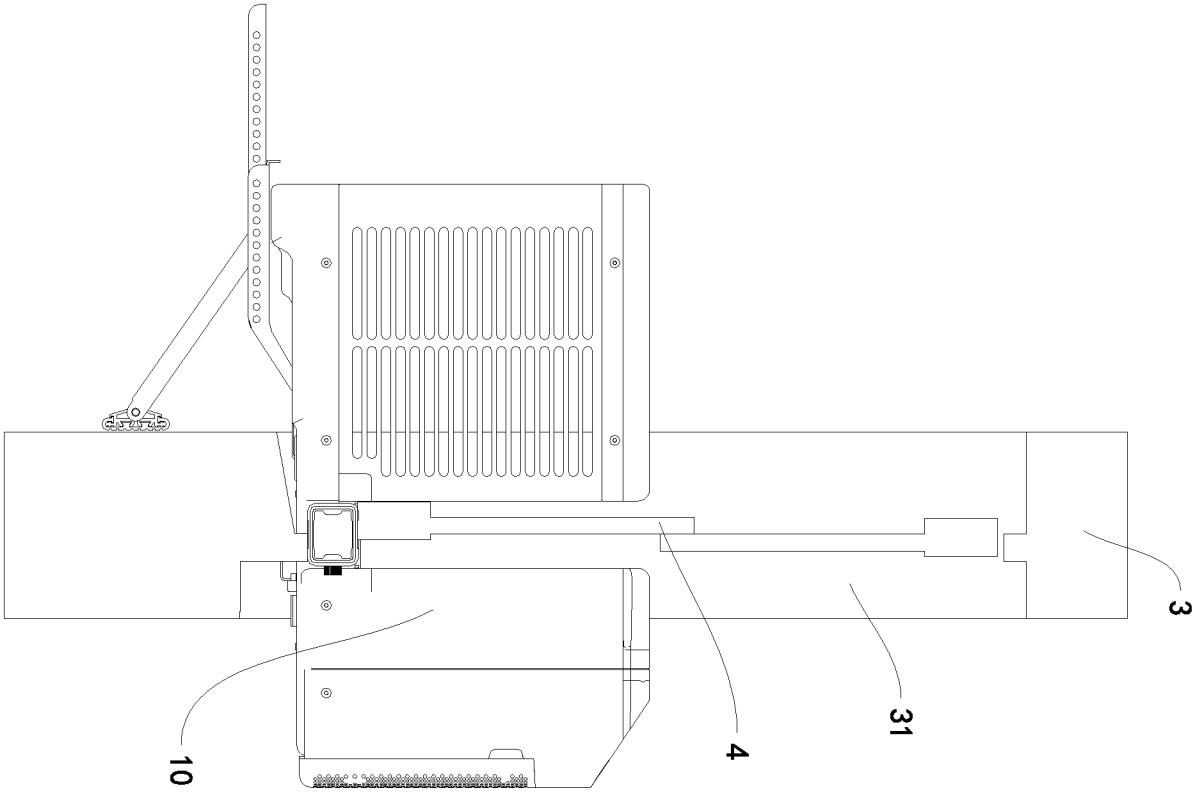
FIG. 25 is a schematic view of a window air conditioner according to an embodiment of the present disclosure.
Figure 29:
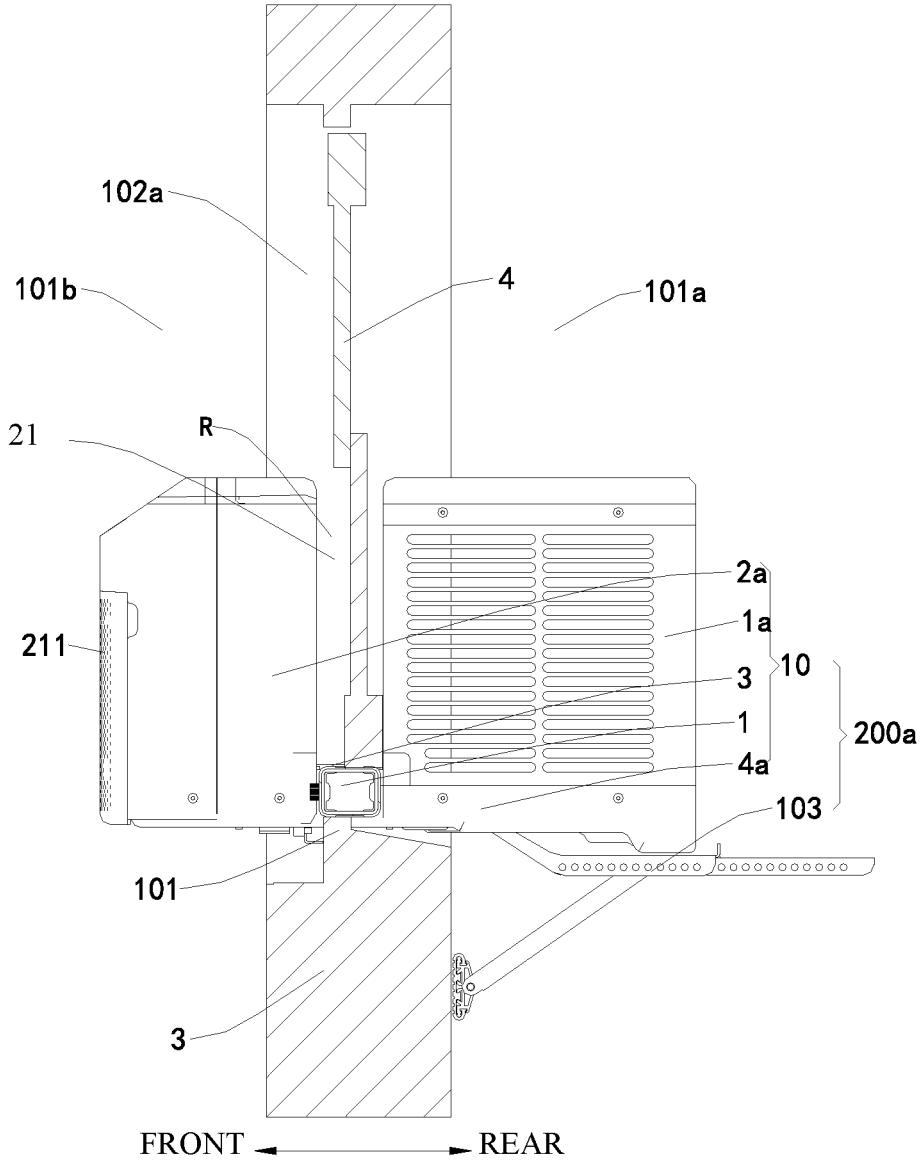
FIG. 29 is a sectional view showing installation of the window air conditioner in FIG. 24.

As shown in FIG. 24 and FIG. 29, in the window air conditioner 10 according to the embodiments of the present disclosure, the wall 3 includes a mounting opening 102*a*, a window sill 101 can be provided at a bottom including the mounting opening 102*a*, and the wall 3 can be arranged at the mounting opening 102*a*. The window air conditioner 10 is suitable to be supported on the window sill 101. Both sides of the window sill 101 may be an indoor side 101*b* and an outdoor side 101*a*, respectively. The window air conditioner 10 includes an outdoor assembly 1*a*, an indoor assembly 2*a*, and a partition assembly 3*a*.

As shown in FIG. 1 and FIG. 29, the outdoor assembly 1*a* is located on the outdoor side 101*a* of the window sill 101, and the outdoor assembly 1*a* includes an outdoor housing 11, an outdoor heat exchanger 12, an outdoor fan 13, and an electric control box 14, in which the outdoor heat exchanger 12, the outdoor fan 13, and the electric control box 14 are arranged in the outdoor housing 11. The outdoor housing 11 has an outdoor air inlet 111*a* and an outdoor air outlet 112*a*. It could be understood that the outdoor assembly 1*a* includes the outdoor housing 11, the outdoor heat exchanger 12, the outdoor fan 13 and the electric control box 14, and the outdoor heat exchanger 12, the outdoor fan 13 and the electric control box 14 are arranged in the outdoor housing 11. When the outdoor fan 13 is in operation, the outdoor air can flow into the outdoor housing 11 through the outdoor air inlet 111*a* to exchange heat with the outdoor heat exchanger 12, and after heat exchange the air can flow out through the outdoor air outlet 112*a*.

The indoor assembly 2*a* is provided on the indoor side 101*b* of the window sill 101, and the indoor assembly 2*a* includes an indoor housing 21*a*, an indoor heat exchanger 22*a*, and an indoor fan 23*a*, in which the indoor heat exchanger 22*a* and the indoor fan 23*a* are arranged in the indoor housing 21*a*. The indoor housing 21*a* has an indoor air inlet 211*a* and an indoor air outlet 212. It could be understood that the indoor assembly 2*a* includes the indoor housing 21*a*, the indoor heat exchanger 22*a*, and the indoor fan 23*a*, and the indoor heat exchanger 22*a* and the indoor fan 23*a* are both arranged in the indoor housing 21*a*. When the indoor fan 23*a* is in operation, the indoor air can flow into the indoor housing 21*a* through the indoor air inlet 211*a* to exchange heat with the indoor heat exchanger 22*a*, and after heat exchange the air can flow out through the indoor air outlet 212.

The partition assembly 3*a* is provided between the indoor assembly 2*a* and the outdoor assembly 1*a*, and the receiving groove 21 is formed above the partition assembly 3*a* and between the outdoor assembly 1*a* and the indoor assembly 2*a*. That is, an upper surface of the partition assembly 3*a*, and mutually opposite surfaces of the indoor assembly 2*a* and the outdoor assembly 1*a* cooperatively form the receiving groove 21, such that surfaces of the receiving groove 21 only include a lower surface, a surface of the indoor assembly 2*a* facing the outdoor side 101*a*, and a surface of the outdoor assembly 1*a* facing the indoor side 101*b*, in which the lower surface of the receiving groove 21 refers to the upper surface of the partition assembly 3*a*. In other words, the receiving groove 21 is open on the top and on both side in a length direction of the receiving groove 21 (e.g., left and right sides in FIG. 1). When the window air conditioner 10 is installed on the window sill 101, the receiving groove 21 can be arranged opposite to the window 4 above the window sill 101, and the window 4 can be pushed and pulled in the up-down direction to change a ventilation area of the mounting opening 102*a*. Moreover, the window 4 can be moved downwards into the receiving groove 21 such that at least a part of the window 4 extends into the receiving groove 21 and hence the window 4 can separate the outdoor assembly 1*a* from the indoor assembly 2*a*. Thus, it is possible to prevent operation noise of the outdoor assembly 1*a* from being transmitted to the indoor side 101*b* to a certain extent, thereby upgrading the user experience, and preventing outdoor rainwater and the like from flowing into the room to ensure indoor cleanliness to a certain extent, thereby facilitating the maintenance of the window air conditioner 10. Moreover, the window air conditioner 10 has a flexible structure and is easy to install. It is not necessary to provide a mounting opening 102*a* in the wall to match the shape of the window air conditioner 10, and the installation of the window air conditioner 10 can be realized by using the mounting opening 102*a* of the wall 3 that is configured to mount the window 4, thereby lowering the installation requirements of the window air conditioner 10.

The indoor assembly 2*a* and the outdoor assembly 1*a* can be separated from each other, such that the indoor housing 21*a* and the outdoor housing 11 can be separated, such that the structures of the indoor housing 21*a* and the outdoor housing 11 are simplified, the processing thereof becomes convenient, and meanwhile, the indoor housing 21*a* and the outdoor housing 11 can be sequentially installed, thereby facilitating the assembly and installation of the window air conditioner 10. With the partition assembly 3*a* between the indoor assembly 2*a* and the outdoor assembly 1*a* to form the receiving groove 21 between the outdoor assembly 1*a* and the indoor assembly 2*a*, the window 4 can be moved downwards into the receiving groove 21 to separate the outdoor assembly 1*a* from the indoor assembly 2*a*, thereby preventing the operation noise of the outdoor assembly 1*a* from being transmitted to the indoor side 101*b*, and hence improving user comfort. The electric control box 14 is arranged in the outdoor housing 11, and the outdoor housing 11 can protect the electrical control box 14 to a certain extent. Moreover, it is unnecessary to reserve a space for the arrangement of the electrical control box 14 in the indoor housing 21*a*, thereby reducing the volume of the indoor assembly 2*a*, saving the space occupied by the indoor assembly 2*a*, lowering the requirement of the window air conditioner 10 for the installation space on the indoor side 101*b*, and improving the applicability of the window air conditioner 10, that is, the window air conditioner 10 can be applied to situations where the installation space on the indoor side 101*b* is small.

For the window air conditioner 10 according to the embodiments of the present disclosure, the partition assembly 3*a* is provided and forms the receiving groove 21 together with the outdoor assembly 1*a* and the indoor assembly 2*a*, such that the window 4 can be moved downwards into the receiving groove 21, thereby preventing the operation noise of the outdoor assembly 1*a* from being transmitted to the indoor side 101*b*, and improving the user comfort. Moreover, the electric control box 14 is provided in the outdoor housing 11, which reduces the volume of the indoor assembly 2*a*, lowers the requirement of the window air conditioner 10 for the installation space on the indoor side 101*b*, further lowers the installation requirement of the window air conditioner 10, and improves the applicability of the window air conditioner 10.

It could be understood that the partition assembly 3*a* can be directly fixedly connected or indirectly fixedly connected to the indoor assembly 2*a*.

Figure 34:
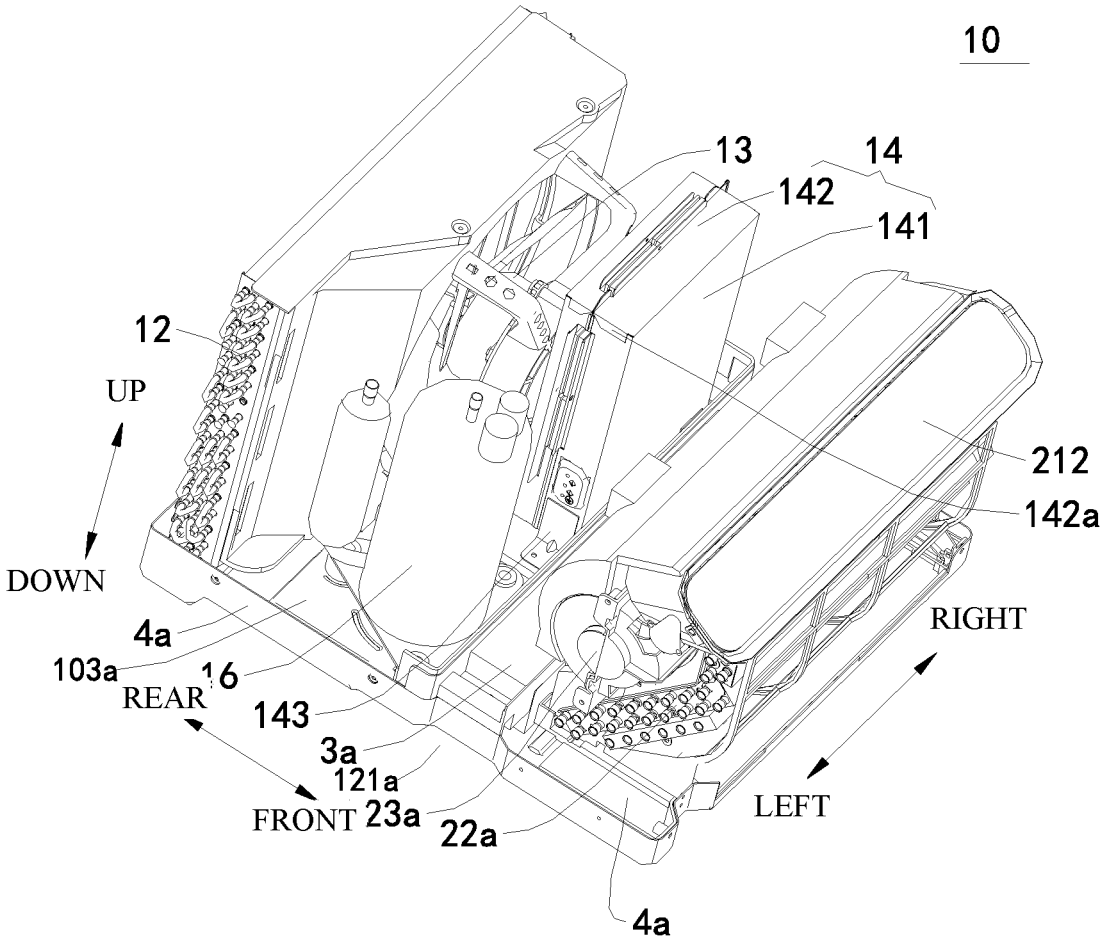
FIG. 34 is a schematic view of a partial structure of the window air conditioner in FIG. 1.
Figure 36:
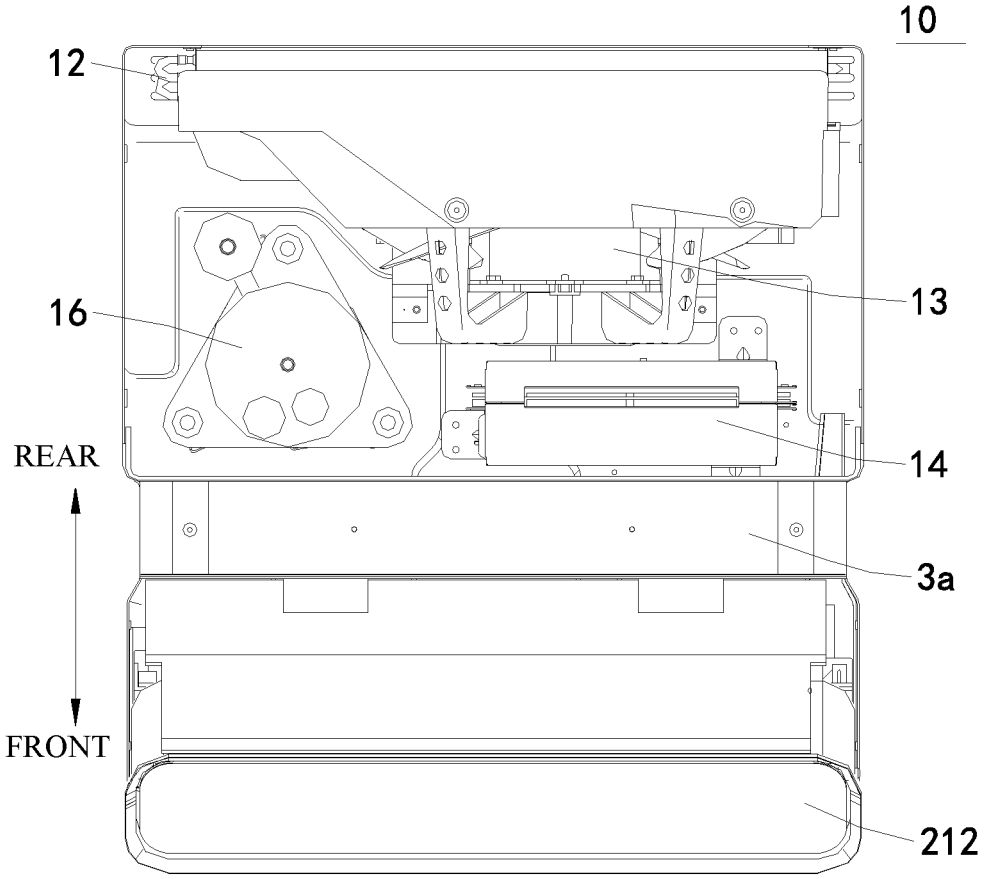
FIG. 36 is a top view of the window air conditioner in FIG. 34.

In some optional embodiments of the present disclosure, as shown in FIGS. 34 and 36, the electric control box 14 is located on a side of the outdoor fan 13 adjacent to the indoor assembly 2*a* (e.g., a front side in FIG. 34), and the electric control box 14 can be spaced apart from the outdoor fan 13 to reduce rotation transmitted to the electric control box 14 during the operation of the outdoor fan 13, thereby ensuring the installation reliability of the electric control box 14, and facilitating the wiring arrangement between components on the outdoor side 101*a* and the electric control box 14 and the wiring arrangement between components on the indoor side 101*b* and the electric control box 14. For example, wires between the components on the outdoor side 101*a* and the electric control box 14 can be coupled to corresponding components on the outdoor side 101*a* after passing through the electrical control box 14 from a circuit board in the electrical control box 14. Wires between components on the indoor side 101*b* and the electric control box 14 can be coupled to corresponding components on the indoor side 101*b* via a wiring passage running through both longitudinal ends of a partition assembly after passing through the electrical control box 14 from a circuit board in the electrical control box 14. However, the present disclosure is not limited thereto.

Certainly, the electric control box 14 can also be located in other positions in the outdoor housing 11, which is not limited thereto, as long as the electric control box 14 can be installed successfully.

Figure 30:
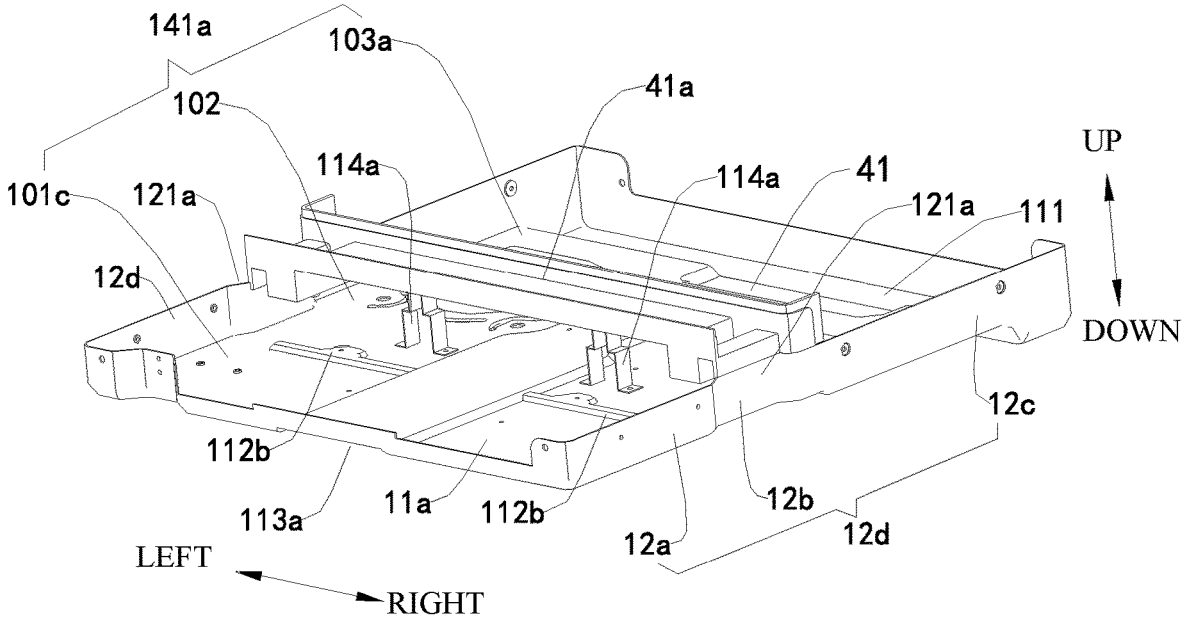
FIG. 30 is a schematic view showing installation of a chassis with a partition assembly shown in FIG. 1.
Figure 31:
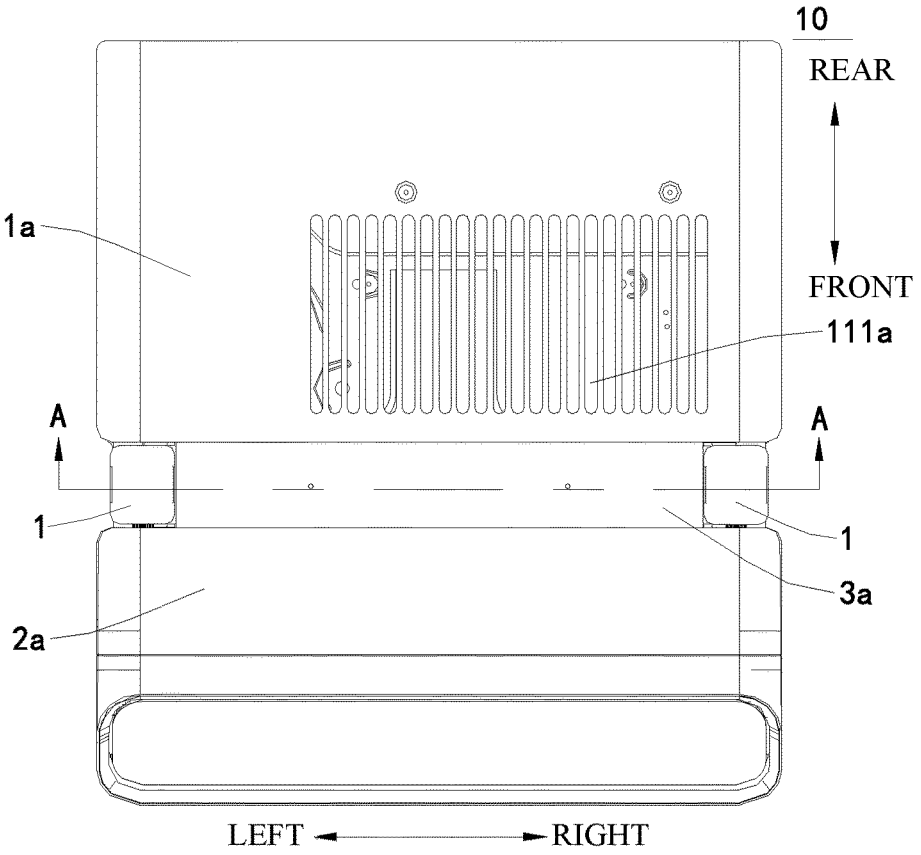
FIG. 31 is a top view of the window air conditioner in FIG. 1.
Figure 32:
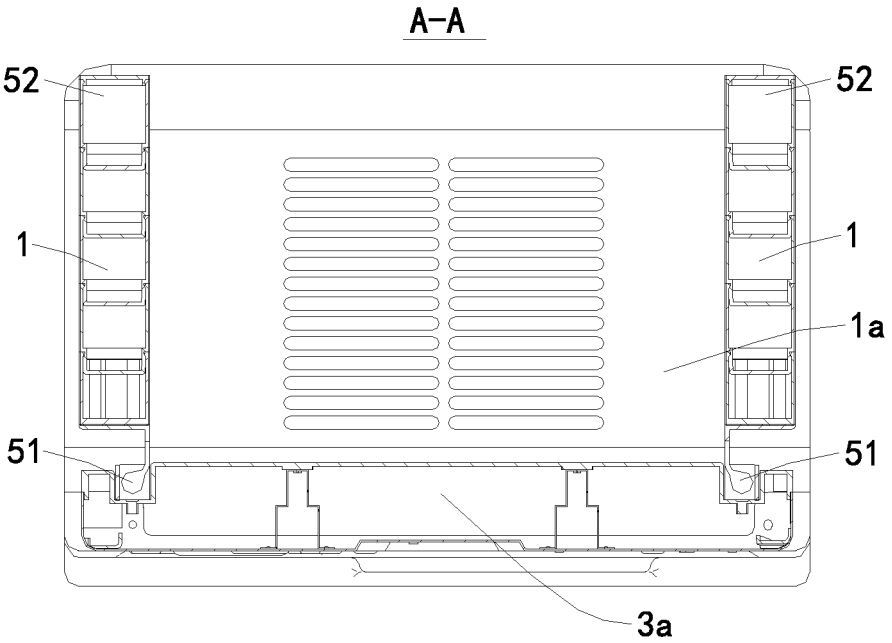
FIG. 32 is a sectional view taken along line A-A in FIG. 31.

In a further embodiment of the present disclosure, the window air conditioner 10 further includes a chassis 4*a*. The outdoor assembly 1*a*, the indoor assembly 2*a*, and the partition assembly 3*a* are all arranged on the chassis 4*a*, and the electric control box 14 is mounted on the chassis 4*a*. For example, as shown in FIGS. 1, 30, and 34, the chassis 4*a* may be provided to bottoms of the outdoor assembly 1*a*, the indoor assembly 2*a*, and the partition assembly 3*a* to support the outdoor assembly 1*a*, the indoor assembly 2*a*, and the partition assembly 3*a*. Thus, the overall structure of the window air conditioner 10 is stabilized, and the overall structure of the window air conditioner 10 is conveniently installed on the window sill 101, thereby improving the installation efficiency of the window air conditioner 10. Since the electric control box 14 is mounted on the chassis 4*a*, the installation reliability of the electric control box 14 is ensured, and the electric control box 14 does not need to be fixed to other components, which simplifies the installation of the electric control box 14 and facilitates the installation of the electric control box 14.

In an example of FIG. 34, the electric control box 14 can be provided with a connecting member 143 on an outer surface thereof. The connecting member 143 can be arranged at a bottom of the electric control box 14. The connecting member 143 has a first end fixedly connected to the electric control box 14 and a second end fixedly connected to the chassis 4*a*. The connecting member 143 can be substantially L-shaped. The connecting member 143 can include a first connecting sub-member and a second connecting sub-member, both of which can be substantially formed into a plate-like structure. A side surface of the first connecting sub-member in a thickness direction abuts against the electric control box 14, and the first connecting sub-member is fixedly connected to the electric control box 14. A side surface of the second connecting sub-member in a thickness direction abuts against the chassis 4*a*, and the second connecting sub-member is fixedly connected to the chassis 4*a*.

Optionally, two connecting members 143 may be provided and arranged on opposite sides of the electric control box 14 respectively, to further ensure the installation reliability of the electric control box 14.

Figure 37:
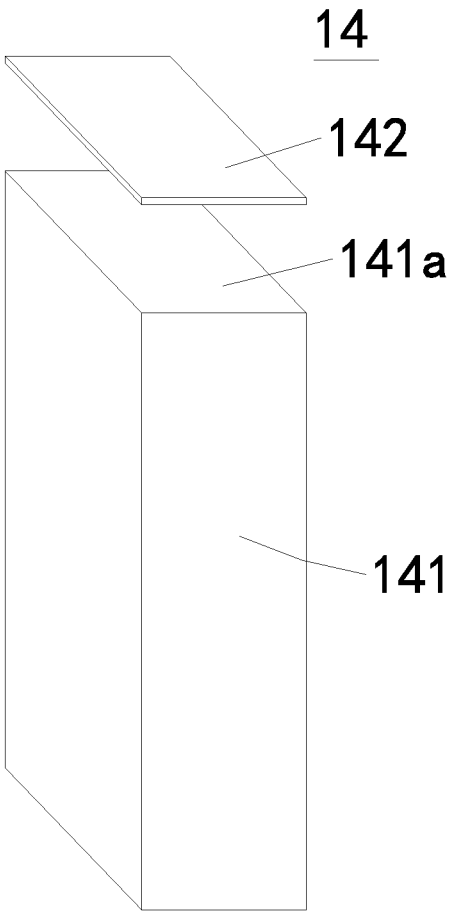
FIG. 37 is a schematic view of an electric control box in FIG. 34.
Figure 38:
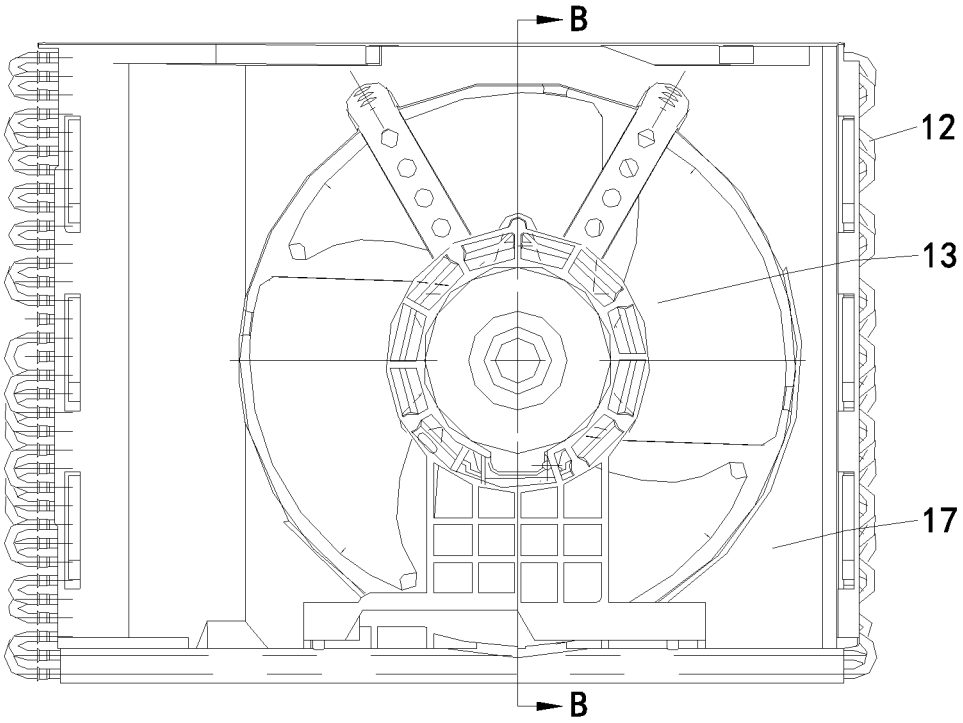
FIG. 38 is a schematic view of another partial structure of the window air conditioner in FIG. 1.

In some embodiments of the present disclosure, as shown in FIGS. 34 and 37, the electrical control box 14 includes a box body 141 and a top cover 142, the box body 141 includes a mounting chamber 141*a* with an open top, and the top cover 142 is arranged on the top of the box body 141 to open or close the mounting chamber 141*a*. Thus, the structures of the box body 141 and the top cover 142 are simplified, the processing and mounting of the box body 141 and the top cover 142 becomes convenient, and the assembly of the electric control box 14 is facilitated.

Specifically, a circuit board is provided in the mounting chamber 141*a*, and the circuit board can be mounted in the box body 141 by means of a mounting member. For example, the box body 141 includes a limiting slot therein, and the mounting member extends into the limiting slot to implement the installation of the circuit board, thereby improving the assembly efficiency of the electric control box 14. The mounting member can be a plastic member, thereby facilitating the formation of the mounting member and satisfying the structural requirement of the mounting member easily, and the plastic member can bring about a good insulation effect. Certainly, the mounting member can also be made of other materials.

Figure 35:
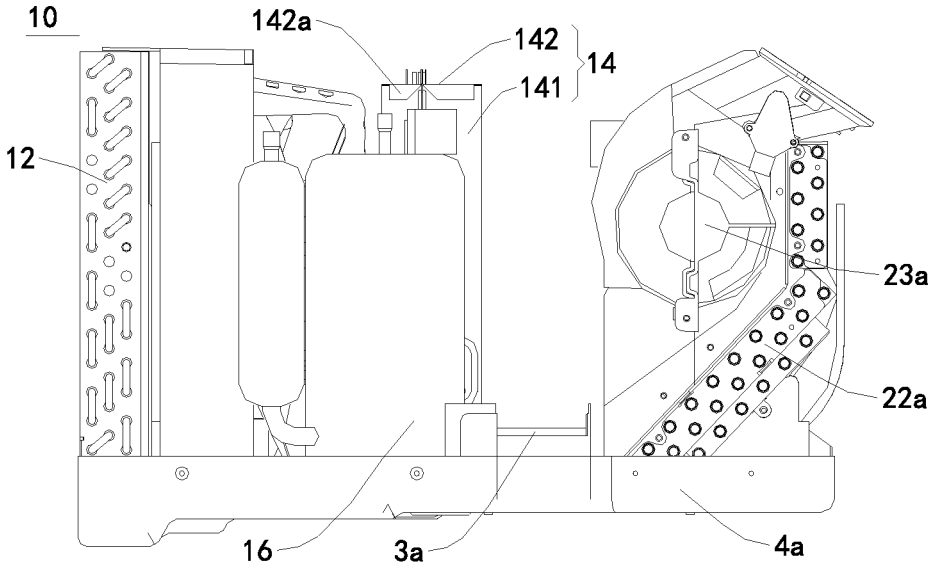
FIG. 35 is a sectional view of the window air conditioner in FIG. 34.

During the installation of the electric control box 14, the box body 141 can be installed first; then the circuit board is mounted in the box body 141 by means of the mounting member, such that the circuit board is placed in the mounting chamber 141*a*; and finally the top cover 142 is arranged on the top of the box body 141 to fixedly connect the top cover 142 with the box body 141. Thus, the installation process of the electric control box 14 is simple, realizing the quick installation of the electric control box 14. For example, in the examples of FIGS. 34 and 35, opposite ends of the top cover 142 are each provided with a flange 142*a*, and an inner surface of the flange 142*a* can abut against an outer peripheral wall of the box body 141 to limit the positions of the top cover 142 and the box body 141, thereby further facilitating the assembly of the electric control box 14.

Optionally, the box body 141 and the top cover 142 may be sheet metal pieces. Even if the electric control box 14 is sparked or ignited due to high temperature during the operation, the electric control box 14 can also perform good fireproof and fire-barrier functions, and the electric control box 14 also has a good waterproof function to prevent rainwater flowing into the outdoor housing 11 from hitting the electric control box 14 to cause a short circuit or the like, thereby ensuring the safety of the electric control box 14. Certainly, the box body 141 and the top cover 142 may also be made of other materials, which is not limited thereto.

Figure 2:
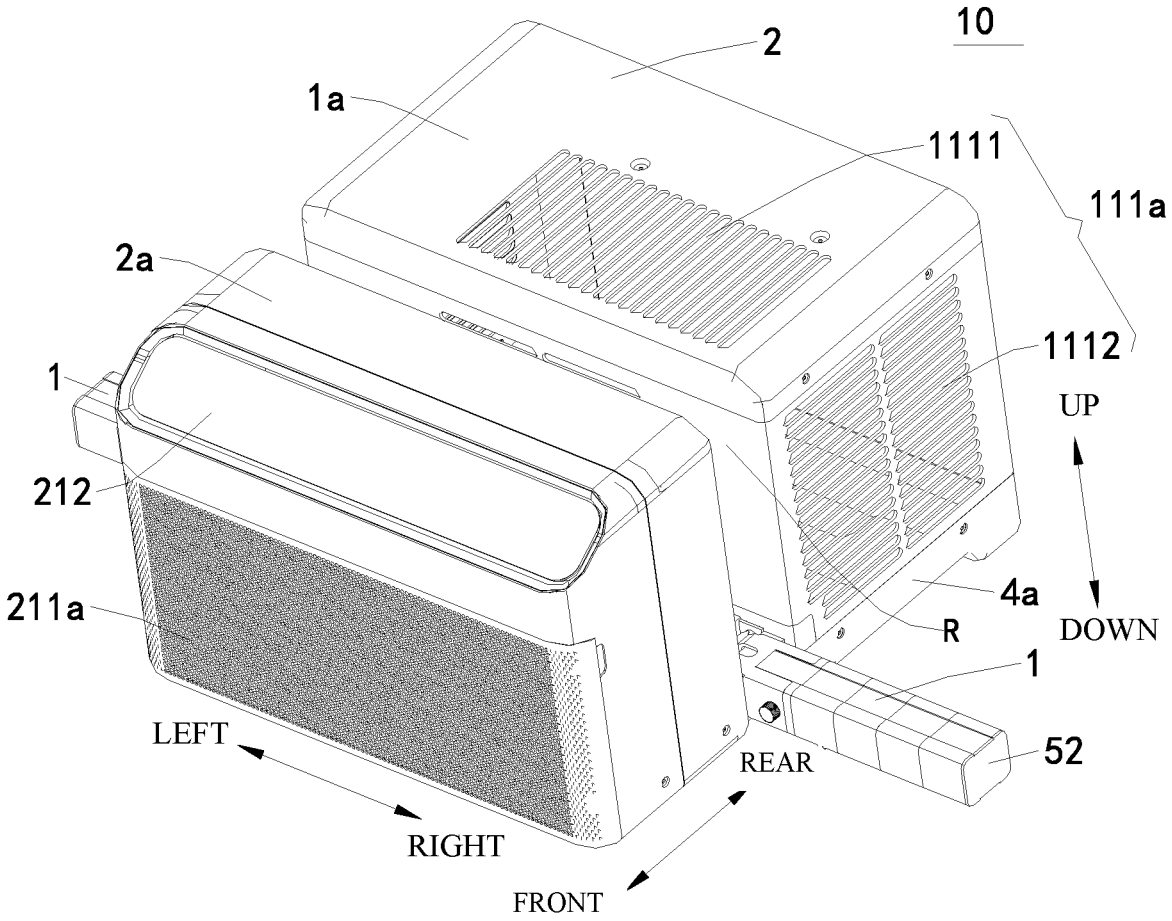
FIG. 2 is a schematic view of a window air conditioner according to an embodiment of the present disclosure.
Figure 3:
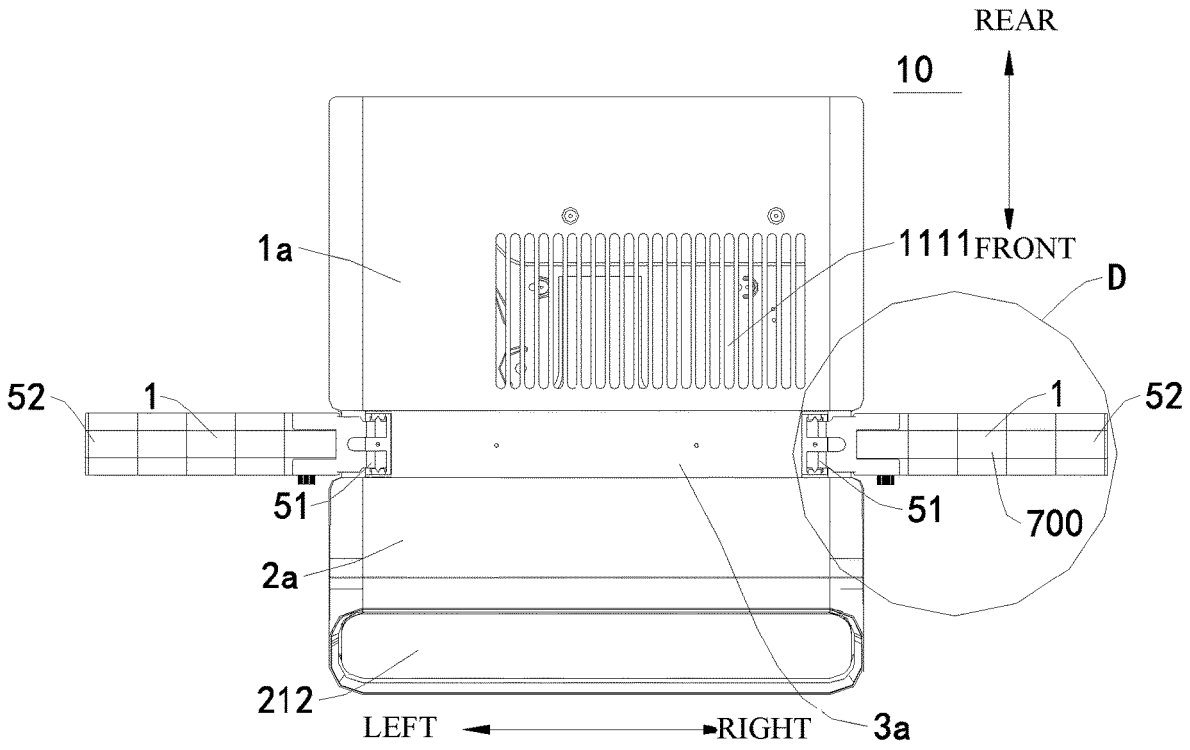
FIG. 3 is a schematic view of a window air conditioner according to an embodiment of the present disclosure.

In some specific embodiments of the present disclosure, as shown in FIG. 1 and FIG. 2, at least a part of the outdoor air inlet 111*a* is formed in a top wall of the outdoor housing 11. It could be understood that the outdoor air inlet 111*a* can include a first outdoor air inlet 1111 formed in the top wall of the outdoor housing 11. The outdoor air can flow into the outdoor housing 11 through the first outdoor air inlet 1111 from top to bottom to exchange heat with the outdoor heat exchanger 12. In such a way, a requirement on the installation height of the window air conditioner 10 is lowered to a certain extent, and air introduction into the window air conditioner 10 can get rid of influence by factors such as obstacles on the left and right sides of the outdoor assembly 1*a*, thereby ensuring that the outdoor air inlet 111*a* has a sufficient air inlet area to guarantee an air volume in the outdoor assembly 1*a*. Moreover, under the same air volume, the operation noise of the outdoor assembly 1*a* can be reduced, and the noise transmitted to the indoor side 101*b* during the operation of the outdoor assembly 1*a* can be further reduced.

Figure 33:
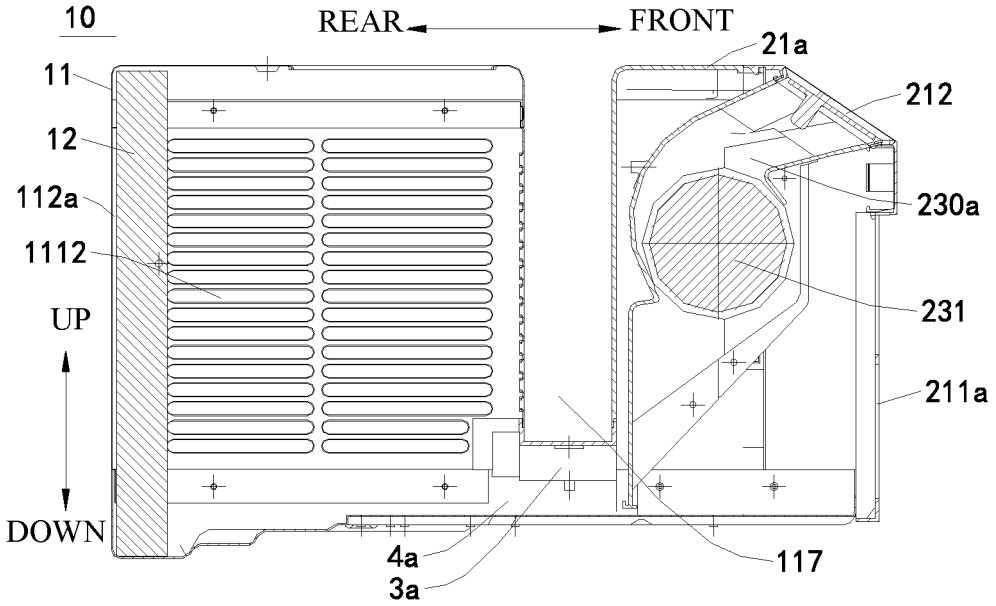
FIG. 33 is a sectional view of the window air conditioner in FIG. 2.

Further, in an example of FIG. 33, the outdoor air outlet 112*a* can be formed on a side of the outdoor housing 11 away from the indoor housing 21*a* (e.g., a rear side in FIG. 33). The outdoor air inlet 111*a* can further include a second outdoor air inlet 1112 located in a side wall of the outdoor housing 11 to ensure the air inlet area of the outdoor air inlet 111*a*. In other words, the second outdoor air inlet 1112 can be located in a left side wall and/or a right side wall of the outdoor housing 11. That is, one or two second outdoor air inlets 1112 may be provided. When one second outdoor air inlet 1112 is provided, the second outdoor air inlet 1112 may be located in the left side wall or the right side wall of the outdoor housing 11; when two second outdoor air inlets 1112 are provided, the two second outdoor air inlets 1112 may be located in the left side wall and the right side of the outdoor housing 11, respectively.

It could be understood that the outdoor air inlet 111*a* and the outdoor air outlet 112*a* can be arranged in other positions according to actual needs, which is not limited thereto.

When the electric control box 14 is located below the first outdoor air inlet 1111, at least the top wall of the electric control box 14 may be waterproof, to prevent rainwater flowing into the outdoor housing 11 via the first outdoor air inlet 1111 from hitting the electric control box 14 to cause a short circuit or the like, thereby ensuring the operation safety of the electric control box 14.

In some specific embodiments of the present disclosure, the outdoor heat exchanger 12 is located on a side of the outdoor fan 13 away from the indoor assembly 2*a* (e.g., a rear side in FIG. 34), and the outdoor fan 13 may be an axial flow fan. For example, as shown in FIGS. 34, 36, 38, and 39, the outdoor heat exchanger 12 may be located on a side of the outdoor fan 13 away from the indoor assembly 2*a* in an axial direction of the outdoor fan 13, such that the outdoor heat exchanger 12 has a relatively large area facing the outdoor fan 13 in the axial direction of the outdoor fan 13. When the outdoor fan 13 is in operation, the outdoor fan 13 pushes air to allow the air to flow in the same direction as the axial direction of the outdoor fan 13, and drives the air to flow through the outdoor heat exchanger 12. The air contacts the outdoor heat exchanger 12 at a relatively large area, such that the air can be in full contact with the outdoor heat exchanger 12, thereby ensuring the heat exchange efficiency of the outdoor heat exchanger 12.

Specifically, in examples of FIG. 30 and FIGS. 39-42, the outdoor fan 13 includes an axial flow fan blade 131 and a water splash ring 132, a side of the axial flow fan blade 131 away from the outdoor heat exchanger 12 is provided with an outdoor motor 136, and the outdoor motor 136 is connected to the axial flow fan blade 131 to drive the axial flow fan blade 131 to rotate. The water splash ring 132 is connected to an outer edge of the axial flow fan blade 131, such that the water splash ring 132 can be rotated synchronously with the axial flow fan blade. A central axis of the outdoor fan 13 can extend in the horizontal direction. A water collecting groove 41 is provided below the water splash ring 132, such that condensation water produced during the operation of the window air conditioner 10 can be collected in the water collecting groove 41. When the outdoor heat exchanger 12 is used as a condenser, the condensation water produced due to the indoor heat exchanger 22*a* can be collected in the water collecting groove 41. When a liquid level in the water collecting groove 41 is high and the water splash ring 132 is immersed below the liquid level, the water splash ring 132 can bring up the water in the water collecting groove 41 to form water droplets during its rotation, and the water droplets can evenly strike on the outdoor heat exchanger 12 under the action of air blowing of the axial flow fan blade 131. Since the outdoor heat exchanger 12 is at a high temperature, the water droplets exchange heat with the outdoor heat exchanger 12 to lower the temperature of the outdoor heat exchanger 12, thereby reducing the power of the window air conditioner 10, and improving the cooling energy efficiency ratio of the window air conditioner 10.

Figure 39:
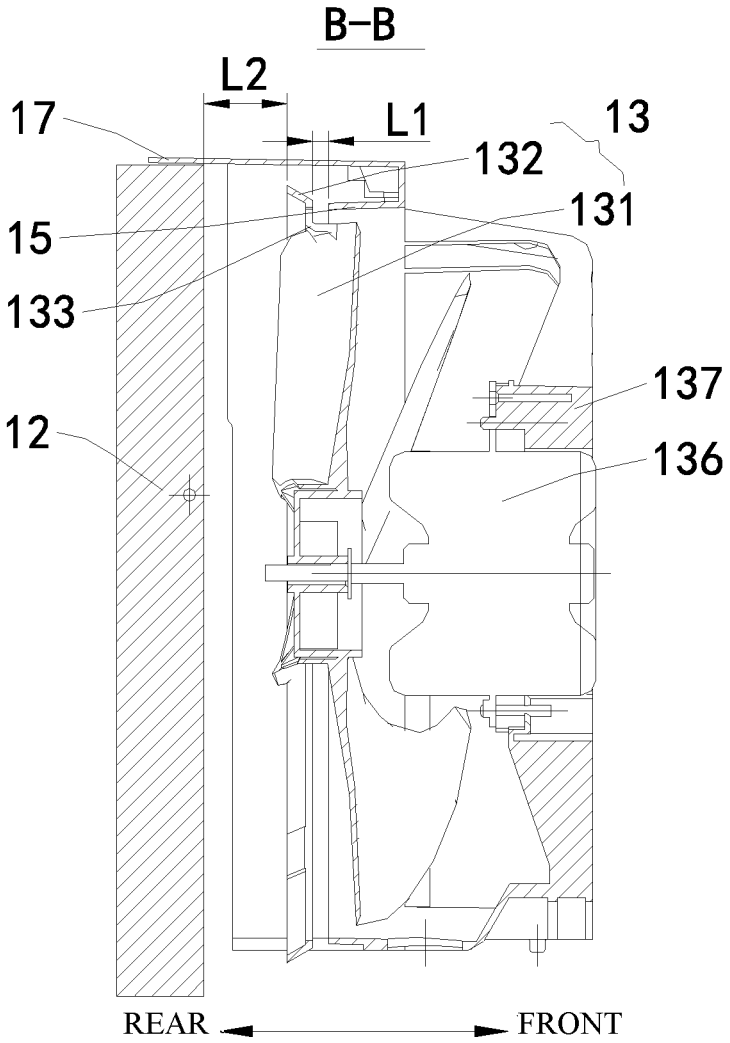
FIG. 39 is a sectional view taken along line B-B in FIG. 38.

As shown in FIG. 39, the outdoor assembly 1*a* further includes an air guide ring 15 around the axial flow fan blade 131, and the air guide ring 15 can be substantially formed in a cylindrical structure. The air guide ring 15 is located on a side of the water splash ring 132 away from the outdoor heat exchanger 12 to realize an air guide function and ensure the air volume to the axial flow fan blade 131. The air guide ring 15 and the water splash ring 132 are spaced apart from each other along an axial direction of the axial flow fan blade 131, and in the axial direction of the axial flow fan blade 131, a distance between the water splash ring 132 and the air guide ring 15 is represented by L1 and L1≥5 mm, so as to ensure a sufficient separation distance between the water splash ring 132 and the air guide ring 15 to avoid interference between the air guide ring 15 and the water splash ring 132, which may otherwise affect normal rotation of the water splash ring 132.

L1 may refer to the separation distance between the water splash ring 132 and the air guide ring 15 in the axial direction of the axial flow fan blade 131. For example, L1 may be 7 mm, 8.4 mm, 9 mm, or etc. Further, L1 satisfies L1≥10 mm, and for example, L1 may be 11 mm, 12.6 mm, 13.2 mm, or etc.

Further, as shown in FIG. 39, the air guide ring 15 and the outdoor heat exchanger 12 are spaced apart from each other in the axial direction of the axial flow fan blade 131, and in the axial direction of the axial flow fan blade 131, a distance between the water splash ring 132 and the outdoor heat exchanger 12 is represented by L2 and L2≥12 mm, so as to ensure a sufficient separation distance between the water splash ring 132 and the outdoor heat exchanger 12 to avoid interference between the outdoor heat exchanger 12 and the water splash ring 132, which may otherwise affect the normal rotation of the water splash ring 132.

Here, L2 may refer to the separation distance between the outdoor heat exchanger 12 and the air guide ring 15 in the axial direction of the axial flow fan blade 131. For example, L2 may be 12.9 mm, 13.7 mm, 14 mm, or etc.

In an example of FIG. 39, the outdoor motor 136 can be mounted by means of a motor frame 137. An outer side of the axial flow fan blade 131 is provided with a back panel 17, and the back panel 17 is located on a side of the motor frame 136 adjacent to the outdoor heat exchanger 12. The back panel 17 is fixedly connected to the outdoor heat exchanger 12 and can form an air flow passage, and the axial flow fan blade 131 drives air in the air flow passage to flow to exchange heat with the outdoor heat exchanger 12. The back panel 17, the motor frame 136, and the air guide ring 15 can be a one-piece member. For example, the back panel 17, the motor frame 136 and the air guide ring 15 can be integrally formed.

Figure 40:
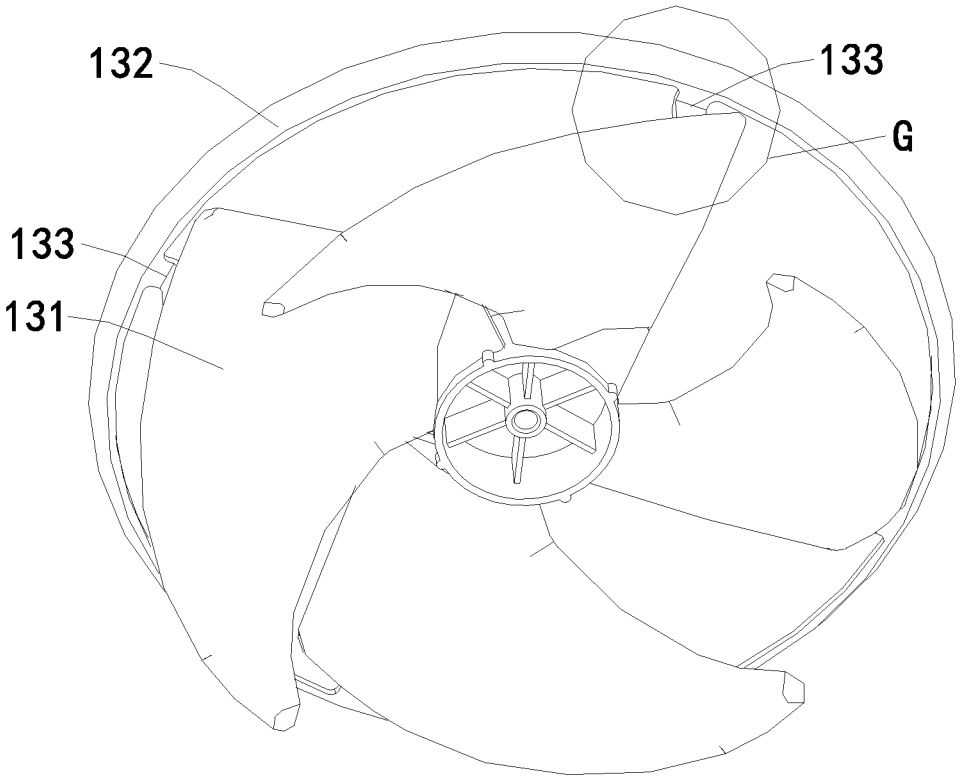
FIG. 40 is an assembly diagram of an axial flow fan blade and a water splash ring shown in FIG. 39.
Figure 41:
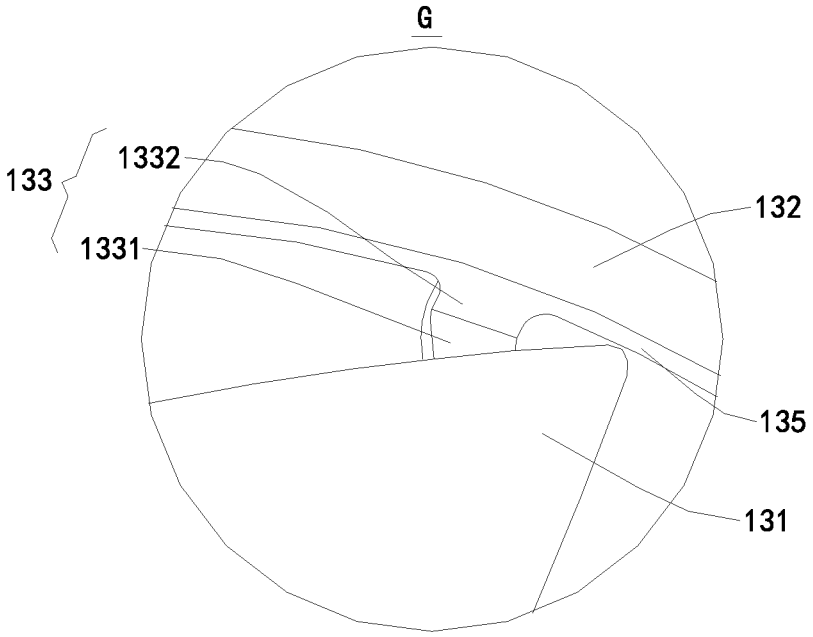
FIG. 41 is an enlarged view of part G circled in FIG. 40.
Figure 45:
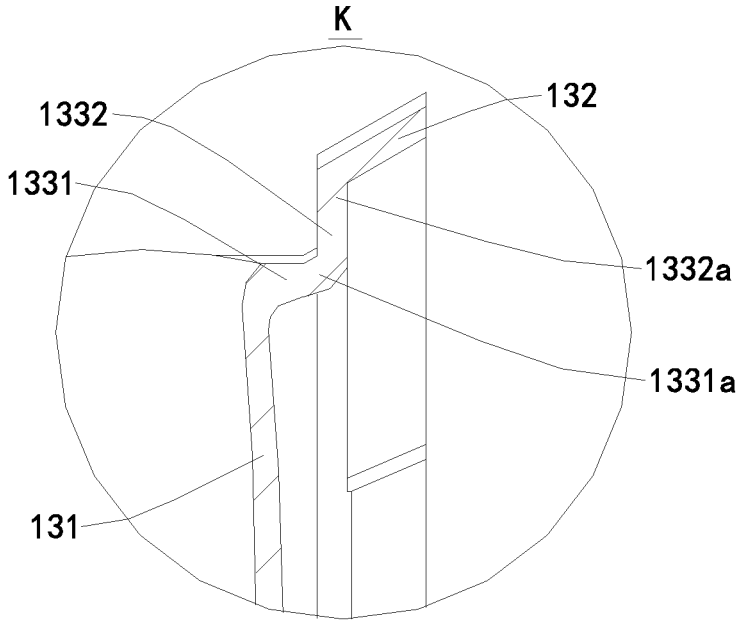
FIG. 45 is an enlarged view of part K circled in FIG. 44.
Figure 46:
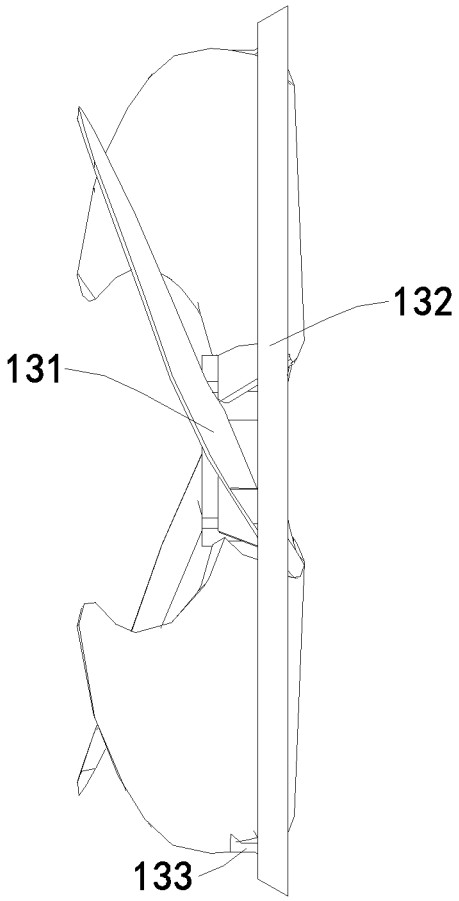
FIG. 46 is still another assembly diagram of the axial flow fan blade and the water splash ring shown in FIG. 40.
Figure 47:
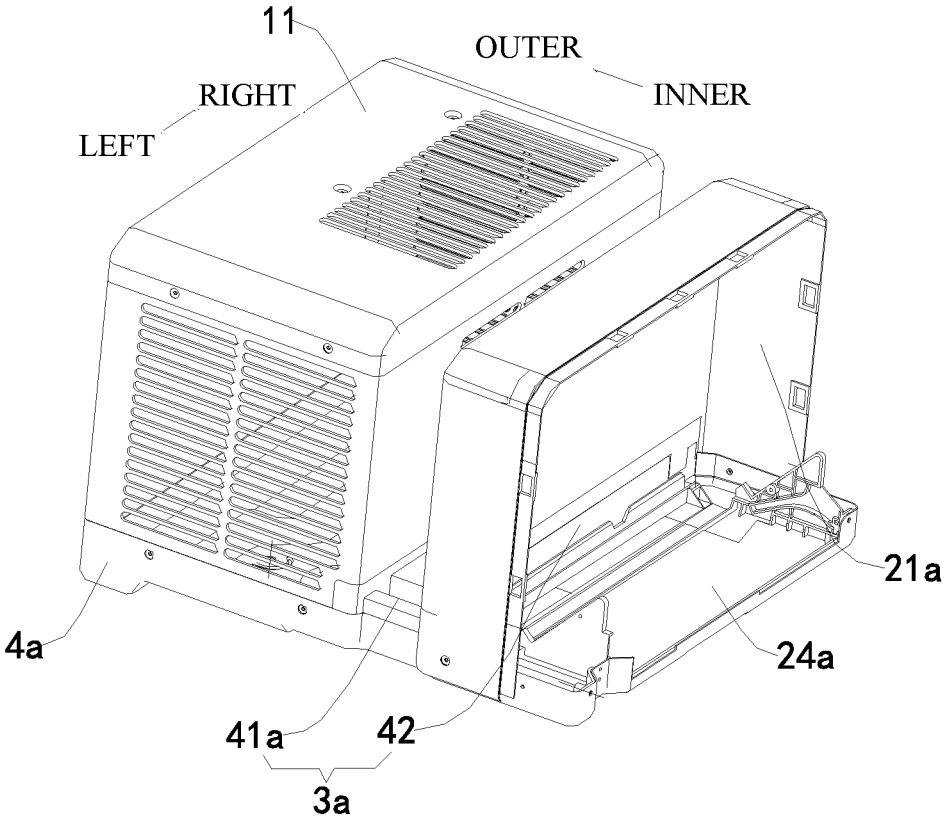
FIG. 47 is a schematic view of a partial structure of the window air conditioner in FIG. 1.
Figure 48:
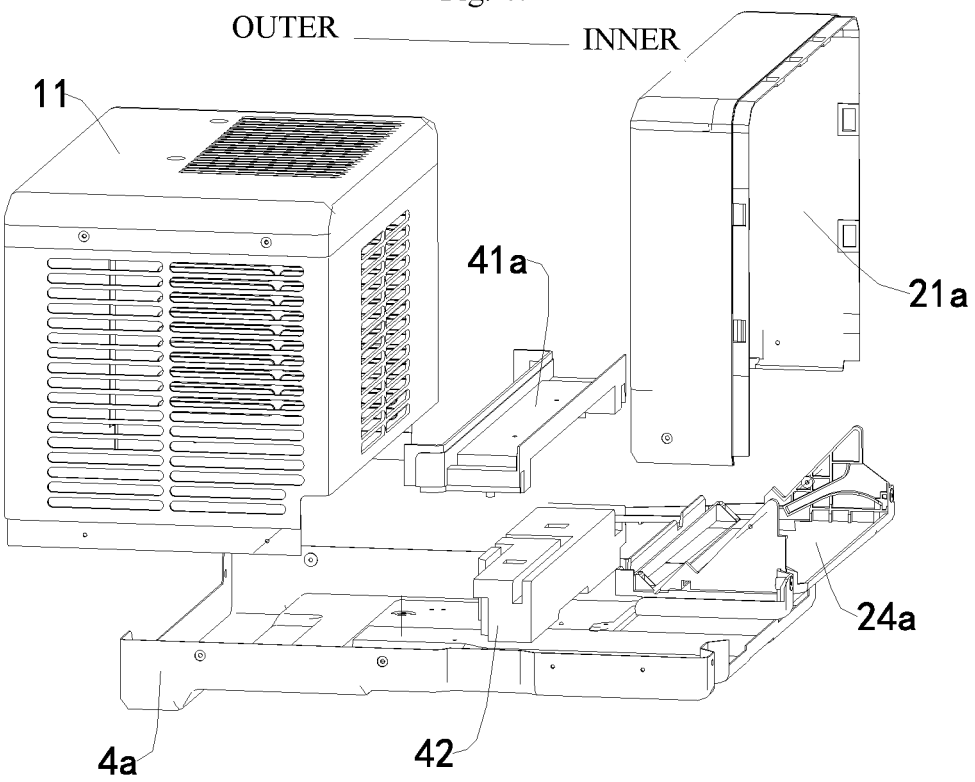
FIG. 48 is an exploded view of the window air conditioner in FIG. 47.

Specifically, as shown in FIGS. 40, 41, and 45, the water splash ring 132 and the outer edge of the axial flow fan blade 131 are connected by a connecting portion 133. The connecting portion 133 includes a first segment 1331 and a second segment 1332. The first segment 1331 extends from the outer edge of the axial flow fan blade 131 towards the outdoor heat exchanger 12, and an extension direction of the first segment 1331 can be in parallel with a central axis 1310 of the axial flow fan blade. The second segment 1332 extends from an extension tail end 1331*a* of the first segment towards a direction away from the central axis 1310 of the axial flow fan blade, and an extension direction of the second segment 1332 can be perpendicular to the central axis 1310 of the axial flow fan blade. Thus, the connecting portion 133 is substantially L-shaped. The water splash ring 132 is connected with an extension tail end 1332*a* of the second segment to ensure the connection reliability between the water splash ring 132 and the axial flow fan blade 131. At the same time, since the connecting portion 133 extends in a bent form to avoid the air guide ring 15, so as to prevent the air guide ring 15 from interfering with the connecting portion 133 and hence from affecting normal rotation of the connecting portion 133. Moreover, the connecting portion 133 can also drive the condensation water during the rotation to improve a water splash effect of the water splash ring 132. Thus, the normal rotation of the axial flow fan blade 131 is ensured, by avoiding a situation where the connecting portion 133 is formed in a straight strip shape and is prone to interfering with the air guide ring 15 and the outdoor heat exchanger 12.

Figure 44:
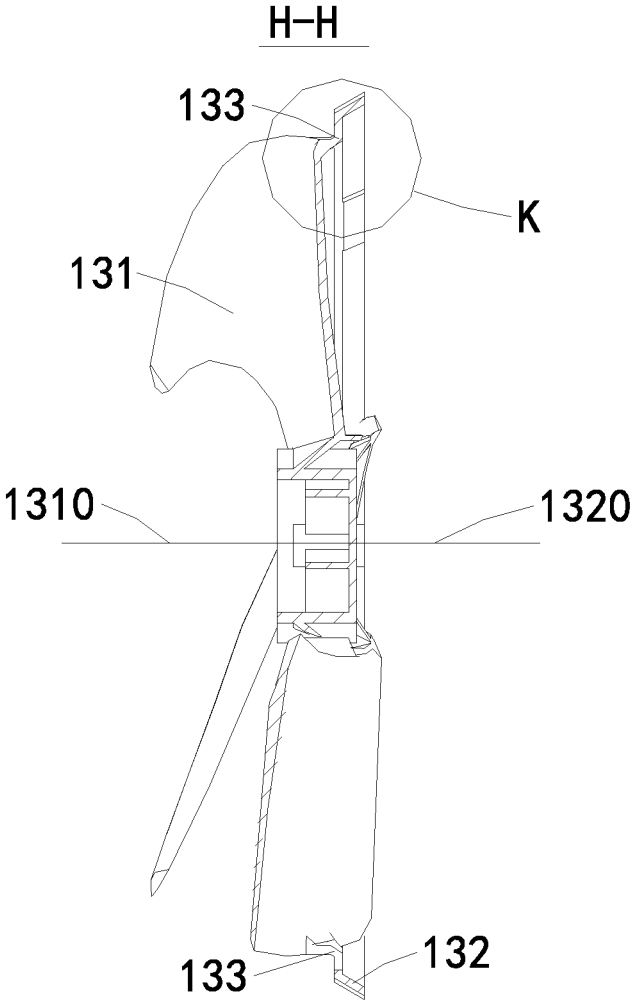
FIG. 44 is a sectional view taken along line H-H in FIG. 42.

Further, in examples of FIGS. 44 and 45, the water splash ring 132 is formed in an annular structure, and the water splash ring 132 has a diameter gradually increased in a direction from the air guide ring 15 to the outdoor heat exchanger 12, such that a tangential force is formed at an end of the water splash ring 132, and the water droplets are dispersed effectively under the action of the tangential force to ensure the water splash effect of the water splash ring 132.

It should be noted that the diameter of the water splash ring 132 may refer to an inner diameter of the water splash ring 132, that is, the inner diameter of the water splash ring 132 is gradually increased along the direction from the air guide ring 15 to the outdoor heat exchanger 12. In such a case, an outer diameter of the water splash ring 132 can remain constant or can also be gradually increased in the direction from the air guide ring 15 to the outdoor heat exchanger 12, but is not limited thereto. When the inner diameter and the outer diameter of the water splash ring 132 are both gradually increased in the direction from the air guide ring 15 to the outdoor heat exchanger 12, the water splash ring 132 can realize an equal-thickness design.

Specifically, as shown in FIG. 45, when the inner diameter of the water splash ring 132 is gradually increased linearly in the direction from the air guide ring 15 to the outdoor heat exchanger 12, an inner wall surface of the water splash ring 132 can be formed into a substantially tapered surface. At this time, a taper angle $\alpha$ corresponding to the inner wall surface of the water splash ring 132 can satisfy: $30° \leq \alpha \leq 90°$. In other words, an included angle $\beta$ between an extension direction of the inner wall surface of the water splash ring 132 and a central axis 1320 of the water splash ring can satisfy: $15° \leq \alpha \leq 45°$.

Figure 42:
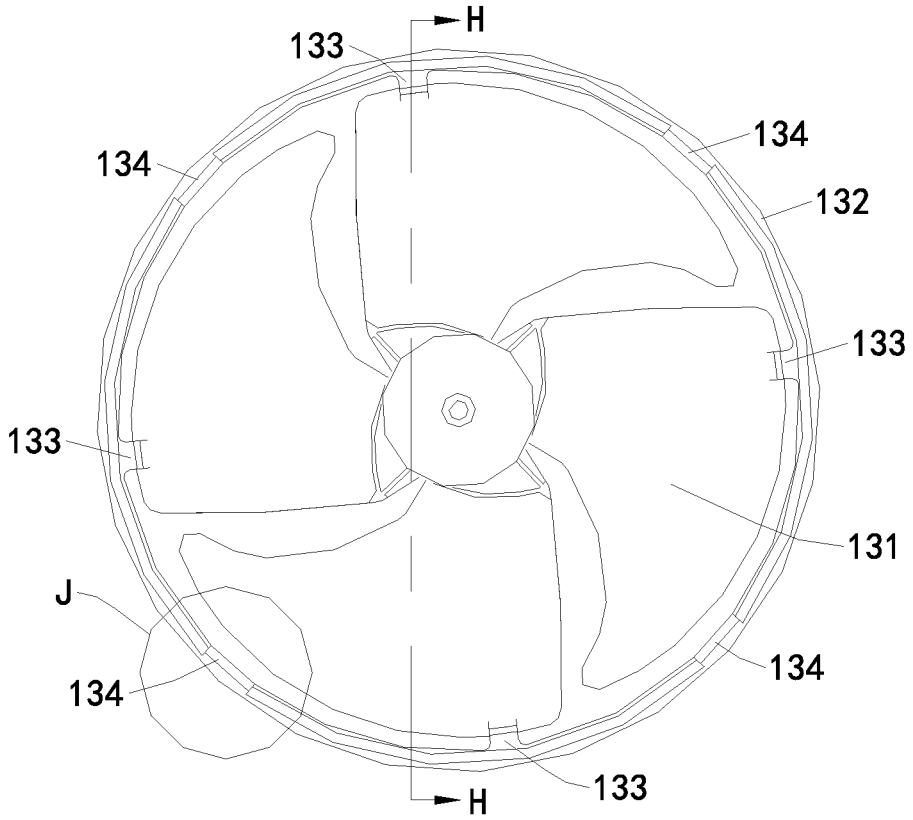
FIG. 42 is another assembly diagram of the axial flow fan blade and the water splash ring shown in FIG. 40.
Figure 43:
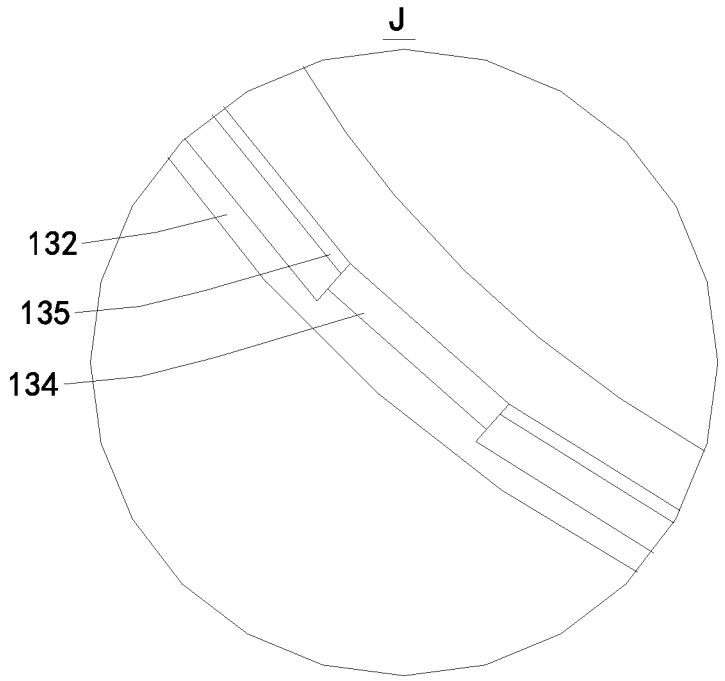
FIG. 43 is an enlarged view of part J circled in FIG. 42.

Further, as shown in FIG. 42 and FIG. 43, an inner peripheral surface of the water splash ring 132 is provided with at least one water splash rib 134, and the water splash rib 134 can be formed in such a way that the inner peripheral surface of the water splash ring 132 partially protrudes inwards, thereby further improving the water splash effect of the water splash ring 132. One or more water splash ribs 134 can be provided. When a plurality of water splash ribs 134 are provided, the plurality of water splash ribs 134 can be spaced apart along a circumferential direction of the water splash ring 132. An end of the water splash ring 132 adjacent to the air guide ring 15 has an anti-backflow ring 135 extending towards the central axis 1320 of the water splash ring. The anti-backflow ring 135 can be formed in an annular structure, and the anti-backflow ring 135 can be formed in such a way that the inner peripheral surface of the water splash ring 132 partially protrudes inwards. Hence, during the rotation of the water splash ring 132, the anti-backflow ring 135 prevents water from flowing back, and prevents the water droplets from striking on the side of the water splash ring 132 away from the outdoor heat exchanger 12, thereby further ensuring the water splash effect. The extension tail end 1332*a* of the second segment can be connected to the anti-backflow ring 135.

In some specific embodiments of the present disclosure, the indoor air outlet 212 is located above the indoor air inlet 211*a*, and the indoor air outlet 212 extends obliquely upwards along a direction from the outdoor assembly 1*a* to the indoor assembly 2*a*. For example, as shown in FIGS. 1, 2 and 33, the indoor air inlet 211*a* can be formed in a side wall of the indoor housing 21*a* away from a side (e.g., a front side in FIG. 1) of the outdoor housing 11. The indoor air outlet 212 can be spaced apart from the indoor air inlet 211*a*. The indoor air outlet 212 can extend obliquely upwards with respect to the horizontal direction, such that a distance between the indoor air outlet 212 and the indoor air inlet 211*a* in the up-down direction can be increased in the case of the same air volume, thereby enlarging an opening area of the indoor air inlet 211*a* and an air inlet area of the indoor air inlet 211*a*, and increasing the air volume into the indoor assembly 2*a*. In the case of the same air volume, the operation noise of the indoor assembly 2*a* can be reduced, the sound quality of the window air conditioner 10 can be improved, and comfort is further upgraded for the user. Since the indoor air outlet 212 obliquely extends upwards, air is obliquely blown upwards through the indoor air outlet 212, such that the indoor air outlet 212 has a suitable air supply distance and air supply height to ensure the comfort of air supply from the window air conditioner 10.

Regarding that the indoor air outlet 212 extends obliquely upwards, it could be understood that an opening direction of the indoor air outlet 212 extends obliquely upwards, or air is obliquely blown upwards through the indoor air outlet 212. For example, an angle between the opening direction of the indoor air outlet 212 and the horizontal direction is represented by $\alpha$, $0° < \alpha < 90°$, and for example, $\alpha$ may be 35°, but is not limited thereto.

It should be noted that, in the description of the present disclosure, a first feature "above" a second feature includes a situation where the first feature is directly or obliquely above the second feature, or merely means that the first feature is at a height higher than the second feature. That is, the arrangement that the indoor air outlet 212 is located above the indoor air inlet 211*a* may include an embodiment in which the indoor air outlet 212 is directly above the indoor air inlet 211*a*, or an embodiment in which the indoor air outlet 212 is obliquely above the indoor air inlet 211*a*.

Optionally, the indoor fan 23*a* can be a cross flow fan, and the indoor fan 23*a* includes a cross flow fan blade 231 whose axis extends in the horizontal direction. The cross flow fan blade 231 is easy to cooperate with the indoor air inlet 211*a* and the indoor air outlet 212, to evenly distribute the air-out volume and the air speed, and reduce the operation noise. The indoor fan 23*a* can include an air channel 230*a*, and the cross flow fan is arranged in the air channel 230*a* to drive the air in the air channel 230*a* to flow. Since the indoor air outlet 212 extends obliquely upwards with respect to the horizontal direction, the arrangement of the indoor air outlet 212 is facilitated, and the air channel 230*a* can be fully utilized, such that the air channel 230*a* and the indoor air outlet 212 cooperate with each other, thereby facilitating the arrangement of the air channel 230*a* and reducing the design cost of the window air conditioner 10.

Further, the window air conditioner 10 further includes the sealing assembly 1, and the sealing assembly 1 is pivotally connected to the partition assembly 3*a* to be rotatable in a stowed position (as shown in FIG. 1) and a sealing position (as shown in FIG. 24 and FIG. 2). When the sealing assembly 1 is pivoted to the stowed position, the sealing assembly 1 is stowed in the receiving groove 21; when the sealing assembly 1 is pivoted to the sealing position, the sealing assembly 1 realizes the sealing between the window sill 101 and the window 4. When the sealing assembly 1 is stowed in the receiving groove 21, it can be ensured that the overall structure of the window air conditioner 10 is small, and the sealing assembly 1 does not occupy the space on the left and right sides of the partition assembly 3*a*, which is applicable to an example that the wall 3 includes a mounting opening 102*a* matching the shape of the window air conditioner 10 (i.e., an example in which the mounting opening 102*a* has a width consistent with a width of the window air conditioner 10), and which facilitates packaging and transportation of the window air conditioner 10. When the sealing assembly 1 is pivoted out of the receiving groove 21 and reaches the sealing position, the sealing assembly 1 is completely or mostly pivoted to the left and right sides of the partition assembly 3*a*, which is applicable to an example that the window air conditioner 10 is mounted to the wall 3 including a mounting opening 102*a* of a greater width than the width of the window air conditioner 10. Thus, since the window air conditioner 10 includes the pivotable sealing assembly 1, the application range of the window air conditioner 10 can be broaden, and the sealing effect of the window air conditioner 10 installed in the examples of the mounting opening 102*a* can be ensured. When the outdoor temperature is low, such as in winter, the user can rotate the sealing assembly 1 to the sealing position to prevent the outdoor cold air from flowing into the room and affecting the comfort in the room.

For example, in examples of FIG. 24, FIG. 1 and FIG. 2, there may be two sealing assemblies 1, each of the sealing assemblies 1 is substantially formed in an elongated shape, and the two sealing assemblies 1 may be connected to two longitudinal ends of the partition assembly 3*a*, respectively. Each of the sealing assemblies 1 has a first end 51 and a second end 52 in its length direction, and the first end 51 of each of the sealing assemblies 1 is pivotally connected to the partition assembly 3*a*, such that the second end 52 of the sealing assembly 1 is rotatable about the first end 51. When the sealing assembly 1 is rotated to the sealing position, the sealing assembly 1 realizes the sealing between the window sill 101 and the window 4, and seals a gap between the window sill 101 and the window 4. When the sealing assembly 1 is rotated to the stowed position, the sealing assembly 1 can extend in the up-down direction to reduce the space occupied by the window air conditioner 10 and facilitate the transportation of the window air conditioner 10.

The window air conditioner 10 according to a specific embodiment of the present disclosure will be described in detail below with reference to the accompanying drawings. It should be understood that the following description is merely illustrative and is not a limitation on the application.

As shown in FIG. 29, the mounting opening 102*a* is formed in the wall 3, the window sill 101 is provided at the bottom of the mounting opening 102*a*, the window 4 is provided at the mounting opening 102*a*, and a window air conditioner assembly 200*a* is mounted on the window sill 101. The window air conditioner assembly 200*a* includes the window air conditioner 10 and a mounting frame assembly 103. The window air conditioner 10 is supported on the window sill 101 by the mounting frame assembly 103. Both sides of the window sill 101 may be the indoor side 101*b* and the outdoor side 101*a*, respectively. The window air conditioner 10 includes the outdoor assembly 1*a*, the indoor assembly 2*a*, the partition assembly 3*a*, the chassis 4*a*, and the sealing assembly 1. The outdoor assembly 1*a* is located on the outdoor side 101*a* of the window sill 101, and the indoor assembly 2*a* is located on the indoor side 101*b* of the window sill 101. The partition assembly 3*a* is directly opposite the window 4 in the up-down direction. The chassis 4*a* is provided at the bottom of the window air conditioner 10, and the outdoor assembly 1*a*, the indoor assembly 2*a*, and the partition assembly 3*a* are all mounted on the chassis 4*a*.

As shown in FIG. 1 and FIGS. 2-36, the outdoor assembly 1*a* includes the outdoor housing 11, the outdoor heat exchanger 12, the outdoor fan 13, the electric control box 14, the air guide ring 15, a compressor 16, and the back panel 17. The outdoor heat exchanger 12, the outdoor fan 13, the electric control box 14, the air guide ring 15, the compressor 16 and the back panel 17 are all arranged in the outdoor housing 11. The electric control box 14 and the compressor 16 are mounted on the chassis 4*a*. The electric control box 14 is spaced apart from the compressor 16 in the left-right direction, and the electric control box 14 and the compressor 16 are both located on a front side of the outdoor fan 13. The back panel 17 is connected to the outdoor heat exchanger 12 to form an air flow passage. The outdoor fan 13 includes the axial flow fan blade 131 and the water splash ring 132, and the water splash ring 132 is connected to the outer edge of the axial flow fan blade 131 to cooperate with the water collecting groove 41 in the chassis 4*a* to splash water. The water splash ring 132 has a diameter gradually increased along a direction from the air guide ring 15 to the outdoor heat exchanger 12. The side of the axial flow fan blade 131 away from the outdoor heat exchanger 12 is provided with the outdoor motor 136. The outdoor motor 136 is connected to the axial flow fan blade 131 to drive the axial flow fan blade 131 to rotate. The air guide ring 15 is located on the side of the water splash ring 132 away from the outdoor heat exchanger 12, and the air guide ring 15 surrounds the axial flow fan blade 131. The air guide ring 15 and the water splash ring 132 are spaced apart from each other along the axial direction of the axial flow fan blade 131, and in the axial direction of the axial flow fan blade 131, the distance between the water splash ring 132 and the air guide ring 15 is represented by L1, and L1≥5 mm. The air guide ring 15 and the outdoor heat exchanger 12 are spaced apart from each other along the axial direction of the axial flow fan blade 131, and in the axial direction of the axial flow fan blade 131, the distance between the water splash ring 132 and the outdoor heat exchanger 12 is represented by L2, and L2≥12 mm. The outdoor housing 11 has the outdoor air inlet 111*a* and the outdoor air outlet 112*a*; the outdoor air inlet 111*a* is located in the top wall as well as left and right side walls of the outdoor housing 11; the outdoor air outlet 112*a* is located in a rear side wall of the outdoor housing 11.

Specifically, the electric control box 14 includes the box body 141 and the top cover 142. The box body 141 includes the mounting chamber 141*a* with an open top, and the top cover 142 is arranged on the top of the box body 141 to open or close the mounting chamber 141*a*. The box body 141 and the top cover 142 are both sheet metal pieces. The water splash ring 132 is connected to the outer edge of the axial flow fan blade 131 through the connecting portion 133. Four connecting portions 133 are provided, the axial flow fan blade 131 includes four blades, and each blade is connected to the water splash ring 132 through one connecting portion 133. Each connecting portion 133 includes the first segment 1331 and the second segment 1332. The first segment 1331 extends from the outer edge of the axial flow fan blade 131 towards the outdoor heat exchanger 12, and the second segment 1332 extends from the extension tail end 1331*a* of the first segment towards the direction away from the central axis 1310 of the axial flow fan blade. Thus, the connecting portion 133 is substantially L-shaped. The water splash ring 132 is connected with the extension tail end 1332*a* of the second segment. The inner peripheral surface of the water splash ring 132 has four water splash ribs 134 spaced apart along the circumferential direction of the water splash ring 132. The end of the water splash ring 132 adjacent to the air guide ring 15 has the anti-backflow ring 135 extending in the direction of the central axis 1320 of the water splash ring. The extension tail end 1332*a* of the second segment is connected to the anti-backflow ring 135.

The indoor assembly 2*a* includes the indoor housing 21*a*, the indoor heat exchanger 22*a*, and the indoor fan 23*a*. The indoor heat exchanger 22*a* and the indoor fan 23*a* are both arranged in the indoor housing 21*a*. The indoor fan 23*a* includes the cross flow fan blade 231 whose axis extends in the horizontal direction. The indoor housing 21*a* has the indoor air inlet 211*a* and the indoor air outlet 212. The indoor air inlet 211*a* is located in a front panel of the indoor housing 11, and the indoor air outlet 212 is arranged above and spaced apart from the indoor air inlet 211*a*. An air deflector can be provided at the indoor air outlet 212. The indoor air outlet 212 extends obliquely upwards along the direction from the outdoor assembly 1*a* to the indoor assembly 2*a*.

The partition assembly 3*a* is arranged between the indoor assembly 2*a* and the outdoor assembly 1*a*, and the receiving groove 21 is formed between the outdoor assembly 1*a* and the indoor assembly 2*a* and above the partition assembly 3*a*. The top, left and right sides of the receiving groove 21 are open. The window 4 can be moved downwards into the receiving groove 21, such that at least a part of the window 4 extends into the receiving groove 21. The sealing assembly 1 is pivotally connected to the partition assembly 3*a* to be rotatable between the stowed position (as shown in FIG. 1) and the sealing position (as shown in FIGS. 24 and 2). The sealing assembly 1 is stowed in the receiving groove 21 when the sealing assembly 1 is pivoted to the stowed position; the sealing assembly 1 realizes the sealing between the window sill 101 and the window 4 when the sealing assembly 1 is pivoted to the sealing position.

Some specific embodiments of the present disclosure are described below in accordance with the accompanying drawings.

As shown in FIGS. 1 and 2, the window air conditioner 10 according to the embodiments of the present disclosure can include the chassis 4*a*, the indoor assembly 2*a*, the outdoor assembly 1*a*, and the partition assembly 3*a*. In combination with FIGS. 34-48, the indoor assembly 2*a* can include the indoor housing 21*a*, the indoor heat exchanger 22 and the indoor fan 23 both arranged in the indoor housing 21*a*; the outdoor assembly 1*a* can include the outdoor housing 11, the outdoor heat exchanger 32 and the outdoor fan 13 both arranged in the outdoor housing 11.

Figure 49:
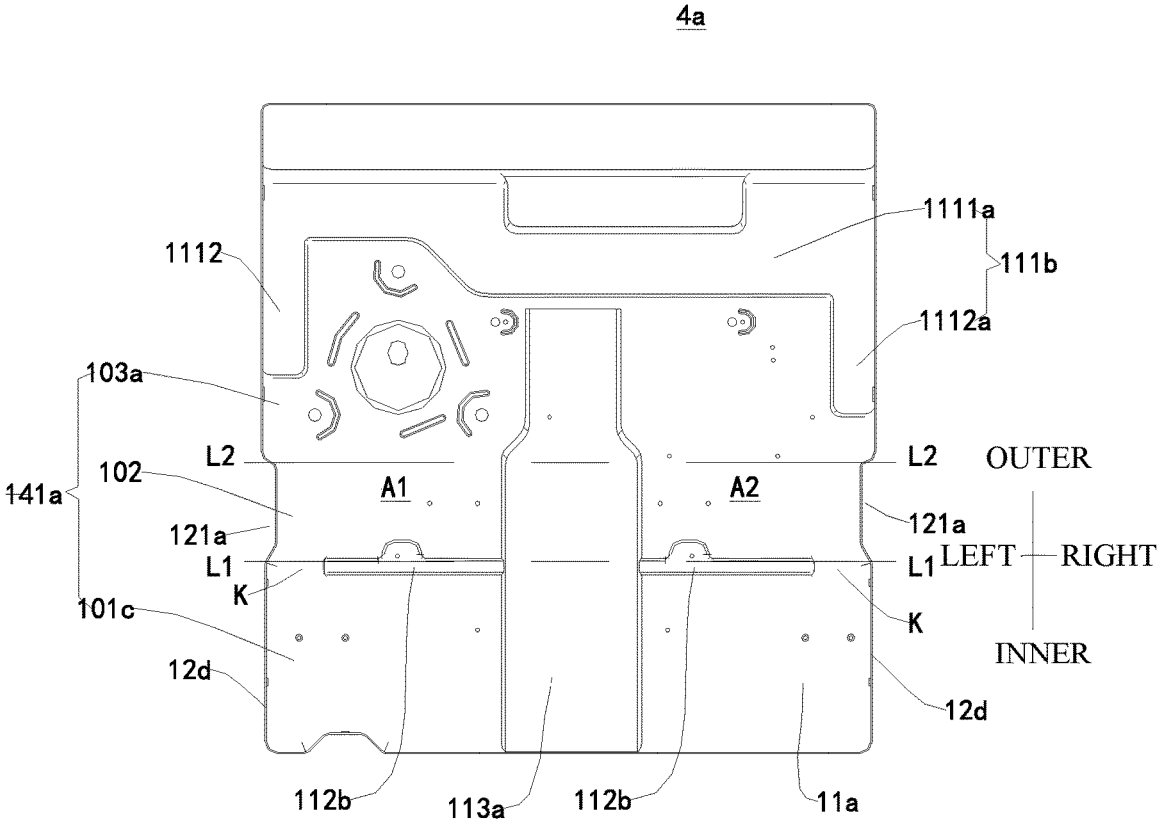
FIG. 49 is a front view of a chassis according to an embodiment of the present disclosure.

As shown in FIG. 49 and FIG. 30, the chassis 4*a* according to the embodiments of the present disclosure can include a bottom plate 11*a* and two side plates 12*d*. The two side plates 12*d* are arranged on two sides of the bottom plate 11*a*, respectively, and form the mounting chamber 141*a* along with the bottom plate 11*a*. That is, the two sides of the bottom plate 11*a* (left and right sides shown in FIG. 49) are separately provided with one side plate 12*d*, and the mounting chamber 141*a* is formed by the two side plates 12*d* and the bottom plate 11*a*. The mounting chamber 141*a* includes a first sub-chamber 101*c*, a second sub-chamber 102, and a third sub-chamber 103*a* sequentially arranged in a length direction of the side plate 12*d* (an inside-outside direction as shown in FIG. 49).

For example, in a specific example shown in FIG. 49, a portion of the mounting chamber 141*a* below line L1-L1 is the first sub-chamber 101*c*; a portion of the mounting chamber 141*a* between line L1-L1 and line L2-L2 is the second sub-chamber 102; and a portion of the mounting chamber 141*a* above line L2-L2 is the third sub-chamber 103*a*.

Referring FIGS. 1 and 2, the first sub-chamber 101*c* is used to bear the indoor assembly 2*a* of the window air conditioner 10, such that the indoor assembly 2*a* is arranged in the first sub-chamber 101*c*. The second sub-chamber 102 is used to bear the partition assembly 3*a*, such that the partition assembly 3*a* is arranged in the second sub-chamber 102. The third sub-chamber 103*a* is used to bear the outdoor assembly 1*a* of the window air conditioner 10, such that the outdoor assembly 1*a* is arranged in the third sub-chamber 103*a*. Referring to FIGS. 1 and 34, the partition assembly 3*a* is provided between the indoor assembly 2*a* and the outdoor assembly 1*a*, that is, the indoor assembly 2*a* and the outdoor assembly 1*a* are arranged on both sides of the partition assembly 3*a*.

As shown in FIGS. 49 and 30, each side plate 12*d* has a concave portion 121*a* recessed towards the other side plate 12*d*, and the concave portion 121*a* constitutes a side wall of the second sub-chamber 102. Thus, each side plate 12*d* can include a first side portion 12*a*, a second side portion 12*b*, and a third side portion 12*c*. The first side portion 12*a* cooperates with the bottom plate 11*a* to form the first sub-chamber 101*c*, such that the first side portion 12*a* constitutes a side wall of the first sub-chamber 101*c*. The second side portion 12*b* cooperates with the bottom plate 11*a* to form the second sub-chamber 102, such that the second side portion 12*b* constitutes a side wall of the second sub-chamber 102. The third side portion 12*c* cooperates with the bottom plate 11*a* to form the third sub-chamber 103*a*, such that the third side portion 12*c* constitutes a side wall of the third sub-chamber 103*a*. Further, it should be noted that the concave portion 121*a* has a recessing depth which is not limited and may range, for example, from 1 cm to 5 cm.

As shown in FIGS. 49 and 30, the first side portion 12*a* and the third side portion 12*c* are connected to both sides of the second side portion 12*b*, and the second side portion 12*b* is located at a side of the first side portion 12*a* and the third side portion 12*c* adjacent to the other side plate 12*d*, such that the concave portion 121*a* is formed at a junction among the second side portion 12*b*, the first side portion 12*a* and the third side portion 12*c*. Thus, by providing the concave portion 121*a* in the side plate 12*d*, the strength of the side plate 12*d* can be reinforced, and the indoor assembly 2*a*, the outdoor assembly 1*a*, and the partition assembly 3*a* can be positioned or mounted at different places by means of the concave portion 121*a*, thereby improving the assembly efficiency of the window air conditioner 10.

Referring to FIG. 1, a receiving space R is formed above the partition assembly 3*a* and between the outdoor assembly 1*a* and the indoor assembly 2*a*, that is, the receiving space R is formed by a bottom wall (formed by an upper surface of the partition assembly 3*a*), an inner side wall (formed by an outer surface of the indoor assembly 2*a*), and an outer side wall (formed by an inner surface of the outdoor assembly 1*a*), which means the receiving space R is open on top, left and right sides thereof. Referring to FIGS. 24 and 29, the window air conditioner 10 is adapted to be supported on the window sill 101, and the window 4 above the window sill 101 can be moved downwards into the receiving space R, that is, when the window 4 above the window sill 101 moves downwards, at least a part of the window 4 can enter the receiving space R.

Therefore, the window air conditioner 10 according to the embodiments of the present disclosure has a flexible structure and is easy to install. It is not necessary to particularly provide a mounting opening in the wall 3 that matches the shape of the window air conditioner 10. The window opening for installation of the window 4 in the wall 3 can be used to realize the installation of the window air conditioner 10. Moreover, since the window 4 can be lowered into the receiving space R, the number of sealing plates can be reduced, saving the implementation cost. Further, since the indoor assembly 2*a* and the outdoor assembly 1*a* can be partitioned by the window 4, the noise of the outdoor assembly 1*a* transmitted to the room can be lowered, reducing the influence of noise on the user indoors.

The window air conditioner 10 according to embodiments of the present disclosure can further include the sealing assembly 1. Referring to FIGS. 1 and 2, the sealing assembly 1 is pivotally connected to the partition assembly 3*a* and is rotatable between the stowed position (as shown in FIG. 1) and the sealing position (as shown in FIG. 2). The sealing assembly 1 is stowed in the receiving space R when the sealing assembly 1 is pivoted to the stowed position (as shown in FIG. 1); an end portion 510*a* of the sealing assembly 1 is rotated into the concave portion 121*a* when the sealing assembly 1 is pivoted to the sealing position (as shown in FIG. 50).

Moreover, as shown in FIGS. 24 and 29, when the window 4 is lowered onto the partition assembly 3*a*, the sealing assembly 1 pivoted to the sealing position realizes the sealing between the window sill 101 and the window 4 (as shown in FIG. 24). Specifically, when the window 4 is lowered onto the partition assembly 3*a*, that is, when the lower surface of the window 4 abuts against the upper surface of the partition assembly 3*a*, there must be a certain air leakage space X between the lower surface of the window 4 and the upper surface of the window sill 101. Thus, by providing the sealing assembly 1, it is possible to solve problems, such as air leakage, noise and the like, due to the air leakage space X.

Therefore, when the sealing assembly 1 is stowed in the receiving space R, it can be ensured that the overall structure of the window air conditioner 10 is small, and the sealing assembly 1 does not occupy the space on the left and right sides of the chassis 4*a*, which is applicable to an example that the wall 3 includes a mounting opening matching the shape of the window air conditioner 10 (i.e., an example in which the mounting opening has a width consistent with a width of the window air conditioner 10), and which facilitates the packaging and transportation of the window air conditioner 10. When the sealing assembly 1 is pivoted out of the receiving space R and reaches the sealing position, the sealing assembly 1 is completely or mostly pivoted to the left and right sides of the chassis 4*a*, which is applicable to an example that the window air conditioner 10 is mounted to the window opening in the wall 3 (i.e., an example where the window opening has a width greater than the width of the window air conditioner 10). Thus, since the window air conditioner assembly 200*a* includes the pivotable sealing assembly 1, the application range of the window air conditioner 10 can be broaden, and the sealing effect of the window air conditioner 10 installed in the example of the window opening can be ensured.

Figure 50:
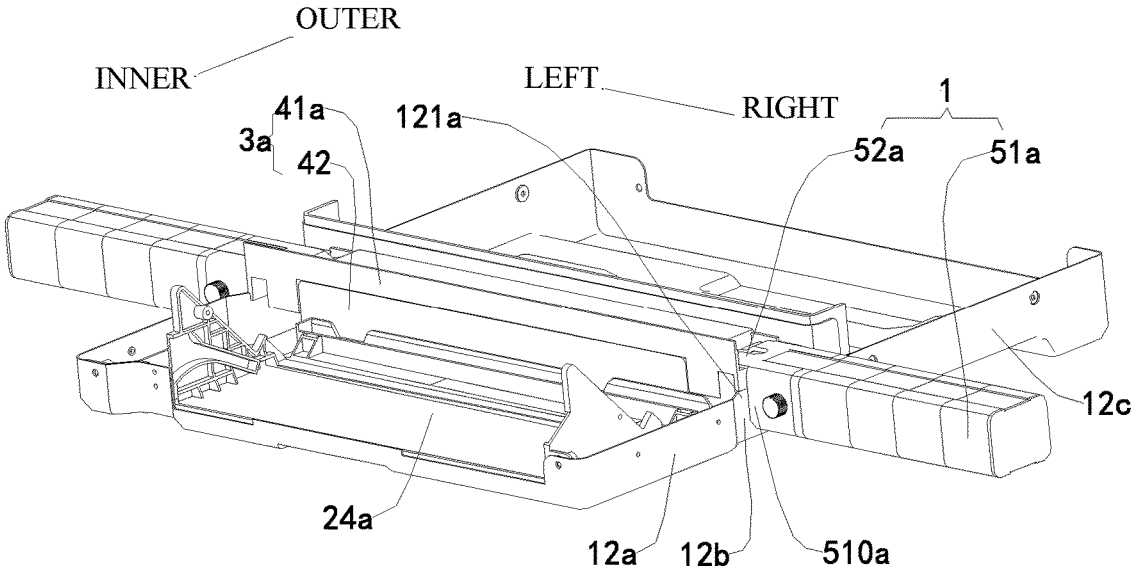
FIG. 50 is an assembly diagram of a chassis with a partition assembly, a drain pan and a sealing assembly according to an embodiment of the present disclosure.
Figure 51:
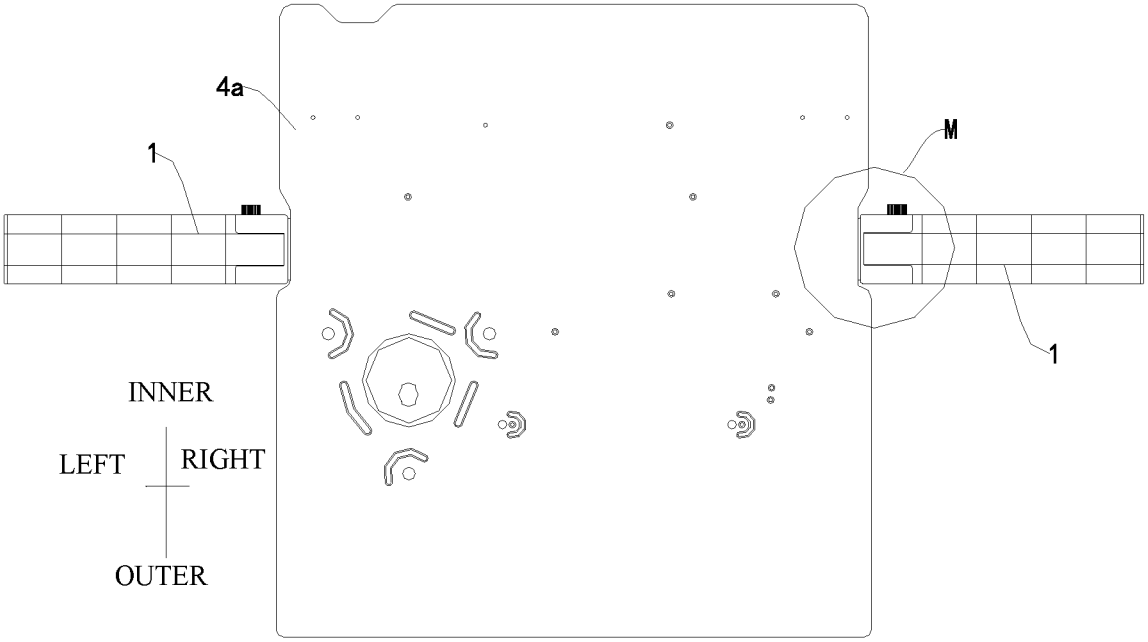
FIG. 51 is a bottom view of the assembly diagram shown in FIG. 50.
Figure 52:
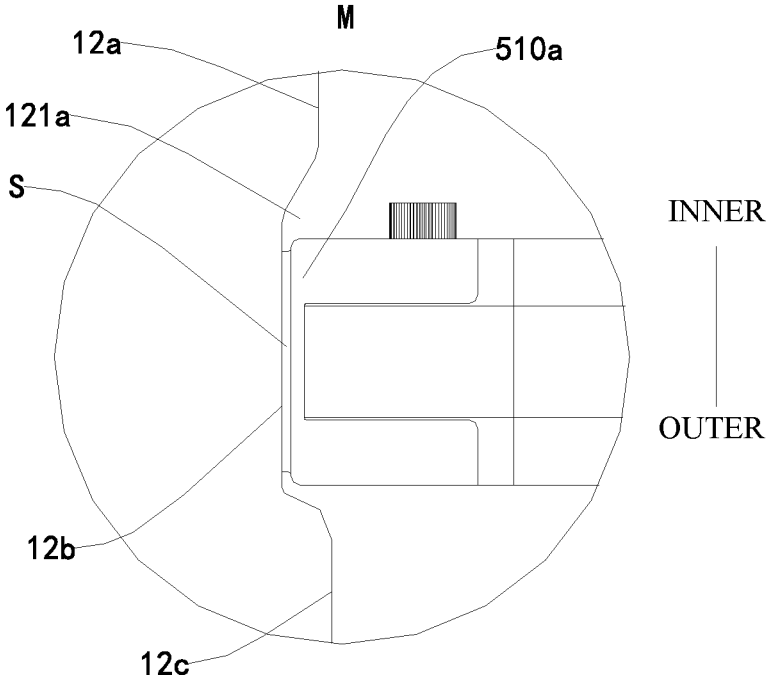
FIG. 52 is an enlarged view of part M circled in FIG. 51.

As shown in FIGS. 50-52, when the window air conditioner assembly 200*a* includes the above sealing assembly 1, by providing the concave portion 121*a*, the smooth rotation of the sealing assembly 1 can be ensured and the sealing performance of installation of the window air conditioner 10 can be improved. Specifically, as shown in FIGS. 50-52, the sealing assembly 1 can include a body 51*a* and a pivoting portion 52*a*. The body 51*a* is pivotally connected to the partition assembly 3*a* through the pivoting portion 52*a*. In order to ensure the smooth pivot of the body 51*a*, a gap S is reserved between an end surface of the end portion 510*a* of the body 51*a* adjacent to the chassis 4*a* and an end surface (a surface of the second side portion 12*b*) of the chassis 4*a* facing the above end surface of the end portion 510*a* (as shown in FIG. 52). When the sealing assembly 1 is rotated to the sealing position, the end portion 510*a* is rotated into the concave portion 121*a*, such that the gap S is located in the concave portion 121*a*. Thus, in a direction from the inside to the outside (or a direction from the outside to the inside), the gap S is blocked by the first side portion 12*a* or the third side portion 12*c*, such that problems such as air leakage and noise due to the gap S can be avoided, thereby improving the sealing effect with a clever design.

Figure 53:
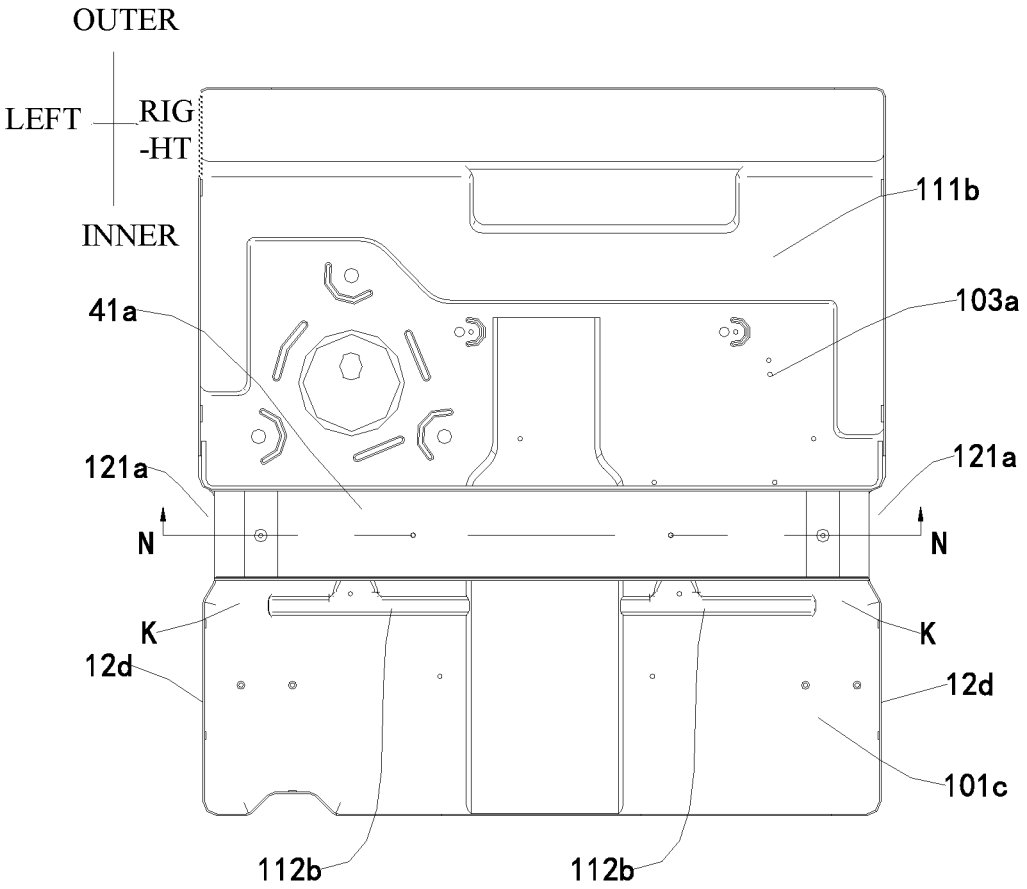
FIG. 53 is a top view showing the assembly of a chassis with a partition assembly according to an embodiment of the present disclosure.

In some embodiments of the present disclosure, as shown in FIG. 53, an upper surface of the bottom plate 11*a* can be provided with a rib 112*b*, and the rib 112*b* is located between the first sub-chamber 101*c* and the third sub-chamber 103*a* (that is, the rib 112*b* may be arranged on a side of the first sub-chamber 101*c* adjacent to the second sub-chamber 102, or the rib 112*b* may be arranged in the second sub-chamber 102, or the rib 112*b* may be arranged on a side of the third sub-chamber 103*a* adjacent to the first sub-chamber 101*c*). The rib 112*b* extends (may extend along a straight line and/or a curved line) in a direction from one side plate 12*d* to the other side plate 12*d* (in a left-right direction as shown in FIG. 53). By providing the rib 112*b* extending in the left-right direction between the first sub-chamber 101*c* and the third sub-chamber 103*a*, it is possible to prevent liquid such as rainwater on the outdoor side from entering the indoor side by means of the rib 112*b*, thereby improving the operational reliability of the window air conditioner 10.

As shown in FIG. 53, the rib 112*b* and the two side plates 12*d* can be spaced apart, that is, the rib 112*b* is not in contact with either of the side plates 12*d*. Thus, a reserved space K between the rib 112*b* and the side plates 12*d* can be utilized to facilitate the layout of a refrigerant pipe, an electric control line, a drainage channel, and the like (for example, a drainage channel can be arranged at a drainage via hole 401, and an electric control line and a refrigerant pipe can be arranged at a wiring via hole 402 in FIG. 54), thereby improving space utilization and enhancing the overall structural compactness of the window air conditioner 10.

Figure 55:
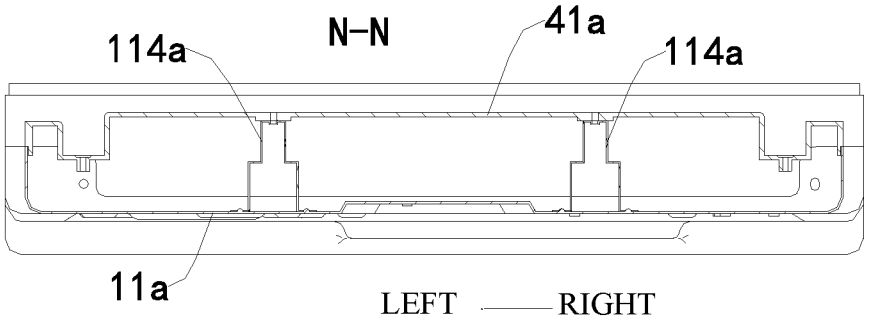
FIG. 55 is a sectional view taken along line N-N in FIG. 53.

In some embodiments of the present disclosure, as shown in FIGS. 30 and 55, the upper surface of the bottom plate 11*a* can be provided with a bracket 114*a*. At least one bracket 114*a* is provided and located in the second sub-chamber 102 to support the partition assembly 3*a*. That is, the partition assembly 3*a* can be supported and mounted on the bracket 114*a*. Thus, convenience and reliability of mounting of the partition assembly 3*a* and the chassis 4*a* can be improved by utilizing the bracket 114*a*. Further, the reliability of supporting the window 4 by the partition assembly 3*a* can be enhanced by the bracket 114*a*, that is, the pressure resistance of the partition assembly 3*a* is reinforced, and a problem that the partition assembly 3*a* is deformed by the window 4 is solved to some extent. Preferably, a plurality of brackets 114*a* are provided and spaced apart along a length direction of the second sub-chamber 102 (a left-right direction as shown in FIG. 30), such that the pressure resistance of the partition assembly 3*a* can be further enhanced, and the problem that the partition assembly 3*a* is deformed by the window 4 is further solved.

Figure 56:
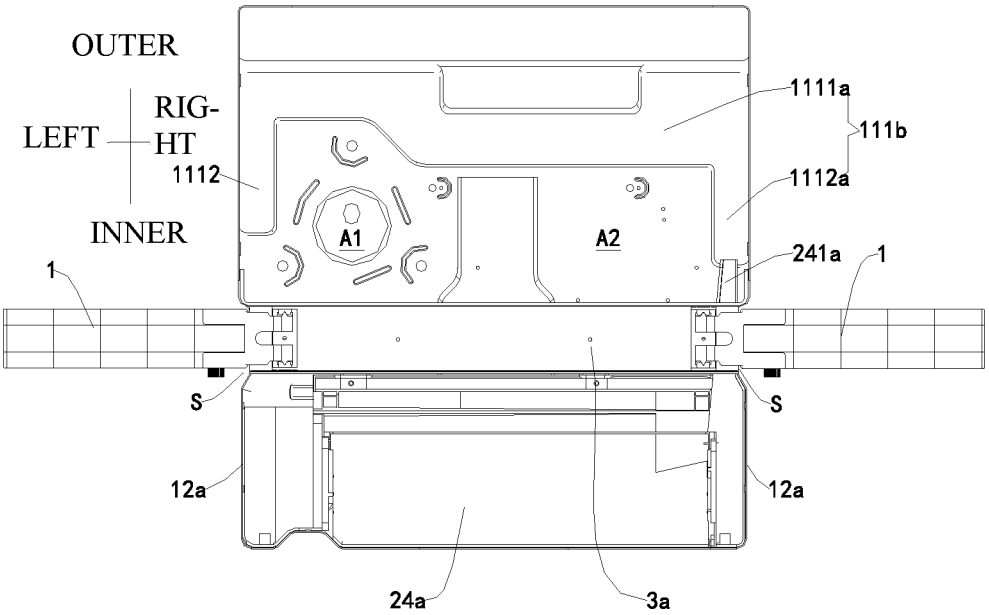
FIG. 56 is a top view of the assembly diagram shown in FIG. 50.

In some embodiments of the present disclosure, as shown in FIG. 49 and FIG. 56, the upper surface of the bottom plate 11*a* can include a drainage groove 111*b* recessed downwards. The drainage groove 111*b* is located in the third sub-chamber 103*a*, and includes a water collecting portion 1111*a* and a water guiding portion 1112*a*. The water collecting portion 1111*a* extends from one side plate 12*d* to the other side plate 12*d*, and the water guiding portion 1112*a* starts from an intersection of the water collecting portion 1111*a* and the side plate 12*d* and extends along the length direction of the side plate 12*d* towards the first sub-chamber 101*c* (a direction from the outside to the inside as shown in FIG. 49), which means that the water guiding portion 1112*a* is adjacent to the side plate 12*d* and extends along the side plate 12*d*.

Therefore, since the water guiding portion 1112*a* is more adjacent to the first sub-chamber 101*c* which is used for bearing the indoor assembly 2*a*, the condensation water generated by the indoor assembly 2*a* can smoothly flow to the outdoor side, thereby reliability and convenience of drainage from the first sub-chamber 101*c* to the drainage groove 111*b*. Moreover, since the water guiding portion 1112*a* is adjacent to the side plate 12*d*, an overall space occupied by the drainage groove 111*b* in the third sub-chamber 103*a* can be reduced, which ensures that the third sub-chamber 103*a* can also have sufficient space (e.g., space A1, A2 shown in FIG. 56) to arrange the compressor 16, the electric control box 14, the outdoor fan 13, and the like (in combination with FIG. 34).

Figure 54:
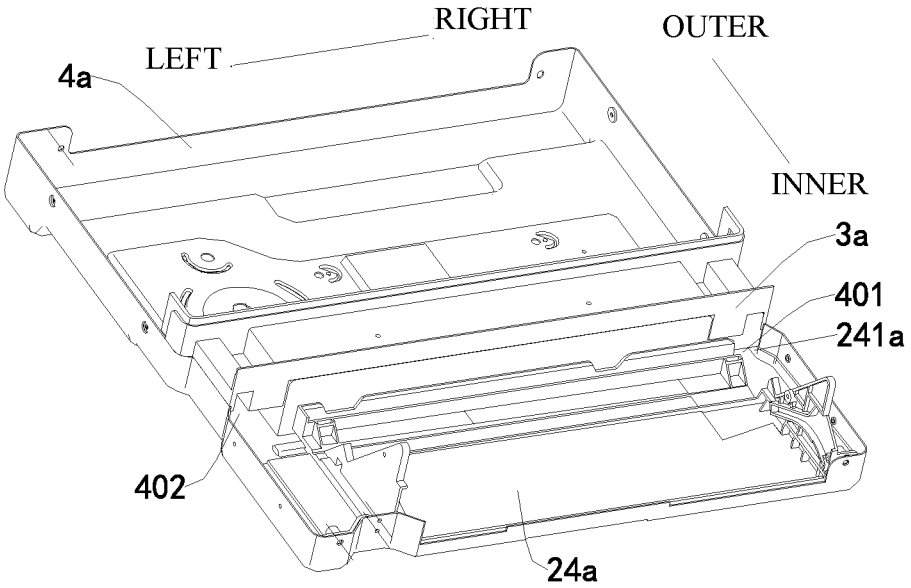
FIG. 54 is an assembly diagram of the chassis and the partition assembly shown in FIG. 53.
Figure 57:
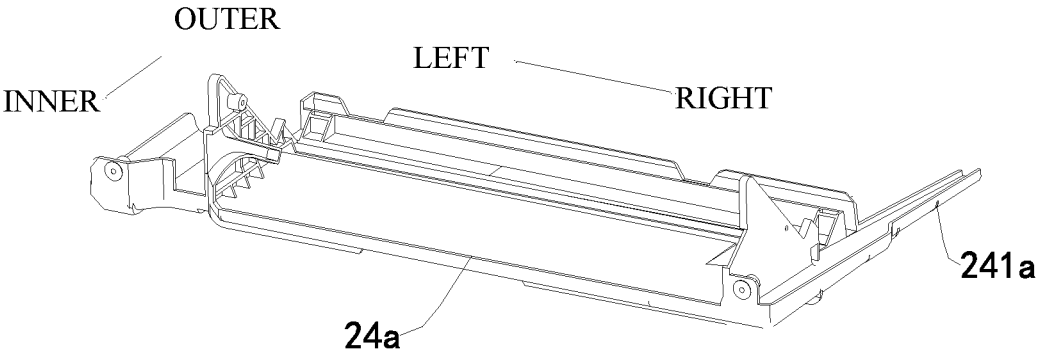
FIG. 57 is a perspective view of a drain pan according to an embodiment of the present disclosure.

Referring to FIGS. 54 and 56-57, the window air conditioner 10 can further include a drain pan 24*a*. The drainage via hole 401 is formed between the partition assembly 3*a* and the chassis 4*a*. The indoor assembly 2*a* further includes the drain pan 24*a* below the indoor heat exchanger 22. The drain pan 24*a* has an extension segment 241*a*, and the extension segment 241*a* includes a drainage channel (the drainage channel may be a non-open channel or a top-open channel). The extension segment 241*a* passes through the drainage via hole 401 and extends to the water guiding portion 1112*a*, to output water in the drain pan 24*a* to the water guiding portion 1112*a*. Thus, the drain pan 24*a* can convey the condensation water to the water guiding portion 1112*a* through the extension segment 241*a* reliably and efficiently, thereby improving the drainage reliability and convenience, and enhancing the reliability of the window air conditioner 10.

Here, it is to be noted that the partition assembly 3*a* can include a partition member 41*a*, and a filling member provided between the partition member 41*a* and the chassis 4*a*. The material of the partition member 41*a* is not limited, and may be, for example, a sheet metal or the like. Thus, the reliability of partitioning the indoor assembly 2*a* from the outdoor assembly 1*a*, and the reliability of supporting the window 4 can be improved. The material of the filling member is not limited, and may be, for example, foam or the like, so as to bring about a heat preservation effect, a sound insulation effect, a sealing effect, and the like.

Returning to FIG. 56, two water guiding portions 1112*a* can be provided and arranged on two longitudinal sides of the water collecting portion 1111*a* (e.g., left and right sides shown in FIG. 56), which can further improve the reliability and convenience of drainage from the first sub-chamber 101*c* to the drainage groove 111*b*, and can adapt to the drain pan 24*a* of different structures. For example, whether the drain pan having the extension segment 241*a* on the left side is used, or the drain pan 24*a* having the extension segment 241*a* on the right side is used, it can be ensured that the extension segment 241*a* is in reliable connection with the water guiding portion 1112*a*, thereby improving the adaptability of the chassis 4*a*.

Figure 58:
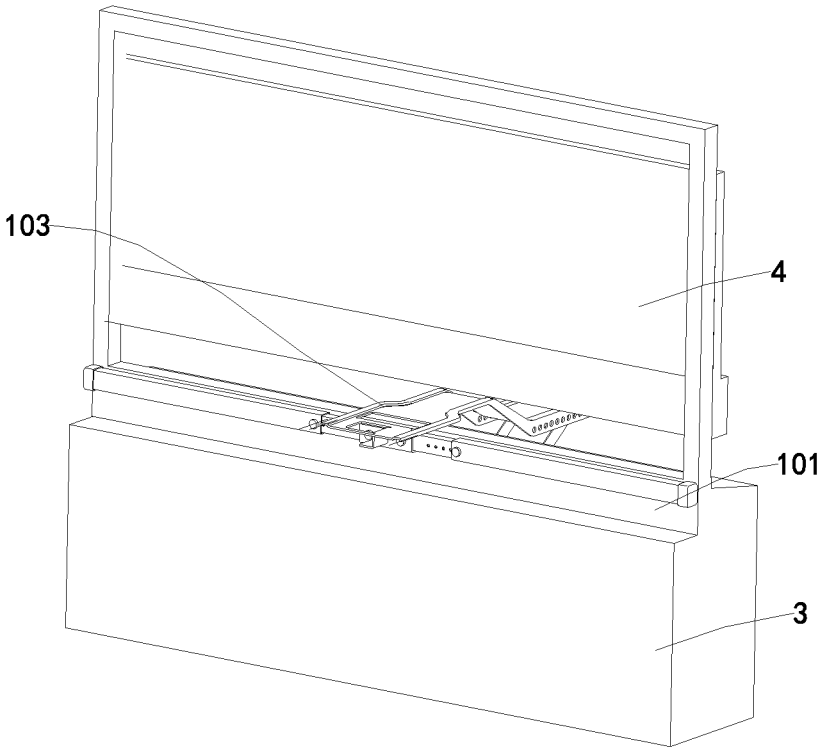
FIG. 58 is an installation diagram of a mounting frame assembly according to an embodiment of the present disclosure.

In some embodiments of the present disclosure, as shown in FIGS. 29 and 58, the window air conditioner assembly 200*a* according to embodiments of the present disclosure can include the window air conditioner 10 according to any one of the embodiments of the present disclosure and a mounting frame assembly 200. The mounting frame assembly 200 enables the window air conditioner 10 to be supported on the window sill 101 through the mounting frame assembly 200, that is, the mounting frame assembly 200 is mounted on the window sill 101, and the window air conditioner 10 is mounted on the mounting frame assembly 200, thereby realizing the installation of the window air conditioner 10 on the window sill 101.

Referring to FIGS. 49 and 30, a lower surface of the bottom plate 11*a* can have an avoidance groove 113*a* recessed upwards. The avoidance groove 113*a* is at least located below the second sub-chamber 102 and is configured to receive the mounting frame assembly 200, and the mounting frame assembly 200 is arranged on the window sill 101 and received in the avoidance groove 113*a*. Here, it should be noted that the mounting frame assembly 200 does not need to be completely received in the avoidance groove 113*a*. Depending on a structure of the mounting frame assembly 200, only a portion of the mounting frame assembly 200 that is arranged on the window sill 101 and supports the bottom of the window air conditioner 10 needs to be received in the avoidance groove 113*a*. Thus, when the window air conditioner 10 is arranged on the mounting frame assembly 200, the portion of the mounting frame assembly 200 supported on the window sill 101 can be received in the avoidance groove 113*a* in the bottom of the window air conditioner 10, such that a lower surface of the window air conditioner 10 (i.e., a lower surface of the chassis 4*a*) can be in contact with the window sill 101, that is, the chassis 4*a* can be pressed onto the window sill 101, thereby enhancing the stability and reliability of installation of the window air conditioner 10.

As shown in FIG. 49, the avoidance groove 113*a* can extend along the length direction of the side plate 12*d* and extend to the drainage groove 111*b*. The drainage groove 111*b* is a downwards recess on the upper surface of the bottom plate 11*a* and located in the third sub-chamber 103*a*. Two sides of the avoidance groove 113*a* in a width direction are each provided with the rib 112*b*. The ribs 112*b* are arranged on the upper surface of the bottom plate 11*a* and located on the side of the first sub-chamber 101*c* adjacent to the second sub-chamber 102, and the ribs 112*b* extend in a direction from one side plate 12*d* to the other side plate 12*d*. That is, when the chassis 4*a* has the above avoidance groove 113*a*, the drainage groove 111*b*, and the rib 112*b* at the same time, all of which can be arranged in the above manner, thereby improving the structural compactness of the chassis 4*a*.

Additionally, it should be noted that the material of the chassis 4*a* according to the embodiments of the present disclosure is not limited. For example, the chassis 4*a* may be made of a sheet metal, such as a galvanized sheet, a steel sheet, or the like. The thickness of the chassis 4*a* is not limited, and for example, can have a thickness of 0.8 to 1.2 mm. Thus, the structural reliability and cost efficiency of the chassis 4*a* can be easily improved. Further, the operation principle of the window air conditioner 10 according to the embodiments of the present disclosure is known to those skilled in the art and will not be described in detail herein.

Other configurations and operations of the window air conditioner 10 according to the embodiments of the present disclosure are known to those skilled in the art and will not be described in detail herein.

In the present disclosure, it shall be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or position as then described or as shown in the drawings under discussion. These relative terms are for convenience of description and do not indicate or imply that the referred device or element must have a particular orientation, or be constructed or operated in a particular orientation, and thus shall not be construed to limit the present disclosure. In addition, the feature associated with "first" and "second" may comprise one or more of this feature. In the description of the present disclosure, the term "a plurality of" means two or more than two, unless specified otherwise. In the description of the present disclosure, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween.

In the present disclosure, a first feature "on," "above," or "on top of" a second feature may include an embodiment in which the first feature is right or obliquely "on," "above," or "on top of" the second feature, or just means that the first feature is at a height higher than that of the second feature.

In the present disclosure, unless specified or limited otherwise, the terms "mounted," "connected," "coupled" and the like are used broadly, and may be, for example, fixed connections, detachable connections, or integral connections; may also be mechanical or electrical connections; may also be direct connections or indirect connections via intervening structures; may also be inner communications of two elements, which could be understood by those skilled in the art according to specific situations.

Reference throughout this specification to "an embodiment," "some embodiments," "an exemplary embodiment," "an example," "a specific example," or "some examples," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variations can be made in the embodiments without departing from the scope of the present disclosure. The scope of the invention is defined by the claims and the like.

What is claimed is:

1. A window air conditioner comprising:

a casing including a receiving groove formed at an outer peripheral wall of the casing, the receiving groove having an open top, an open left side, and an open right side, and the casing being divided into an indoor part and an outdoor part by the receiving groove;

an indoor heat exchanger and an indoor fan arranged in the indoor part;

an outdoor heat exchanger and an outdoor fan arranged in the outdoor part; and a sealing assembly arranged in the receiving groove, and being rotatable around a rotation axis that is parallel to a length direction of the casing;

wherein the indoor part, the receiving groove, and the outdoor part are sequentially arranged along the length direction of the casing, the length direction being parallel to an indoor-outdoor direction.

2. The window air conditioner according to claim 1, wherein:

the sealing assembly is configured to seal a space between a window and a window sill of a window opening when the window air conditioner is mounted at the window sill.

3. The window air conditioner according to claim 2, wherein the sealing assembly comprises:

a first connecting component having a variable length, and comprising a fixing component and a sliding block, at least a part of the fixing component being arranged in the receiving groove, and the sliding block being slidably fitted with the fixing component; and a plurality of second connecting components detachably connected to one another and configured to adjust a length of the sealing assembly, one of the second connecting components being detachably connected to the sliding block.

4. The window air conditioner according to claim 3, wherein the sealing assembly further comprises a rotating bracket fixed at the casing, and the fixing component is rotatably arranged at the rotating bracket to enable the sealing assembly to be rotated to be stowed in the receiving groove.

5. The window air conditioner according to claim 4, further comprising:

an angle-positioning assembly configured to cooperate with the rotating bracket and the fixing component to fix a position of the fixing component at an angle.

6. The window air conditioner according to claim 5, wherein the angle-positioning assembly comprises:

a plurality of positioning recesses arranged in the rotating bracket and arranged in a ring; and a positioning protrusion arranged at the fixing component and configured to be switchably fitted with one of the plurality of positioning recesses to fix a position of the fixing component.

7. The window air conditioner according to claim 3, further comprising:

a slide-positioning assembly arranged at the fixing component and configured to cooperate with the sliding block to fix the sliding block at a position.

8. The window air conditioner according to claim 7, wherein the fixing component includes a sliding cavity, and at least a part of the sliding block extends into the sliding cavity.

9. The window air conditioner according to claim 3, wherein each of the second connecting components comprises an insertion portion, each of the second connecting components and the sliding block includes an insertion chamber, and each insertion portion is configured to be fitted with a corresponding insertion chamber in a pluggable manner.

10. The window air conditioner according to claim 9, wherein one of the insertion portion and an inner wall of the insertion chamber includes a resilient protrusion, another one of the insertion portion and the inner wall of the insertion chamber includes a recess, and the resilient protrusion is configured to extend into the recess.

11. The window air conditioner according to claim 9, further comprising:

a sealing end cover configured to seal an open end of the insertion chamber farthest from the fixing component.

12. The window air conditioner according to claim 1, wherein the casing comprises:

a chassis;

a rear case fixed at the chassis;

a front case fixed at the chassis, and spaced apart from the rear case in a front-rear direction to form the receiving groove.

13. The window air conditioner according to claim 12, wherein the chassis, the rear case, and the front case are independently machined parts.

14. The window air conditioner according to claim 12, wherein the casing further comprises an intermediate partition board fixed at the chassis and located in the receiving groove, the intermediate partition board having a front end and a rear end cooperating with the rear case and the front case, respectively.

15. The window air conditioner according to claim 12, wherein the rear case comprises:

a rear case seat having an open top and being fixed at the chassis; and a rear case cover covering the open top of the rear case seat.

16. The window air conditioner according to claim 15, wherein:

a part of a top wall of the rear case seat includes a supporting plate, and another part of the top wall of the rear case seat includes a supporting step surface;

the rear case cover covers an outer side of the supporting plate; and a lower end of the rear case cover is supported on the supporting step surface.

17. The window air conditioner according to claim 16, wherein the supporting plate includes a plurality of supporting bosses spaced apart from each other, and each of the supporting bosses abuts against an inner peripheral wall of the rear case cover.

18. The window air conditioner according to claim 16, wherein:

the supporting step surface includes a fastening hole; and the lower end of the rear case cover includes a fastener insert configured to extend into the fastening hole.

19. The window air conditioner according to claim 12, wherein the chassis is an integrally formed member, a position of the rear case on the chassis is fixed, and a position of the front case on the chassis is fixed.

20. A window air conditioner assembly comprising:

a window air conditioner including:

a casing including a receiving groove formed at an outer peripheral wall of the casing, the receiving groove having an open top, an open left side, and an open right side, and the casing being divided into an indoor part and an outdoor part by the receiving groove;

an indoor heat exchanger and an indoor fan arranged in the indoor part;

an outdoor heat exchanger and an outdoor fan arranged in the outdoor part; and a sealing assembly arranged in the receiving groove, and being rotatable around a rotation axis that is parallel to a length direction of the casing, wherein the indoor part, the receiving groove, and the outdoor part are sequentially arranged along the length direction of the casing, the length direction being parallel to an indoor-outdoor direction; and a mounting frame assembly configured to support the window air conditioner.

* * * * *